US006614413B2

(12) United States Patent
Tokunaga et al.

(10) Patent No.: US 6,614,413 B2
(45) **Date of Patent: *Sep. 2, 2003**

(54) METHOD OF DRIVING PLASMA DISPLAY PANEL

(75) Inventors: Tsutomu Tokunaga, Nakakoma-gun (JP); Tetsuya Shigeta, Nakakoma-gun (JP); Masahiro Suzuki, Nakakoma-gun (JP)

(73) Assignee: Pioneer Electronic Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,192

(22) Filed: Apr. 20, 1999

(65) Prior Publication Data

US 2002/0054000 A1 May 9, 2002

(30) Foreign Application Priority Data

| | | |
|---|---|---|
| Apr. 22, 1998 | (JP) | 10-112244 |
| Dec. 3, 1998 | (JP) | 10-344526 |
| Dec. 8, 1998 | (JP) | 10-348958 |
| Mar. 3, 1999 | (JP) | 11-056235 |
| Mar. 12, 1999 | (JP) | 11-066678 |

(51) Int. Cl.[7] ..... G09G 3/28; G09G 5/10
(52) U.S. Cl. ..... 345/63; 345/68; 345/690
(58) Field of Search ..... 345/60–63, 68, 345/147, 690–695

(56) References Cited

U.S. PATENT DOCUMENTS

| | | | | |
|---|---|---|---|---|
| 6,052,112 A | * | 4/2000 | Tanaka et al. | 345/147 |
| 6,091,398 A | * | 7/2000 | Shigeta | 345/147 |
| 6,097,358 A | * | 8/2000 | Hirakawa et al. | 345/63 |
| 6,144,364 A | * | 11/2000 | Otobe et al. | 345/63 |

FOREIGN PATENT DOCUMENTS

| | | | |
|---|---|---|---|
| EP | 0 782 167 A2 | 7/1997 | H01J/17/49 |
| EP | 0 836 171 A2 | 4/1998 | G09G/3/28 |
| FR | 2 740 253 | 4/1997 | G09G/3/28 |
| GB | 0836171 A2 * | 4/1998 | G09G/3/28 |

* cited by examiner

*Primary Examiner*—Richard Hjerpe
*Assistant Examiner*—Duc Q. Dinh
(74) *Attorney, Agent, or Firm*—Sughrue Mion, PLLC

(57) ABSTRACT

A method of driving a plasma display panel capable of improving the contrast with reduced power consumption while suppressing a pseudo-contour. In each of a plurality of subfields divided from a display period of one field, a pixel data writing stage is executed for selectively erasing and discharging wall charges formed in discharge cells in accordance with pixel data to set the discharge cells to light emitting cells and non-light emitting cells, and a light emission sustaining stage is executed for allowing the light emitting cells to sustain light emission for a time corresponding to weighting for each subfield. Also, a simultaneous resetting stage is provided for simultaneously resetting or discharging all discharge cells to form wall charges only in the first subfield in a group of subfields including at least two mutually consecutive subfields, and the erasing discharge is performed only in the pixel data writing stage in any subfield in the group of subfields.

20 Claims, 43 Drawing Sheets

[SELECTIVE ERASURE]

| Ds | HD 1 | 2 | 3 | 4 | 5 | 6 | 7 | 8 | 9 | 10 | 11 | 12 | 13 | 14 | DRIVING STATE IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FIG.3

| LUMINANCE | PIXEL DATA D | | | | | | CONVERTED PIXEL DATA HD | | | | | | | | |
|---|---|---|---|---|---|---|---|---|---|---|---|---|---|---|---|
| | | | | | | | SF1a | SF1b | SF1c | SF2a | SF2b | SF2c | SF3a | SF3b | SF3c |
| | 0 | 1 | 2 | 3 | 4 | 5 | 0 | 1 | 2 | 3 | 4 | 5 | 6 | 7 | 8 |
| 0 | 0 | 0 | 0 | 0 | 0 | 0 | 1 | 0 | 0 | 1 | 0 | 0 | 1 | 0 | 0 |
| 1 | 0 | 0 | 0 | 0 | 0 | 1 | 0 | 1 | 0 | 1 | 0 | 0 | 1 | 0 | 0 |
| 2 | 0 | 0 | 0 | 0 | 1 | 0 | 0 | 0 | 1 | 1 | 0 | 0 | 1 | 0 | 0 |
| 3 | 0 | 0 | 0 | 0 | 1 | 1 | 0 | 0 | 0 | 1 | 0 | 0 | 1 | 0 | 0 |
| 4 | 0 | 0 | 0 | 1 | 0 | 0 | 1 | 0 | 0 | 0 | 1 | 0 | 1 | 0 | 0 |
| 5 | 0 | 0 | 0 | 1 | 0 | 1 | 0 | 1 | 0 | 0 | 1 | 0 | 1 | 0 | 0 |
| 6 | 0 | 0 | 0 | 1 | 1 | 0 | 0 | 0 | 1 | 0 | 1 | 0 | 1 | 0 | 0 |
| 7 | 0 | 0 | 0 | 1 | 1 | 1 | 0 | 0 | 0 | 0 | 1 | 0 | 1 | 0 | 0 |
| 8 | 0 | 0 | 1 | 0 | 0 | 0 | 1 | 0 | 0 | 0 | 0 | 1 | 1 | 0 | 0 |
| 9 | 0 | 0 | 1 | 0 | 0 | 1 | 0 | 1 | 0 | 0 | 0 | 1 | 1 | 0 | 0 |
| 10 | 0 | 0 | 1 | 0 | 1 | 0 | 0 | 0 | 1 | 0 | 0 | 1 | 1 | 0 | 0 |
| 11 | 0 | 0 | 1 | 0 | 1 | 1 | 0 | 0 | 0 | 0 | 0 | 1 | 1 | 0 | 0 |
| 12 | 0 | 0 | 1 | 1 | 0 | 0 | 1 | 0 | 0 | 0 | 0 | 0 | 1 | 0 | 0 |
| 13 | 0 | 0 | 1 | 1 | 0 | 1 | 0 | 1 | 0 | 0 | 0 | 0 | 1 | 0 | 0 |
| 14 | 0 | 0 | 1 | 1 | 1 | 0 | 0 | 0 | 1 | 0 | 0 | 0 | 1 | 0 | 0 |
| 15 | 0 | 0 | 1 | 1 | 1 | 1 | 0 | 0 | 0 | 0 | 0 | 0 | 1 | 0 | 0 |
| 16 | 0 | 1 | 0 | 0 | 0 | 0 | 1 | 0 | 0 | 1 | 0 | 0 | 0 | 1 | 0 |
| 17 | 0 | 1 | 0 | 0 | 0 | 1 | 0 | 1 | 0 | 1 | 0 | 0 | 0 | 1 | 0 |
| 18 | 0 | 1 | 0 | 0 | 1 | 0 | 0 | 0 | 1 | 1 | 0 | 0 | 0 | 1 | 0 |
| 19 | 0 | 1 | 0 | 0 | 1 | 1 | 0 | 0 | 0 | 1 | 0 | 0 | 0 | 1 | 0 |
| 20 | 0 | 1 | 0 | 1 | 0 | 0 | 1 | 0 | 0 | 0 | 1 | 0 | 0 | 1 | 0 |
| 21 | 0 | 1 | 0 | 1 | 0 | 1 | 0 | 1 | 0 | 0 | 1 | 0 | 0 | 1 | 0 |
| 22 | 0 | 1 | 0 | 1 | 1 | 0 | 0 | 0 | 1 | 0 | 1 | 0 | 0 | 1 | 0 |
| 23 | 0 | 1 | 0 | 1 | 1 | 1 | 0 | 0 | 0 | 0 | 1 | 0 | 0 | 1 | 0 |
| 24 | 0 | 1 | 1 | 0 | 0 | 0 | 1 | 0 | 0 | 0 | 0 | 1 | 0 | 1 | 0 |
| 25 | 0 | 1 | 1 | 0 | 0 | 1 | 0 | 1 | 0 | 0 | 0 | 1 | 0 | 1 | 0 |
| 26 | 0 | 1 | 1 | 0 | 1 | 0 | 0 | 0 | 1 | 0 | 0 | 1 | 0 | 1 | 0 |
| 27 | 0 | 1 | 1 | 0 | 1 | 1 | 0 | 0 | 0 | 0 | 0 | 1 | 0 | 1 | 0 |
| 28 | 0 | 1 | 1 | 1 | 0 | 0 | 1 | 0 | 0 | 0 | 0 | 0 | 0 | 1 | 0 |
| 29 | 0 | 1 | 1 | 1 | 0 | 1 | 0 | 1 | 0 | 0 | 0 | 0 | 0 | 1 | 0 |
| 30 | 0 | 1 | 1 | 1 | 1 | 0 | 0 | 0 | 1 | 0 | 0 | 0 | 0 | 1 | 0 |
| 31 | 0 | 1 | 1 | 1 | 1 | 1 | 0 | 0 | 0 | 0 | 0 | 0 | 0 | 1 | 0 |

FIG. 4

| LUMINANCE | PIXEL DATA D | | | | | | CONVERTED PIXEL DATA HD | | | | | | | | |
|---|---|---|---|---|---|---|---|---|---|---|---|---|---|---|---|
| | | | | | | | SF1a | SF1b | SF1c | SF2a | SF2b | SF2c | SF3a | SF3b | SF3c |
| | 0 | 1 | 2 | 3 | 4 | 5 | 0 | 1 | 2 | 3 | 4 | 5 | 6 | 7 | 8 |
| 32 | 1 | 0 | 0 | 0 | 0 | 0 | 1 | 0 | 0 | 1 | 0 | 0 | 0 | 0 | 1 |
| 33 | 1 | 0 | 0 | 0 | 0 | 1 | 0 | 1 | 0 | 1 | 0 | 0 | 0 | 0 | 1 |
| 34 | 1 | 0 | 0 | 0 | 1 | 0 | 0 | 0 | 1 | 1 | 0 | 0 | 0 | 0 | 1 |
| 35 | 1 | 0 | 0 | 0 | 1 | 1 | 0 | 0 | 0 | 1 | 0 | 0 | 0 | 0 | 1 |
| 36 | 1 | 0 | 0 | 1 | 0 | 0 | 1 | 0 | 0 | 0 | 1 | 0 | 0 | 0 | 1 |
| 37 | 1 | 0 | 0 | 1 | 0 | 1 | 0 | 1 | 0 | 0 | 1 | 0 | 0 | 0 | 1 |
| 38 | 1 | 0 | 0 | 1 | 1 | 0 | 0 | 0 | 1 | 0 | 1 | 0 | 0 | 0 | 1 |
| 39 | 1 | 0 | 0 | 1 | 1 | 1 | 0 | 0 | 0 | 0 | 1 | 0 | 0 | 0 | 1 |
| 40 | 1 | 0 | 1 | 0 | 0 | 0 | 1 | 0 | 0 | 0 | 0 | 1 | 0 | 0 | 1 |
| 41 | 1 | 0 | 1 | 0 | 0 | 1 | 0 | 1 | 0 | 0 | 0 | 1 | 0 | 0 | 1 |
| 42 | 1 | 0 | 1 | 0 | 1 | 0 | 0 | 0 | 1 | 0 | 0 | 1 | 0 | 0 | 1 |
| 43 | 1 | 0 | 1 | 0 | 1 | 1 | 0 | 0 | 0 | 0 | 0 | 1 | 0 | 0 | 1 |
| 44 | 1 | 0 | 1 | 1 | 0 | 0 | 1 | 0 | 0 | 0 | 0 | 0 | 0 | 0 | 1 |
| 45 | 1 | 0 | 1 | 1 | 0 | 1 | 0 | 1 | 0 | 0 | 0 | 0 | 0 | 0 | 1 |
| 46 | 1 | 0 | 1 | 1 | 1 | 0 | 0 | 0 | 1 | 0 | 0 | 0 | 0 | 0 | 1 |
| 47 | 1 | 0 | 1 | 1 | 1 | 1 | 0 | 0 | 0 | 0 | 0 | 0 | 0 | 0 | 1 |
| 48 | 1 | 1 | 0 | 0 | 0 | 0 | 1 | 0 | 0 | 1 | 0 | 0 | 0 | 0 | 0 |
| 49 | 1 | 1 | 0 | 0 | 0 | 1 | 0 | 1 | 0 | 1 | 0 | 0 | 0 | 0 | 0 |
| 50 | 1 | 1 | 0 | 0 | 1 | 0 | 0 | 0 | 1 | 1 | 0 | 0 | 0 | 0 | 0 |
| 51 | 1 | 1 | 0 | 0 | 1 | 1 | 0 | 0 | 0 | 1 | 0 | 0 | 0 | 0 | 0 |
| 52 | 1 | 1 | 0 | 1 | 0 | 0 | 1 | 0 | 0 | 0 | 1 | 0 | 0 | 0 | 0 |
| 53 | 1 | 1 | 0 | 1 | 0 | 1 | 0 | 1 | 0 | 0 | 1 | 0 | 0 | 0 | 0 |
| 54 | 1 | 1 | 0 | 1 | 1 | 0 | 0 | 0 | 1 | 0 | 1 | 0 | 0 | 0 | 0 |
| 55 | 1 | 1 | 0 | 1 | 1 | 1 | 0 | 0 | 0 | 0 | 1 | 0 | 0 | 0 | 0 |
| 56 | 1 | 1 | 1 | 0 | 0 | 0 | 1 | 0 | 0 | 0 | 0 | 1 | 0 | 0 | 0 |
| 57 | 1 | 1 | 1 | 0 | 0 | 1 | 0 | 1 | 0 | 0 | 0 | 1 | 0 | 0 | 0 |
| 58 | 1 | 1 | 1 | 0 | 1 | 0 | 0 | 0 | 1 | 0 | 0 | 1 | 0 | 0 | 0 |
| 59 | 1 | 1 | 1 | 0 | 1 | 1 | 0 | 0 | 0 | 0 | 0 | 1 | 0 | 0 | 0 |
| 60 | 1 | 1 | 1 | 1 | 0 | 0 | 1 | 0 | 0 | 0 | 0 | 0 | 0 | 0 | 0 |
| 61 | 1 | 1 | 1 | 1 | 0 | 1 | 0 | 1 | 0 | 0 | 0 | 0 | 0 | 0 | 0 |
| 62 | 1 | 1 | 1 | 1 | 1 | 0 | 0 | 0 | 1 | 0 | 0 | 0 | 0 | 0 | 0 |
| 63 | 1 | 1 | 1 | 1 | 1 | 1 | 0 | 0 | 0 | 0 | 0 | 0 | 0 | 0 | 0 |

FIG.7

| LUMINANCE | PIXEL DATA D | | | | | | CONVERTED PIXEL DATA HD | | | | | | | | | |
|---|---|---|---|---|---|---|---|---|---|---|---|---|---|---|---|---|
| | | | | | | | SF1 | SF2 | SF3 | SF4a | SF4b | SF4c | SF4d | SF4e | SF4f | SF4g |
| | 0 | 1 | 2 | 3 | 4 | 5 | 0 | 1 | 2 | 3 | 4 | 5 | 6 | 7 | 8 | 9 |
| 0 | 0 | 0 | 0 | 0 | 0 | 0 | 1 | 1 | 1 | 1 | 0 | 0 | 0 | 0 | 0 | 0 |
| 1 | 0 | 0 | 0 | 0 | 0 | 1 | 0 | 1 | 1 | 1 | 0 | 0 | 0 | 0 | 0 | 0 |
| 2 | 0 | 0 | 0 | 0 | 1 | 0 | 1 | 0 | 1 | 1 | 0 | 0 | 0 | 0 | 0 | 0 |
| 3 | 0 | 0 | 0 | 0 | 1 | 1 | 0 | 0 | 1 | 1 | 0 | 0 | 0 | 0 | 0 | 0 |
| 4 | 0 | 0 | 0 | 1 | 0 | 0 | 1 | 1 | 0 | 1 | 0 | 0 | 0 | 0 | 0 | 0 |
| 5 | 0 | 0 | 0 | 1 | 0 | 1 | 0 | 1 | 0 | 1 | 0 | 0 | 0 | 0 | 0 | 0 |
| 6 | 0 | 0 | 0 | 1 | 1 | 0 | 1 | 0 | 0 | 1 | 0 | 0 | 0 | 0 | 0 | 0 |
| 7 | 0 | 0 | 0 | 1 | 1 | 1 | 0 | 0 | 0 | 1 | 0 | 0 | 0 | 0 | 0 | 0 |
| 8 | 0 | 0 | 1 | 0 | 0 | 0 | 1 | 1 | 1 | 0 | 1 | 0 | 0 | 0 | 0 | 0 |
| 9 | 0 | 0 | 1 | 0 | 0 | 1 | 0 | 1 | 1 | 0 | 1 | 0 | 0 | 0 | 0 | 0 |
| 10 | 0 | 0 | 1 | 0 | 1 | 0 | 1 | 0 | 1 | 0 | 1 | 0 | 0 | 0 | 0 | 0 |
| 11 | 0 | 0 | 1 | 0 | 1 | 1 | 0 | 0 | 1 | 0 | 1 | 0 | 0 | 0 | 0 | 0 |
| 12 | 0 | 0 | 1 | 1 | 0 | 0 | 1 | 1 | 0 | 0 | 1 | 0 | 0 | 0 | 0 | 0 |
| 13 | 0 | 0 | 1 | 1 | 0 | 1 | 0 | 1 | 0 | 0 | 1 | 0 | 0 | 0 | 0 | 0 |
| 14 | 0 | 0 | 1 | 1 | 1 | 0 | 1 | 0 | 0 | 0 | 1 | 0 | 0 | 0 | 0 | 0 |
| 15 | 0 | 0 | 1 | 1 | 1 | 1 | 0 | 0 | 0 | 0 | 1 | 0 | 0 | 0 | 0 | 0 |
| 16 | 0 | 1 | 0 | 0 | 0 | 0 | 1 | 1 | 1 | 0 | 0 | 1 | 0 | 0 | 0 | 0 |
| 17 | 0 | 1 | 0 | 0 | 0 | 1 | 0 | 1 | 1 | 0 | 0 | 1 | 0 | 0 | 0 | 0 |
| 18 | 0 | 1 | 0 | 0 | 1 | 0 | 1 | 0 | 1 | 0 | 0 | 1 | 0 | 0 | 0 | 0 |
| 19 | 0 | 1 | 0 | 0 | 1 | 1 | 0 | 0 | 1 | 0 | 0 | 1 | 0 | 0 | 0 | 0 |
| 20 | 0 | 1 | 0 | 1 | 0 | 0 | 1 | 1 | 0 | 0 | 0 | 1 | 0 | 0 | 0 | 0 |
| 21 | 0 | 1 | 0 | 1 | 0 | 1 | 0 | 1 | 0 | 0 | 0 | 1 | 0 | 0 | 0 | 0 |
| 22 | 0 | 1 | 0 | 1 | 1 | 0 | 1 | 0 | 0 | 0 | 0 | 1 | 0 | 0 | 0 | 0 |
| 23 | 0 | 1 | 0 | 1 | 1 | 1 | 0 | 0 | 0 | 0 | 0 | 1 | 0 | 0 | 0 | 0 |
| 24 | 0 | 1 | 1 | 0 | 0 | 0 | 1 | 1 | 1 | 0 | 0 | 0 | 1 | 0 | 0 | 0 |
| 25 | 0 | 1 | 1 | 0 | 0 | 1 | 0 | 1 | 1 | 0 | 0 | 0 | 1 | 0 | 0 | 0 |
| 26 | 0 | 1 | 1 | 0 | 1 | 0 | 1 | 0 | 1 | 0 | 0 | 0 | 1 | 0 | 0 | 0 |
| 27 | 0 | 1 | 1 | 0 | 1 | 1 | 0 | 0 | 1 | 0 | 0 | 0 | 1 | 0 | 0 | 0 |
| 28 | 0 | 1 | 1 | 1 | 0 | 0 | 1 | 1 | 0 | 0 | 0 | 0 | 1 | 0 | 0 | 0 |
| 29 | 0 | 1 | 1 | 1 | 0 | 1 | 0 | 1 | 0 | 0 | 0 | 0 | 1 | 0 | 0 | 0 |
| 30 | 0 | 1 | 1 | 1 | 1 | 0 | 1 | 0 | 0 | 0 | 0 | 0 | 1 | 0 | 0 | 0 |
| 31 | 0 | 1 | 1 | 1 | 1 | 1 | 0 | 0 | 0 | 0 | 0 | 0 | 1 | 0 | 0 | 0 |

FIG. 8

| LUMINANCE | PIXEL DATA D | | | | | | CONVERTED PIXEL DATA | | | | | | | | | |
|---|---|---|---|---|---|---|---|---|---|---|---|---|---|---|---|---|
| | | | | | | | SF1 | SF2 | SF3 | SF4a | SF4b | SF4c | SF4d | SF4e | SF4f | SF4g |
| | 0 | 1 | 2 | 3 | 4 | 5 | 0 | 1 | 2 | 3 | 4 | 5 | 6 | 7 | 8 | 9 |
| 32 | 1 | 0 | 0 | 0 | 0 | 0 | 1 | 1 | 1 | 0 | 0 | 0 | 0 | 1 | 0 | 0 |
| 33 | 1 | 0 | 0 | 0 | 0 | 1 | 0 | 1 | 1 | 0 | 0 | 0 | 0 | 1 | 0 | 0 |
| 34 | 1 | 0 | 0 | 0 | 1 | 0 | 1 | 0 | 1 | 0 | 0 | 0 | 0 | 1 | 0 | 0 |
| 35 | 1 | 0 | 0 | 0 | 1 | 1 | 0 | 0 | 1 | 0 | 0 | 0 | 0 | 1 | 0 | 0 |
| 36 | 1 | 0 | 0 | 1 | 0 | 0 | 1 | 1 | 0 | 0 | 0 | 0 | 0 | 1 | 0 | 0 |
| 37 | 1 | 0 | 0 | 1 | 0 | 1 | 0 | 1 | 0 | 0 | 0 | 0 | 0 | 1 | 0 | 0 |
| 38 | 1 | 0 | 0 | 1 | 1 | 0 | 1 | 0 | 0 | 0 | 0 | 0 | 0 | 1 | 0 | 0 |
| 39 | 1 | 0 | 0 | 1 | 1 | 1 | 0 | 0 | 0 | 0 | 0 | 0 | 0 | 1 | 0 | 0 |
| 40 | 1 | 0 | 1 | 0 | 0 | 0 | 1 | 1 | 1 | 0 | 0 | 0 | 0 | 0 | 1 | 0 |
| 41 | 1 | 0 | 1 | 0 | 0 | 1 | 0 | 1 | 1 | 0 | 0 | 0 | 0 | 0 | 1 | 0 |
| 42 | 1 | 0 | 1 | 0 | 1 | 0 | 1 | 0 | 1 | 0 | 0 | 0 | 0 | 0 | 1 | 0 |
| 43 | 1 | 0 | 1 | 0 | 1 | 1 | 0 | 0 | 1 | 0 | 0 | 0 | 0 | 0 | 1 | 0 |
| 44 | 1 | 0 | 1 | 1 | 0 | 0 | 1 | 1 | 0 | 0 | 0 | 0 | 0 | 0 | 1 | 0 |
| 45 | 1 | 0 | 1 | 1 | 0 | 1 | 0 | 1 | 0 | 0 | 0 | 0 | 0 | 0 | 1 | 0 |
| 46 | 1 | 0 | 1 | 1 | 1 | 0 | 1 | 0 | 0 | 0 | 0 | 0 | 0 | 0 | 1 | 0 |
| 47 | 1 | 0 | 1 | 1 | 1 | 1 | 0 | 0 | 0 | 0 | 0 | 0 | 0 | 0 | 1 | 0 |
| 48 | 1 | 1 | 0 | 0 | 0 | 0 | 1 | 1 | 1 | 0 | 0 | 0 | 0 | 0 | 0 | 1 |
| 49 | 1 | 1 | 0 | 0 | 0 | 1 | 0 | 1 | 1 | 0 | 0 | 0 | 0 | 0 | 0 | 1 |
| 50 | 1 | 1 | 0 | 0 | 1 | 0 | 1 | 0 | 1 | 0 | 0 | 0 | 0 | 0 | 0 | 1 |
| 51 | 1 | 1 | 0 | 0 | 1 | 1 | 0 | 0 | 1 | 0 | 0 | 0 | 0 | 0 | 0 | 1 |
| 52 | 1 | 1 | 0 | 1 | 0 | 0 | 1 | 1 | 0 | 0 | 0 | 0 | 0 | 0 | 0 | 1 |
| 53 | 1 | 1 | 0 | 1 | 0 | 1 | 0 | 1 | 0 | 0 | 0 | 0 | 0 | 0 | 0 | 1 |
| 54 | 1 | 1 | 0 | 1 | 1 | 0 | 1 | 0 | 0 | 0 | 0 | 0 | 0 | 0 | 0 | 1 |
| 55 | 1 | 1 | 0 | 1 | 1 | 1 | 0 | 0 | 0 | 0 | 0 | 0 | 0 | 0 | 0 | 1 |
| 56 | 1 | 1 | 1 | 0 | 0 | 0 | 1 | 1 | 1 | 0 | 0 | 0 | 0 | 0 | 0 | 0 |
| 57 | 1 | 1 | 1 | 0 | 0 | 1 | 0 | 1 | 1 | 0 | 0 | 0 | 0 | 0 | 0 | 0 |
| 58 | 1 | 1 | 1 | 0 | 1 | 0 | 1 | 0 | 1 | 0 | 0 | 0 | 0 | 0 | 0 | 0 |
| 59 | 1 | 1 | 1 | 0 | 1 | 1 | 0 | 0 | 1 | 0 | 0 | 0 | 0 | 0 | 0 | 0 |
| 60 | 1 | 1 | 1 | 1 | 0 | 0 | 1 | 1 | 0 | 0 | 0 | 0 | 0 | 0 | 0 | 0 |
| 61 | 1 | 1 | 1 | 1 | 0 | 1 | 0 | 1 | 0 | 0 | 0 | 0 | 0 | 0 | 0 | 0 |
| 62 | 1 | 1 | 1 | 1 | 1 | 0 | 1 | 0 | 0 | 0 | 0 | 0 | 0 | 0 | 0 | 0 |
| 63 | 1 | 1 | 1 | 1 | 1 | 1 | 0 | 0 | 0 | 0 | 0 | 0 | 0 | 0 | 0 | 0 |

FIG.11

| LUMINANCE | PIXEL DATA D | | | | | | CONVERTED PIXEL DATA HD | | | | | | | | | |
|---|---|---|---|---|---|---|---|---|---|---|---|---|---|---|---|---|
| | | | | | | | SF1 | SF2 | SF3 | SF4a | SF4b | SF4c | SF4d | SF4e | SF4f | SF4g |
| | 0 | 1 | 2 | 3 | 4 | 5 | 0 | 1 | 2 | 3 | 4 | 5 | 6 | 7 | 8 | 9 |
| 0 | 0 | 0 | 0 | 0 | 0 | 0 | 1 | 1 | 1 | 1 | 0 | 0 | 0 | 0 | 0 | 0 |
| 1 | 0 | 0 | 0 | 0 | 0 | 1 | 0 | 1 | 1 | 1 | 0 | 0 | 0 | 0 | 0 | 0 |
| 2 | 0 | 0 | 0 | 0 | 1 | 0 | 1 | 0 | 1 | 1 | 0 | 0 | 0 | 0 | 0 | 0 |
| 3 | 0 | 0 | 0 | 0 | 1 | 1 | 0 | 0 | 1 | 1 | 0 | 0 | 0 | 0 | 0 | 0 |
| 4 | 0 | 0 | 0 | 1 | 0 | 0 | 1 | 1 | 0 | 1 | 0 | 0 | 0 | 0 | 0 | 0 |
| 5 | 0 | 0 | 0 | 1 | 0 | 1 | 0 | 1 | 0 | 1 | 0 | 0 | 0 | 0 | 0 | 0 |
| 6 | 0 | 0 | 0 | 1 | 1 | 0 | 1 | 0 | 0 | 1 | 0 | 0 | 0 | 0 | 0 | 0 |
| 7 | 0 | 0 | 0 | 1 | 1 | 1 | 0 | 0 | 0 | 1 | 0 | 0 | 0 | 0 | 0 | 0 |
| 8 | 0 | 0 | 1 | 0 | 0 | 0 | 1 | 1 | 0 | 0 | 1 | 0 | 0 | 0 | 0 | 0 |
| 9 | 0 | 0 | 1 | 0 | 0 | 1 | 0 | 1 | 0 | 0 | 1 | 0 | 0 | 0 | 0 | 0 |
| 10 | 0 | 0 | 1 | 0 | 1 | 0 | 1 | 0 | 0 | 0 | 1 | 0 | 0 | 0 | 0 | 0 |
| 11 | 0 | 0 | 1 | 0 | 1 | 1 | 0 | 0 | 0 | 0 | 1 | 0 | 0 | 0 | 0 | 0 |
| 12 | 0 | 0 | 1 | 1 | 0 | 0 | 1 | 1 | 1 | 0 | 0 | 1 | 0 | 0 | 0 | 0 |
| 13 | 0 | 0 | 1 | 1 | 0 | 1 | 0 | 1 | 1 | 0 | 0 | 1 | 0 | 0 | 0 | 0 |
| 14 | 0 | 0 | 1 | 1 | 1 | 0 | 1 | 0 | 1 | 0 | 0 | 1 | 0 | 0 | 0 | 0 |
| 15 | 0 | 0 | 1 | 1 | 1 | 1 | 0 | 0 | 1 | 0 | 0 | 1 | 0 | 0 | 0 | 0 |
| 16 | 0 | 1 | 0 | 0 | 0 | 0 | 1 | 1 | 0 | 0 | 0 | 1 | 0 | 0 | 0 | 0 |
| 17 | 0 | 1 | 0 | 0 | 0 | 1 | 0 | 1 | 0 | 0 | 0 | 1 | 0 | 0 | 0 | 0 |
| 18 | 0 | 1 | 0 | 0 | 1 | 0 | 1 | 0 | 0 | 0 | 0 | 1 | 0 | 0 | 0 | 0 |
| 19 | 0 | 1 | 0 | 0 | 1 | 1 | 0 | 0 | 0 | 0 | 0 | 1 | 0 | 0 | 0 | 0 |
| 20 | 0 | 1 | 0 | 1 | 0 | 0 | 1 | 1 | 1 | 0 | 0 | 0 | 1 | 0 | 0 | 0 |
| 21 | 0 | 1 | 0 | 1 | 0 | 1 | 0 | 1 | 1 | 0 | 0 | 0 | 1 | 0 | 0 | 0 |
| 22 | 0 | 1 | 0 | 1 | 1 | 0 | 1 | 0 | 1 | 0 | 0 | 0 | 1 | 0 | 0 | 0 |
| 23 | 0 | 1 | 0 | 1 | 1 | 1 | 0 | 0 | 1 | 0 | 0 | 0 | 1 | 0 | 0 | 0 |
| 24 | 0 | 1 | 1 | 0 | 0 | 0 | 1 | 1 | 0 | 0 | 0 | 0 | 1 | 0 | 0 | 0 |
| 25 | 0 | 1 | 1 | 0 | 0 | 1 | 0 | 1 | 0 | 0 | 0 | 0 | 1 | 0 | 0 | 0 |
| 26 | 0 | 1 | 1 | 0 | 1 | 0 | 1 | 0 | 0 | 0 | 0 | 0 | 1 | 0 | 0 | 0 |
| 27 | 0 | 1 | 1 | 0 | 1 | 1 | 0 | 0 | 0 | 0 | 0 | 0 | 1 | 0 | 0 | 0 |
| 28 | 0 | 1 | 1 | 1 | 0 | 0 | 1 | 1 | 1 | 0 | 0 | 0 | 0 | 1 | 0 | 0 |
| 29 | 0 | 1 | 1 | 1 | 0 | 1 | 0 | 1 | 1 | 0 | 0 | 0 | 0 | 1 | 0 | 0 |
| 30 | 0 | 1 | 1 | 1 | 1 | 0 | 1 | 0 | 1 | 0 | 0 | 0 | 0 | 1 | 0 | 0 |
| 31 | 0 | 1 | 1 | 1 | 1 | 1 | 0 | 0 | 1 | 0 | 0 | 0 | 0 | 1 | 0 | 0 |

FIG.12

| LUMINANCE | PIXEL DATA D | | | | | | CONVERTED PIXEL DATA HD | | | | | | | | | |
|---|---|---|---|---|---|---|---|---|---|---|---|---|---|---|---|---|
| | | | | | | | SF1 | SF2 | SF3 | SF4a | SF4b | SF4c | SF4d | SF4e | SF4f | SF4g |
| | 0 | 1 | 2 | 3 | 4 | 5 | 0 | 1 | 2 | 3 | 4 | 5 | 6 | 7 | 8 | 9 |
| 32 | 1 | 0 | 0 | 0 | 0 | 0 | 1 | 1 | 0 | 0 | 0 | 0 | 0 | 1 | 0 | 0 |
| 33 | 1 | 0 | 0 | 0 | 0 | 1 | 0 | 1 | 0 | 0 | 0 | 0 | 0 | 1 | 0 | 0 |
| 34 | 1 | 0 | 0 | 0 | 1 | 0 | 1 | 0 | 0 | 0 | 0 | 0 | 0 | 1 | 0 | 0 |
| 35 | 1 | 0 | 0 | 0 | 1 | 1 | 0 | 0 | 0 | 0 | 0 | 0 | 0 | 1 | 0 | 0 |
| 36 | 1 | 0 | 0 | 1 | 0 | 0 | 1 | 1 | 1 | 0 | 0 | 0 | 0 | 0 | 1 | 0 |
| 37 | 1 | 0 | 0 | 1 | 0 | 1 | 0 | 1 | 1 | 0 | 0 | 0 | 0 | 0 | 1 | 0 |
| 38 | 1 | 0 | 0 | 1 | 1 | 0 | 1 | 0 | 1 | 0 | 0 | 0 | 0 | 0 | 1 | 0 |
| 39 | 1 | 0 | 0 | 1 | 1 | 1 | 0 | 0 | 1 | 0 | 0 | 0 | 0 | 0 | 1 | 0 |
| 40 | 1 | 0 | 1 | 0 | 0 | 0 | 1 | 1 | 0 | 0 | 0 | 0 | 0 | 0 | 1 | 0 |
| 41 | 1 | 0 | 1 | 0 | 0 | 1 | 0 | 1 | 0 | 0 | 0 | 0 | 0 | 0 | 1 | 0 |
| 42 | 1 | 0 | 1 | 0 | 1 | 0 | 1 | 0 | 0 | 0 | 0 | 0 | 0 | 0 | 1 | 0 |
| 43 | 1 | 0 | 1 | 0 | 1 | 1 | 0 | 0 | 0 | 0 | 0 | 0 | 0 | 0 | 1 | 0 |
| 44 | 1 | 0 | 1 | 1 | 0 | 0 | 1 | 1 | 1 | 0 | 0 | 0 | 0 | 0 | 0 | 1 |
| 45 | 1 | 0 | 1 | 1 | 0 | 1 | 0 | 1 | 1 | 0 | 0 | 0 | 0 | 0 | 0 | 1 |
| 46 | 1 | 0 | 1 | 1 | 1 | 0 | 1 | 0 | 1 | 0 | 0 | 0 | 0 | 0 | 0 | 1 |
| 47 | 1 | 0 | 1 | 1 | 1 | 1 | 0 | 0 | 1 | 0 | 0 | 0 | 0 | 0 | 0 | 1 |
| 48 | 1 | 1 | 0 | 0 | 0 | 0 | 1 | 1 | 0 | 0 | 0 | 0 | 0 | 0 | 0 | 1 |
| 49 | 1 | 1 | 0 | 0 | 0 | 1 | 0 | 1 | 0 | 0 | 0 | 0 | 0 | 0 | 0 | 1 |
| 50 | 1 | 1 | 0 | 0 | 1 | 0 | 1 | 0 | 0 | 0 | 0 | 0 | 0 | 0 | 0 | 1 |
| 51 | 1 | 1 | 0 | 0 | 1 | 1 | 0 | 0 | 0 | 0 | 0 | 0 | 0 | 0 | 0 | 1 |
| 56 | 1 | 1 | 0 | 1 | 0 | 0 | 1 | 1 | 1 | 0 | 0 | 0 | 0 | 0 | 0 | 0 |
| 56 | 1 | 1 | 0 | 1 | 0 | 1 | 1 | 1 | 1 | 0 | 0 | 0 | 0 | 0 | 0 | 0 |
| 56 | 1 | 1 | 0 | 1 | 1 | 0 | 1 | 1 | 1 | 0 | 0 | 0 | 0 | 0 | 0 | 0 |
| 56 | 1 | 1 | 0 | 1 | 1 | 1 | 1 | 1 | 1 | 0 | 0 | 0 | 0 | 0 | 0 | 0 |
| 56 | 1 | 1 | 1 | 0 | 0 | 0 | 1 | 1 | 1 | 0 | 0 | 0 | 0 | 0 | 0 | 0 |
| 56 | 1 | 1 | 1 | 0 | 0 | 1 | 1 | 1 | 1 | 0 | 0 | 0 | 0 | 0 | 0 | 0 |
| 63 | 1 | 1 | 1 | 0 | 1 | 0 | 0 | 0 | 0 | 0 | 0 | 0 | 0 | 0 | 0 | 0 |
| 63 | 1 | 1 | 1 | 0 | 1 | 1 | 0 | 0 | 0 | 0 | 0 | 0 | 0 | 0 | 0 | 0 |
| 63 | 1 | 1 | 1 | 1 | 0 | 0 | 0 | 0 | 0 | 0 | 0 | 0 | 0 | 0 | 0 | 0 |
| 63 | 1 | 1 | 1 | 1 | 0 | 1 | 0 | 0 | 0 | 0 | 0 | 0 | 0 | 0 | 0 | 0 |
| 63 | 1 | 1 | 1 | 1 | 1 | 0 | 0 | 0 | 0 | 0 | 0 | 0 | 0 | 0 | 0 | 0 |
| 63 | 1 | 1 | 1 | 1 | 1 | 1 | 0 | 0 | 0 | 0 | 0 | 0 | 0 | 0 | 0 | 0 |

FIG. 20

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| MODE 1 | 1 | 3 | 5 | 8 | 10 | 13 | 16 | 19 | 22 | 25 | 28 | 32 | 35 | 39 |
| MODE 2 | 2 | 6 | 10 | 16 | 20 | 26 | 32 | 38 | 44 | 50 | 56 | 64 | 70 | 78 |
| MODE 3 | 3 | 9 | 15 | 24 | 30 | 39 | 48 | 57 | 66 | 75 | 84 | 96 | 105 | 117 |
| MODE 4 | 4 | 12 | 20 | 32 | 40 | 52 | 64 | 76 | 88 | 100 | 112 | 128 | 140 | 156 |

FIG. 22

| LUMINANCE | DBL | LUMINANCE | HDP | LUMINANCE | DBL | LUMINANCE | HDP |
|---|---|---|---|---|---|---|---|
| | 0 ~ 7 | | 0 ~ 7 | | 0 ~ 7 | | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 23

| LUMINANCE | $D_{BL}$ | LUMINANCE | $HD_P$ | LUMINANCE | $D_{BL}$ | LUMINANCE | $HD_P$ |
|---|---|---|---|---|---|---|---|
| | 0 ~ 7 | | 0 ~ 7 | | 0 ~ 7 | | 0 ~ 7 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG. 28

[SELECTIVE ERASURE]

| Ds | HD 1 | 2 | 3 | 4 | 5 | 6 | 7 | 8 | 9 | 10 | 11 | 12 | 13 | 14 | DRIVING STATE IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FIG.29

[SELECTIVE WRITING]

| Ds | HD 14 | 13 | 12 | 11 | 10 | 9 | 8 | 7 | 6 | 5 | 4 | 3 | 2 | 1 | DRIVING STATE IN ONE FIELD SF 14 | SF 13 | SF 12 | SF 11 | SF 10 | SF 9 | SF 8 | SF 7 | SF 6 | SF 5 | SF 4 | SF 3 | SF 2 | SF 1 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | 0 |
| 0001 | 0 | 0 | 0 | 0 | 0 | 0 | 0 | 0 | 0 | 0 | 0 | 0 | 0 | 1 | | | | | | | | | | | | | | ● | 1 |
| 0010 | 0 | 0 | 0 | 0 | 0 | 0 | 0 | 0 | 0 | 0 | 0 | 0 | 1 | 0 | | | | | | | | | | | | | ● | ○ | 4 |
| 0011 | 0 | 0 | 0 | 0 | 0 | 0 | 0 | 0 | 0 | 0 | 0 | 1 | 0 | 0 | | | | | | | | | | | | ● | ○ | ○ | 9 |
| 0100 | 0 | 0 | 0 | 0 | 0 | 0 | 0 | 0 | 0 | 0 | 1 | 0 | 0 | 0 | | | | | | | | | | | ● | ○ | ○ | ○ | 17 |
| 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 27 |
| 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 40 |
| 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 56 |
| 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 75 |
| 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 97 |
| 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 122 |
| 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 150 |
| 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 182 |
| 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 217 |
| 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 256 |

FIG.35

| LUMINANCE | DBL | LUMINANCE | HDP | LUMINANCE | DBL | LUMINANCE | HDP |
|---|---|---|---|---|---|---|---|
| | 0 ~ 7 | | 0 ~ 8 | | 0 ~ 7 | | 0 ~ 8 |
| 0 | 00000000 | 0 | 000000000 | 64 | 01000000 | 88 | 001011000 |
| 1 | 00000001 | 1 | 000000001 | 65 | 01000001 | 89 | 001011001 |
| 2 | 00000010 | 2 | 000000010 | 66 | 01000010 | 91 | 001011011 |
| 3 | 00000011 | 3 | 000000011 | 67 | 01000011 | 92 | 001011100 |
| 4 | 00000100 | 4 | 000000100 | 68 | 01000100 | 93 | 001011101 |
| 5 | 00000101 | 5 | 000000101 | 69 | 01000101 | 95 | 001011111 |
| 6 | 00000110 | 6 | 000000110 | 70 | 01000110 | 96 | 001100000 |
| 7 | 00000111 | 8 | 000001000 | 71 | 01000111 | 98 | 001100010 |
| 8 | 00001000 | 9 | 000001001 | 72 | 01001000 | 99 | 001100011 |
| 9 | 00001001 | 11 | 000001011 | 73 | 01001001 | 100 | 001100100 |
| 10 | 00001010 | 12 | 000001100 | 74 | 01001010 | 102 | 001100110 |
| 11 | 00001011 | 13 | 000001101 | 75 | 01001011 | 103 | 001100111 |
| 12 | 00001100 | 15 | 000001111 | 76 | 01001100 | 104 | 001101000 |
| 13 | 00001101 | 16 | 000010000 | 77 | 01001101 | 106 | 001101010 |
| 14 | 00001110 | 17 | 000010001 | 78 | 01001110 | 107 | 001101011 |
| 15 | 00001111 | 19 | 000010011 | 79 | 01001111 | 109 | 001101101 |
| 16 | 00010000 | 20 | 000010100 | 80 | 01010000 | 110 | 001101110 |
| 17 | 00010001 | 22 | 000010110 | 81 | 01010001 | 111 | 001101111 |
| 18 | 00010010 | 23 | 000010111 | 82 | 01010010 | 113 | 001110001 |
| 19 | 00010011 | 24 | 000011000 | 83 | 01010011 | 114 | 001110010 |
| 20 | 00010100 | 26 | 000011010 | 84 | 01010100 | 115 | 001110011 |
| 21 | 00010101 | 27 | 000011011 | 85 | 01010101 | 117 | 001110101 |
| 22 | 00010110 | 28 | 000011100 | 86 | 01010110 | 118 | 001110110 |
| 23 | 00010111 | 30 | 000011110 | 87 | 01010111 | 120 | 001111000 |
| 24 | 00011000 | 31 | 000011111 | 88 | 01011000 | 121 | 001111001 |
| 25 | 00011001 | 33 | 000100001 | 89 | 01011001 | 122 | 001111010 |
| 26 | 00011010 | 34 | 000100010 | 90 | 01011010 | 124 | 001111100 |
| 27 | 00011011 | 35 | 000100011 | 91 | 01011011 | 125 | 001111101 |
| 28 | 00011100 | 36 | 000100100 | 92 | 01011100 | 126 | 001111110 |
| 29 | 00011101 | 36 | 000100100 | 93 | 01011101 | 128 | 010000000 |
| 30 | 00011110 | 37 | 000100101 | 94 | 01011110 | 129 | 010000001 |
| 31 | 00011111 | 38 | 000100110 | 95 | 01011111 | 131 | 010000011 |
| 32 | 00100000 | 40 | 000101000 | 96 | 01100000 | 132 | 010000100 |
| 33 | 00100001 | 41 | 000101001 | 97 | 01100001 | 133 | 010000101 |
| 34 | 00100010 | 42 | 000101010 | 98 | 01100010 | 135 | 010000111 |
| 35 | 00100011 | 44 | 000101100 | 99 | 01100011 | 136 | 010001000 |
| 36 | 00100100 | 45 | 000101101 | 100 | 01100100 | 138 | 010001010 |
| 37 | 00100101 | 46 | 000101110 | 101 | 01100101 | 139 | 010001011 |
| 38 | 00100110 | 48 | 000110000 | 102 | 01100110 | 140 | 010001100 |
| 39 | 00100111 | 49 | 000110001 | 103 | 01100111 | 142 | 010001110 |
| 40 | 00101000 | 50 | 000110010 | 104 | 01101000 | 143 | 010001111 |
| 41 | 00101001 | 51 | 000110011 | 105 | 01101001 | 144 | 010010000 |
| 42 | 00101010 | 52 | 000110100 | 106 | 01101010 | 146 | 010010010 |
| 43 | 00101011 | 53 | 000110101 | 107 | 01101011 | 147 | 010010011 |
| 44 | 00101100 | 55 | 000110111 | 108 | 01101100 | 149 | 010010101 |
| 45 | 00101101 | 56 | 000111000 | 109 | 01101101 | 150 | 010010110 |
| 46 | 00101110 | 57 | 000111001 | 110 | 01101110 | 151 | 010010111 |
| 47 | 00101111 | 59 | 000111011 | 111 | 01101111 | 153 | 010011001 |
| 48 | 00110000 | 60 | 000111100 | 112 | 01110000 | 154 | 010011010 |
| 49 | 00110001 | 62 | 000111110 | 113 | 01110001 | 155 | 010011011 |
| 50 | 00110010 | 63 | 000111111 | 114 | 01110010 | 157 | 010011101 |
| 51 | 00110011 | 64 | 001000000 | 115 | 01110011 | 158 | 010011110 |
| 52 | 00110100 | 66 | 001000010 | 116 | 01110100 | 160 | 010100000 |
| 53 | 00110101 | 67 | 001000011 | 117 | 01110101 | 161 | 010100001 |
| 54 | 00110110 | 69 | 001000101 | 118 | 01110110 | 162 | 010100010 |
| 55 | 00110111 | 70 | 001000110 | 119 | 01110111 | 164 | 010100100 |
| 56 | 00111000 | 71 | 001000111 | 120 | 01111000 | 165 | 010100101 |
| 57 | 00111001 | 73 | 001001001 | 121 | 01111001 | 167 | 010100111 |
| 58 | 00111010 | 74 | 001001010 | 122 | 01111010 | 168 | 010101000 |
| 59 | 00111011 | 75 | 001001011 | 123 | 01111011 | 169 | 010101001 |
| 60 | 00111100 | 77 | 001001101 | 124 | 01111100 | 171 | 010101011 |
| 61 | 00111101 | 78 | 001001110 | 125 | 01111101 | 172 | 010101100 |
| 62 | 00111110 | 80 | 001010000 | 126 | 01111110 | 173 | 010101101 |
| 63 | 00111111 | 81 | 001010001 | 127 | 01111111 | 175 | 010101111 |

FIG.36

| LUMINANCE | DBL | LUMINANCE | HDP | LUMINANCE | DBL | LUMINANCE | HDP |
|---|---|---|---|---|---|---|---|
| | 0 ~ 7 | | 0 ~ 8 | | 0 ~ 7 | | 0 ~ 8 |
| 128 | 10000000 | 176 | 010110000 | 192 | 11000000 | 265 | 100001001 |
| 129 | 10000001 | 178 | 010110010 | 193 | 11000001 | 266 | 100001010 |
| 130 | 10000010 | 179 | 010110011 | 194 | 11000010 | 267 | 100001011 |
| 131 | 10000011 | 180 | 010110100 | 195 | 11000011 | 269 | 100001101 |
| 132 | 10000100 | 182 | 010110110 | 196 | 11000100 | 270 | 100001110 |
| 133 | 10000101 | 183 | 010110111 | 197 | 11000101 | 271 | 100001111 |
| 134 | 10000110 | 184 | 010111000 | 198 | 11000110 | 273 | 100010001 |
| 135 | 10000111 | 186 | 010111010 | 199 | 11000111 | 274 | 100010010 |
| 136 | 10001000 | 187 | 010111011 | 200 | 11001000 | 276 | 100010100 |
| 137 | 10001001 | 189 | 010111101 | 201 | 11001001 | 277 | 100010101 |
| 138 | 10001010 | 190 | 010111110 | 202 | 11001010 | 278 | 100010110 |
| 139 | 10001011 | 191 | 010111111 | 203 | 11001011 | 280 | 100011000 |
| 140 | 10001100 | 193 | 011000001 | 204 | 11001100 | 281 | 100011001 |
| 141 | 10001101 | 194 | 011000010 | 205 | 11001101 | 282 | 100011010 |
| 142 | 10001110 | 196 | 011000100 | 206 | 11001110 | 284 | 100011100 |
| 143 | 10001111 | 197 | 011000101 | 207 | 11001111 | 285 | 100011101 |
| 144 | 10010000 | 198 | 011000110 | 208 | 11010000 | 287 | 100011111 |
| 145 | 10010001 | 200 | 011001000 | 209 | 11010001 | 288 | 100100000 |
| 146 | 10010010 | 201 | 011001001 | 210 | 11010010 | 289 | 100100001 |
| 147 | 10010011 | 202 | 011001010 | 211 | 11010011 | 291 | 100100011 |
| 148 | 10010100 | 204 | 011001100 | 212 | 11010100 | 292 | 100100100 |
| 149 | 10010101 | 205 | 011001101 | 213 | 11010101 | 294 | 100100110 |
| 150 | 10010110 | 207 | 011001111 | 214 | 11010110 | 295 | 100100111 |
| 151 | 10010111 | 208 | 011010000 | 215 | 11010111 | 296 | 100101000 |
| 152 | 10011000 | 209 | 011010001 | 216 | 11011000 | 298 | 100101010 |
| 153 | 10011001 | 211 | 011010011 | 217 | 11011001 | 299 | 100101011 |
| 154 | 10011010 | 212 | 011010100 | 218 | 11011010 | 300 | 100101100 |
| 155 | 10011011 | 213 | 011010101 | 219 | 11011011 | 302 | 100101110 |
| 156 | 10011100 | 215 | 011010111 | 220 | 11011100 | 303 | 100101111 |
| 157 | 10011101 | 216 | 011011000 | 221 | 11011101 | 305 | 100110001 |
| 158 | 10011110 | 218 | 011011010 | 222 | 11011110 | 306 | 100110010 |
| 159 | 10011111 | 219 | 011011011 | 223 | 11011111 | 307 | 100110011 |
| 160 | 10100000 | 220 | 011011100 | 224 | 11100000 | 309 | 100110101 |
| 161 | 10100001 | 222 | 011011110 | 225 | 11100001 | 310 | 100110110 |
| 162 | 10100010 | 223 | 011011111 | 226 | 11100010 | 311 | 100110111 |
| 163 | 10100011 | 225 | 011100001 | 227 | 11100011 | 313 | 100111001 |
| 164 | 10100100 | 226 | 011100010 | 228 | 11100100 | 314 | 100111010 |
| 165 | 10100101 | 227 | 011100011 | 229 | 11100101 | 316 | 100111100 |
| 166 | 10100110 | 229 | 011100101 | 230 | 11100110 | 317 | 100111101 |
| 167 | 10100111 | 230 | 011100110 | 231 | 11100111 | 318 | 100111110 |
| 168 | 10101000 | 231 | 011100111 | 232 | 11101000 | 320 | 101000000 |
| 169 | 10101001 | 233 | 011101001 | 233 | 11101001 | 321 | 101000001 |
| 170 | 10101010 | 234 | 011101010 | 234 | 11101010 | 323 | 101000011 |
| 171 | 10101011 | 236 | 011101100 | 235 | 11101011 | 324 | 101000100 |
| 172 | 10101100 | 237 | 011101101 | 236 | 11101100 | 325 | 101000101 |
| 173 | 10101101 | 238 | 011101110 | 237 | 11101101 | 327 | 101000111 |
| 174 | 10101110 | 240 | 011110000 | 238 | 11101110 | 328 | 101001000 |
| 175 | 10101111 | 241 | 011110001 | 239 | 11101111 | 329 | 101001001 |
| 176 | 10110000 | 242 | 011110010 | 240 | 11110000 | 331 | 101001011 |
| 177 | 10110001 | 244 | 011110100 | 241 | 11110001 | 332 | 101001100 |
| 178 | 10110010 | 245 | 011110101 | 242 | 11110010 | 334 | 101001110 |
| 179 | 10110011 | 247 | 011110111 | 243 | 11110011 | 335 | 101001111 |
| 180 | 10110100 | 248 | 011111000 | 244 | 11110100 | 336 | 101010000 |
| 181 | 10110101 | 249 | 011111001 | 245 | 11110101 | 338 | 101010010 |
| 182 | 10110110 | 251 | 011111011 | 246 | 11110110 | 339 | 101010011 |
| 183 | 10110111 | 252 | 011111100 | 247 | 11110111 | 340 | 101010100 |
| 184 | 10111000 | 253 | 011111101 | 248 | 11111000 | 342 | 101010110 |
| 185 | 10111001 | 255 | 011111111 | 249 | 11111001 | 343 | 101010111 |
| 186 | 10111010 | 256 | 100000000 | 250 | 11111010 | 345 | 101011001 |
| 187 | 10111011 | 258 | 100000010 | 251 | 11111011 | 346 | 101011010 |
| 188 | 10111100 | 259 | 100000011 | 252 | 11111100 | 347 | 101011011 |
| 189 | 10111101 | 260 | 100000100 | 253 | 11111101 | 349 | 101011101 |
| 190 | 10111110 | 262 | 100000110 | 254 | 11111110 | 350 | 101011110 |
| 191 | 10111111 | 263 | 100000111 | 255 | 11111111 | 352 | 101100000 |

FIG.37

[SELECTIVE ERASURE]

| Ds | HD 1 | 2 | 3 | 4 | 5 | 6 | 7 | 8 | 9 | 10 | 11 | 12 | 13 | 14 | DRIVING STATE IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 1 | 0 | 0 | 0 | 0 | 0 | 1 | 0 | 0 | 0 | 0 | 0 | 0 | 0 | ● | | | | | | ● | | | | | | | | 0 |
| 00001 | 0 | 1 | 0 | 0 | 0 | 0 | 1 | 0 | 0 | 0 | 0 | 0 | 0 | 0 | ○ | ● | | | | | ● | | | | | | | | 1 |
| 00010 | 0 | 0 | 1 | 0 | 0 | 0 | 1 | 0 | 0 | 0 | 0 | 0 | 0 | 0 | ○ | ○ | ● | | | | ● | | | | | | | | 2 |
| 00011 | 0 | 0 | 0 | 1 | 0 | 0 | 1 | 0 | 0 | 0 | 0 | 0 | 0 | 0 | ○ | ○ | ○ | ● | | | ● | | | | | | | | 3 |
| 00100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 6 |
| 00101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 9 |
| 00110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 17 |
| 00111 | 0 | 0 | 0 | 0 | 0 | 1 | 0 | 1 | 0 | 0 | 0 | 0 | 0 | 0 | ○ | ○ | ○ | ○ | ○ | ● | ○ | ● | | | | | | | 22 |
| 01000 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 30 |
| 01001 | 0 | 0 | 0 | 0 | 0 | 1 | 0 | 0 | 1 | 0 | 0 | 0 | 0 | 0 | ○ | ○ | ○ | ○ | ○ | ● | ○ | ○ | ● | | | | | | 37 |
| 01010 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 45 |
| 01011 | 0 | 0 | 0 | 0 | 0 | 1 | 0 | 0 | 0 | 1 | 0 | 0 | 0 | 0 | ○ | ○ | ○ | ○ | ○ | ● | ○ | ○ | ○ | ● | | | | | 57 |
| 01100 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 65 |
| 01101 | 0 | 0 | 0 | 0 | 0 | 1 | 0 | 0 | 0 | 0 | 1 | 0 | 0 | 0 | ○ | ○ | ○ | ○ | ○ | ● | ○ | ○ | ○ | ○ | ● | | | | 82 |
| 01110 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 90 |
| 01111 | 0 | 0 | 0 | 0 | 0 | 1 | 0 | 0 | 0 | 0 | 0 | 1 | 0 | 0 | ○ | ○ | ○ | ○ | ○ | ● | ○ | ○ | ○ | ○ | ○ | ● | | | 113 |
| 10000 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 121 |
| 10001 | 0 | 0 | 0 | 0 | 0 | 1 | 0 | 0 | 0 | 0 | 0 | 0 | 1 | 0 | ○ | ○ | ○ | ○ | ○ | ● | ○ | ○ | ○ | ○ | ○ | ○ | ● | | 150 |
| 10010 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 158 |
| 10011 | 0 | 0 | 0 | 0 | 1 | 0 | 0 | 0 | 0 | 0 | 0 | 0 | 0 | 1 | ○ | ○ | ○ | ○ | ● | | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 0 | 0 | 0 | 0 | 0 | 0 | 0 | 0 | 0 | ○ | ○ | ○ | ○ | ● | | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

FIG. 38

[SELECTIVE WRITING]

| Ds | HD 14 | 13 | 12 | 11 | 10 | 9 | 8 | 7 | 6 | 5 | 4 | 3 | 2 | 1 | DRIVING STATE IN ONE FIELD SF 14 | SF 13 | SF 12 | SF 11 | SF 10 | SF 9 | SF 8 | SF 7 | SF 6 | SF 5 | SF 4 | SF 3 | SF 2 | SF 1 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | 0 |
| 00001 | 0 | 0 | 0 | 0 | 0 | 0 | 0 | 0 | 0 | 0 | 0 | 0 | 0 | 1 | | | | | | | | | | | | | | ● | 1 |
| 00010 | 0 | 0 | 0 | 0 | 0 | 0 | 0 | 0 | 0 | 0 | 0 | 0 | 1 | 0 | | | | | | | | | | | | | ● | ○ | 2 |
| 00011 | 0 | 0 | 0 | 0 | 0 | 0 | 0 | 0 | 0 | 0 | 0 | 1 | 0 | 0 | | | | | | | | | | | | ● | ○ | ○ | 3 |
| 00100 | 0 | 0 | 0 | 0 | 0 | 0 | 0 | 0 | 0 | 0 | 1 | 0 | 0 | 0 | | | | | | | | | | | ● | ○ | ○ | ○ | 6 |
| 00101 | 0 | 0 | 0 | 0 | 0 | 0 | 0 | 0 | 0 | 1 | 0 | 0 | 0 | 0 | | | | | | | | | | ● | ○ | ○ | ○ | ○ | 9 |
| 00110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 17 |
| 00111 | 0 | 0 | 0 | 0 | 0 | 0 | 0 | 1 | 0 | 1 | 0 | 0 | 0 | 0 | | | | | | | | ● | | ● | ○ | ○ | ○ | ○ | 22 |
| 01000 | 0 | 0 | 0 | 0 | 0 | 0 | 0 | 1 | 1 | 0 | 0 | 0 | 0 | 0 | | | | | | | | ● | ● | ○ | ○ | ○ | ○ | ○ | 30 |
| 01001 | 0 | 0 | 0 | 0 | 0 | 0 | 1 | 0 | 0 | 1 | 0 | 0 | 0 | 0 | | | | | | | ● | ○ | | ● | ○ | ○ | ○ | ○ | 37 |
| 01010 | 0 | 0 | 0 | 0 | 0 | 0 | 1 | 0 | 1 | 0 | 0 | 0 | 0 | 0 | | | | | | | ● | ○ | ● | ○ | ○ | ○ | ○ | ○ | 45 |
| 01011 | 0 | 0 | 0 | 0 | 0 | 1 | 0 | 0 | 0 | 1 | 0 | 0 | 0 | 0 | | | | | | ● | ○ | ○ | | ● | ○ | ○ | ○ | ○ | 57 |
| 01100 | 0 | 0 | 0 | 0 | 0 | 1 | 0 | 0 | 1 | 0 | 0 | 0 | 0 | 0 | | | | | | ● | ○ | ○ | ● | ○ | ○ | ○ | ○ | ○ | 65 |
| 01101 | 0 | 0 | 0 | 0 | 1 | 0 | 0 | 0 | 0 | 1 | 0 | 0 | 0 | 0 | | | | | ● | ○ | ○ | ○ | | ● | ○ | ○ | ○ | ○ | 82 |
| 01110 | 0 | 0 | 0 | 0 | 1 | 0 | 0 | 0 | 1 | 0 | 0 | 0 | 0 | 0 | | | | | ● | ○ | ○ | ○ | ● | ○ | ○ | ○ | ○ | ○ | 90 |
| 01111 | 0 | 0 | 0 | 1 | 0 | 0 | 0 | 0 | 0 | 1 | 0 | 0 | 0 | 0 | | | | ● | ○ | ○ | ○ | ○ | | ● | ○ | ○ | ○ | ○ | 113 |
| 10000 | 0 | 0 | 0 | 1 | 0 | 0 | 0 | 0 | 1 | 0 | 0 | 0 | 0 | 0 | | | | ● | ○ | ○ | ○ | ○ | ● | ○ | ○ | ○ | ○ | ○ | 121 |
| 10001 | 0 | 0 | 1 | 0 | 0 | 0 | 0 | 0 | 0 | 1 | 0 | 0 | 0 | 0 | | | ● | ○ | ○ | ○ | ○ | ○ | | ● | ○ | ○ | ○ | ○ | 150 |
| 10010 | 0 | 0 | 1 | 0 | 0 | 0 | 0 | 0 | 1 | 0 | 0 | 0 | 0 | 0 | | | ● | ○ | ○ | ○ | ○ | ○ | ● | ○ | ○ | ○ | ○ | ○ | 158 |
| 10011 | 0 | 1 | 0 | 0 | 0 | 0 | 0 | 0 | 0 | 0 | 1 | 0 | 0 | 0 | | ● | ○ | ○ | ○ | ○ | ○ | ○ | | | ● | ○ | ○ | ○ | 195 |
| 10100 | 0 | 1 | 0 | 0 | 0 | 0 | 0 | 0 | 1 | 0 | 0 | 0 | 0 | 0 | | ● | ○ | ○ | ○ | ○ | ○ | ○ | ● | ○ | ○ | ○ | ○ | ○ | 206 |
| 10101 | 1 | 0 | 0 | 0 | 0 | 0 | 0 | 0 | 0 | 0 | 1 | 0 | 0 | 0 | ● | ○ | ○ | ○ | ○ | ○ | ○ | ○ | | | ● | ○ | ○ | ○ | 245 |
| 10110 | 1 | 0 | 0 | 0 | 0 | 0 | 0 | 0 | 1 | 0 | 0 | 0 | 0 | 0 | ● | ○ | ○ | ○ | ○ | ○ | ○ | ○ | ● | ○ | ○ | ○ | ○ | ○ | 256 |

FIG. 39

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 1 | 0 | 0 | 0 | 0 | 0 | 0 | 0 | 0 | 0 | 0 | 0 | 0 | ● | ● | | | | | | | | | | | | | 0 |
| 0001 | 0 | 1 | 1 | 0 | 0 | 0 | 0 | 0 | 0 | 0 | 0 | 0 | 0 | 0 | ○ | ● | ● | | | | | | | | | | | | 1 |
| 0010 | 0 | 0 | 1 | 1 | 0 | 0 | 0 | 0 | 0 | 0 | 0 | 0 | 0 | 0 | ○ | ○ | ● | ● | | | | | | | | | | | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 40

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 0 | 1 | 0 | 0 | 0 | 0 | 0 | 0 | 0 | 0 | 0 | 0 | 0 | ● | | ● | | | | | | | | | | | | 0 |
| 0001 | 0 | 1 | 0 | 1 | 0 | 0 | 0 | 0 | 0 | 0 | 0 | 0 | 0 | 0 | ○ | ● | | ● | | | | | | | | | | | 1 |
| 0010 | 0 | 0 | 1 | 0 | 1 | 0 | 0 | 0 | 0 | 0 | 0 | 0 | 0 | 0 | ○ | ○ | ● | | ● | | | | | | | | | | 4 |
| 0011 | 0 | 0 | 0 | 1 | 0 | 1 | 0 | 0 | 0 | 0 | 0 | 0 | 0 | 0 | ○ | ○ | ○ | ● | | ● | | | | | | | | | 9 |
| 0100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 17 |
| 0101 | 0 | 0 | 0 | 0 | 0 | 1 | 0 | 1 | 0 | 0 | 0 | 0 | 0 | 0 | ○ | ○ | ○ | ○ | ○ | ● | | ● | | | | | | | 27 |
| 0110 | 0 | 0 | 0 | 0 | 0 | 0 | 1 | 0 | 1 | 0 | 0 | 0 | 0 | 0 | ○ | ○ | ○ | ○ | ○ | ○ | ● | | ● | | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ● | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ● | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ● | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ● | | ● | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ● | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 41

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 1 | * | * | * | * | * | * | * | * | * | * | * | * | ● | ● | △ | △ | △ | △ | △ | △ | △ | △ | △ | △ | △ | △ | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 17 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 42

[SELECTIVE WRITING]

| Ds | HD 14 | 13 | 12 | 11 | 10 | 9 | 8 | 7 | 6 | 5 | 4 | 3 | 2 | 1 | LIGHT EMISSION DRIVING PATTERN IN ONE FIELD SF 5 | SF 4 | SF 3 | SF 2 | SF 1 | LUMINANCE OF EMITTED LIGHT |
|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | 0 |
| 0001 | 0 | 0 | 0 | 0 | 0 | 0 | 0 | 0 | 0 | 0 | 0 | 0 | 0 | 1 | | | | | ● | 1 |
| 0010 | 0 | 0 | 0 | 0 | 0 | 0 | 0 | 0 | 0 | 0 | 0 | 0 | 1 | | | | | ● | | 4 |
| 0011 | 0 | 0 | 0 | 0 | 0 | 0 | 0 | 0 | 0 | 0 | 0 | 1 | | 0 | | | ● | | ○ | 9 |
| 0100 | 0 | 0 | 0 | 0 | 0 | 0 | 0 | 0 | 0 | 0 | 1 | | 0 | 0 | | ● | | ○ | ○ | 17 |
| 0101 | 0 | 0 | 0 | 0 | 0 | 0 | 0 | 0 | 0 | 1 | | 0 | 0 | 0 | ● | | ○ | ○ | ○ | 27 |
| 0110 | 0 | 0 | 0 | 0 | 0 | 0 | 0 | 0 | 1 | | 0 | 0 | 0 | 0 | | ○ | ○ | ○ | ○ | 40 |
| 0111 | 0 | 0 | 0 | 0 | 0 | 0 | 0 | 1 | | 0 | 0 | 0 | 0 | 0 | ○ | ○ | ○ | ○ | ○ | 56 |
| 1000 | 0 | 0 | 0 | 0 | 0 | 0 | 1 | | 0 | 0 | 0 | 0 | 0 | 0 | ○ | ○ | ○ | ○ | ○ | 75 |
| 1001 | 0 | 0 | 0 | 0 | 0 | 1 | | 0 | 0 | 0 | 0 | 0 | 0 | 0 | ○ | ○ | ○ | ○ | ○ | 97 |
| 1010 | 0 | 0 | 0 | 0 | 1 | | 0 | 0 | 0 | 0 | 0 | 0 | 0 | 0 | ○ | ○ | ○ | ○ | ○ | 122 |
| 1011 | 0 | 0 | 0 | 1 | | 0 | 0 | 0 | 0 | 0 | 0 | 0 | 0 | 0 | ○ | ○ | ○ | ○ | ○ | 150 |
| 1100 | 0 | 0 | 1 | | 0 | 0 | 0 | 0 | 0 | 0 | 0 | 0 | 0 | 0 | ○ | ○ | ○ | ○ | ○ | 182 |
| 1101 | 0 | 1 | | 0 | 0 | 0 | 0 | 0 | 0 | 0 | 0 | 0 | 0 | 0 | ○ | ○ | ○ | ○ | ○ | 217 |
| 1110 | 1 | | 0 | 0 | 0 | 0 | 0 | 0 | 0 | 0 | 0 | 0 | 0 | 0 | ○ | ○ | ○ | ○ | ○ | 256 |

BLACK CIRCLE : SELECTIVE WRITE DISCHARGE
WHITE CIRCLE : LIGHT EMISSION

FIG. 43

[SELECTIVE WRITING]

| Ds | HD 14 | 13 | 12 | 11 | 10 | 9 | 8 | 7 | 6 | 5 | 4 | 3 | 2 | 1 | LIGHT EMISSION DRIVING PATTERN IN ONE FIELD SF 14 | SF 13 | SF 12 | SF 11 | SF 10 | SF 9 | SF 8 | SF 7 | SF 6 | SF 5 | SF 4 | SF 3 | SF 2 | SF 1 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | 0 |
| 0001 | 0 | 0 | 0 | 0 | 0 | 0 | 0 | 0 | 0 | 0 | 0 | 0 | 0 | 1 | | | | | | | | | | | | | | ● | 1 |
| 0010 | 0 | 0 | 0 | 0 | 0 | 0 | 0 | 0 | 0 | 0 | 0 | 0 | 1 | 1 | | | | | | | | | | | | | ● | ● | 4 |
| 0011 | 0 | 0 | 0 | 0 | 0 | 0 | 0 | 0 | 0 | 0 | 0 | 1 | 1 | * | | | | | | | | | | | | ● | ● | ○ | 9 |
| 0100 | 0 | 0 | 0 | 0 | 0 | 0 | 0 | 0 | 0 | 0 | 1 | 1 | * | * | | | | | | | | | | | ● | ● | ○ | ○ | 17 |
| 0101 | 0 | 0 | 0 | 0 | 0 | 0 | 0 | 0 | 0 | 1 | 1 | * | * | * | | | | | | | | | | ● | ● | ○ | ○ | ○ | 27 |
| 0110 | 0 | 0 | 0 | 0 | 0 | 0 | 0 | 0 | 1 | 1 | * | * | * | * | | | | | | | | | ● | ● | ○ | ○ | ○ | ○ | 40 |
| 0111 | 0 | 0 | 0 | 0 | 0 | 0 | 0 | 1 | 1 | * | * | * | * | * | | | | | | | | ● | ● | ○ | ○ | ○ | ○ | ○ | 56 |
| 1000 | 0 | 0 | 0 | 0 | 0 | 0 | 1 | 1 | * | * | * | * | * | * | | | | | | | ● | ● | ○ | ○ | ○ | ○ | ○ | ○ | 75 |
| 1001 | 0 | 0 | 0 | 0 | 0 | 1 | 1 | * | * | * | * | * | * | * | | | | | | ● | ● | ○ | ○ | ○ | ○ | ○ | ○ | ○ | 97 |
| 1010 | 0 | 0 | 0 | 0 | 1 | 1 | * | * | * | * | * | * | * | * | | | | | ● | ● | ○ | ○ | ○ | ○ | ○ | ○ | ○ | ○ | 122 |
| 1011 | 0 | 0 | 0 | 1 | 1 | * | * | * | * | * | * | * | * | * | | | | ● | ● | ○ | ○ | ○ | ○ | ○ | ○ | ○ | ○ | ○ | 150 |
| 1100 | 0 | 0 | 1 | 1 | * | * | * | * | * | * | * | * | * | * | | | ● | ● | ○ | ○ | ○ | ○ | ○ | ○ | ○ | ○ | ○ | ○ | 182 |
| 1101 | 0 | 1 | 1 | * | * | * | * | * | * | * | * | * | * | * | | ● | ● | ○ | ○ | ○ | ○ | ○ | ○ | ○ | ○ | ○ | ○ | ○ | 217 |
| 1110 | 1 | 1 | * | * | * | * | * | * | * | * | * | * | * | * | ● | ● | ○ | ○ | ○ | ○ | ○ | ○ | ○ | ○ | ○ | ○ | ○ | ○ | 256 |

BLACK CIRCLE : SELECTIVE WRITE DISCHARGE
WHITE CIRCLE : LIGHT EMISSION

FIG. 44

[SELECTIVE WRITING]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 1 | 1 | 0 | 0 | 0 | 0 | 1 | 1 | 0 | 0 | 0 | 0 | 0 | 0 | ● | ● | | | | | ● | ● | | | | | | | 0 |
| 00001 | 0 | 1 | 1 | 0 | 0 | 0 | 1 | 1 | 0 | 0 | 0 | 0 | 0 | 0 | ○ | ● | ● | | | | ● | ● | | | | | | | 1 |
| 00010 | 0 | 0 | 1 | 1 | 0 | 0 | 1 | 1 | 0 | 0 | 0 | 0 | 0 | 0 | ○ | ○ | ● | ● | | | ● | ● | | | | | | | 2 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | 3 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE WRITE DISCHARGE
WHITE CIRCLE : LIGHT EMISSION

FIG. 45

[SELECTIVE WRITING]

| Ds | HD 14 | 13 | 12 | 11 | 10 | 9 | 8 | 7 | 6 | 5 | 4 | 3 | 2 | 1 | LIGHT EMISSION DRIVING PATTERN IN ONE FIELD SF 14 | SF 13 | SF 12 | SF 11 | SF 10 | SF 9 | SF 8 | SF 7 | SF 6 | SF 5 | SF 4 | SF 3 | SF 2 | SF 1 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | 0 |
| 00001 | 0 | 0 | 0 | 0 | 0 | 0 | 0 | 0 | 0 | 0 | 0 | 0 | 0 | 1 | | | | | | | | | | | | | | ● | 1 |
| 00010 | 0 | 0 | 0 | 0 | 0 | 0 | 0 | 0 | 0 | 0 | 0 | 0 | 1 | 1 | | | | | | | | | | | | | ● | ● | 2 |
| 00011 | 0 | 0 | 0 | 0 | 0 | 0 | 0 | 0 | 0 | 0 | 0 | 1 | 1 | 0 | | | | | | | | | | | | ● | ● | ○ | 3 |
| 00100 | 0 | 0 | 0 | 0 | 0 | 0 | 0 | 0 | 0 | 0 | 1 | 1 | 0 | 0 | | | | | | | | | | | ● | ● | ○ | ○ | 6 |
| 00101 | 0 | 0 | 0 | 0 | 0 | 0 | 0 | 0 | 0 | 1 | 1 | 0 | 0 | 0 | | | | | | | | | | ● | ● | ○ | ○ | ○ | 9 |
| 00110 | 0 | 0 | 0 | 0 | 0 | 0 | 0 | 0 | 1 | 1 | 0 | 0 | 0 | 0 | | | | | | | | | ● | ● | ○ | ○ | ○ | ○ | 17 |
| 00111 | 0 | 0 | 0 | 0 | 0 | 0 | 0 | 1 | 0 | 1 | 1 | 0 | 0 | 0 | | | | | | | | ● | | ● | ● | ○ | ○ | ○ | 22 |
| 01000 | 0 | 0 | 0 | 0 | 0 | 0 | 0 | 1 | 1 | 1 | 0 | 0 | 0 | 0 | | | | | | | | ● | ● | ● | ○ | ○ | ○ | ○ | 30 |
| 01001 | 0 | 0 | 0 | 0 | 0 | 0 | 1 | 1 | 0 | 1 | 1 | 0 | 0 | 0 | | | | | | | ● | ● | | ● | ● | ○ | ○ | ○ | 37 |
| 01010 | 0 | 0 | 0 | 0 | 0 | 0 | 1 | 1 | 1 | 1 | 0 | 0 | 0 | 0 | | | | | | | ● | ● | ● | ● | ○ | ○ | ○ | ○ | 45 |
| 01011 | 0 | 0 | 0 | 0 | 0 | 1 | 1 | 0 | 0 | 1 | 1 | 0 | 0 | 0 | | | | | | ● | ● | ○ | | ● | ● | ○ | ○ | ○ | 57 |
| 01100 | 0 | 0 | 0 | 0 | 0 | 1 | 1 | 0 | 1 | 1 | 0 | 0 | 0 | 0 | | | | | | ● | ● | ○ | ● | ● | ○ | ○ | ○ | ○ | 65 |
| 01101 | 0 | 0 | 0 | 0 | 1 | 1 | 0 | 0 | 0 | 1 | 1 | 0 | 0 | 0 | | | | | ● | ● | ○ | ○ | | ● | ● | ○ | ○ | ○ | 82 |
| 01110 | 0 | 0 | 0 | 0 | 1 | 1 | 0 | 0 | 1 | 1 | 0 | 0 | 0 | 0 | | | | | ● | ● | ○ | ○ | ● | ● | ○ | ○ | ○ | ○ | 90 |
| 01111 | 0 | 0 | 0 | 1 | 1 | 0 | 0 | 0 | 0 | 1 | 1 | 0 | 0 | 0 | | | | ● | ● | ○ | ○ | ○ | | ● | ● | ○ | ○ | ○ | 113 |
| 10000 | 0 | 0 | 0 | 1 | 1 | 0 | 0 | 0 | 1 | 1 | 0 | 0 | 0 | 0 | | | | ● | ● | ○ | ○ | ○ | ● | ● | ○ | ○ | ○ | ○ | 121 |
| 10001 | 0 | 0 | 1 | 1 | 0 | 0 | 0 | 0 | 0 | 1 | 1 | 0 | 0 | 0 | | | ● | ● | ○ | ○ | ○ | ○ | | ● | ● | ○ | ○ | ○ | 150 |
| 10010 | 0 | 0 | 1 | 1 | 0 | 0 | 0 | 0 | 1 | 1 | 0 | 0 | 0 | 0 | | | ● | ● | ○ | ○ | ○ | ○ | ● | ● | ○ | ○ | ○ | ○ | 158 |
| 10011 | 0 | 1 | 1 | 0 | 0 | 0 | 0 | 0 | 0 | 0 | 1 | 1 | 0 | 0 | | ● | ● | ○ | ○ | ○ | ○ | ○ | | | ● | ● | ○ | ○ | 195 |
| 10100 | 0 | 1 | 1 | 0 | 0 | 0 | 0 | 0 | 1 | 1 | 0 | 0 | 0 | 0 | | ● | ● | ○ | ○ | ○ | ○ | ○ | ● | ● | ○ | ○ | ○ | ○ | 206 |
| 10101 | 1 | 1 | 0 | 0 | 0 | 0 | 0 | 0 | 0 | 0 | 1 | 1 | 0 | 0 | ● | ● | ○ | ○ | ○ | ○ | ○ | ○ | | | ● | ● | ○ | ○ | 245 |
| 10110 | 1 | 1 | 0 | 0 | 0 | 0 | 0 | 0 | 1 | 1 | 0 | 0 | 0 | 0 | ● | ● | ○ | ○ | ○ | ○ | ○ | ○ | ● | ● | ○ | ○ | ○ | ○ | 256 |

BLACK CIRCLE : SELECTIVE WRITE DISCHARGE
WHITE CIRCLE : LIGHT EMISSION

METHOD OF DRIVING PLASMA DISPLAY PANEL

BACKGROUND OF THE INVENTION

1. Field of the Invention

The present invention relates to a method of driving a plasma display panel (hereinafter abbreviated as the "PDP") of a matrix display type.

2. Description of Related Art

As a display panel of the matrix display type, an AC (alternate current discharge) type PDP is known.

The AC-type PDP comprises a plurality of column electrodes (address electrodes) and a plurality of row electrode pairs arranged orthogonal to the column electrodes, with each pair of row electrodes forming a scanning line. The row electrode pairs and column electrodes are covered with a dielectric layer to separate them from a discharge space. At an intersection of a row electrode pair with a column electrode, a discharge cell is formed corresponding to one pixel.

As a method of displaying a half-tone image on such a PDP, a so-called subfield method is described, for example, in Japanese Patent Kokai No. 4-195087. In the subfield method, a field period is divided into N subfields, in each of which light is emitted for a time corresponding to weighting applied to an associated bit of N-bit pixel data.

FIG. 1 illustrates a light emission driving format in one field period according to the subfield method.

In the example illustrated in FIG. 1, supplied pixel data is assumed to be 6-bit data, and one field period is divided into six subfields SF1, SF2, . . . , SF6 for driving light emission. A gradation display of 64 steps can be achieved for an image of one field by executing light emission throughout the six subfields.

Each subfield includes a simultaneous resetting stage Rc, a pixel data writing stage Wc and a light emission sustaining stage Ic. In the simultaneous resetting stage Rc, all discharge cells in the PDP are simultaneously excited to discharge (reset discharge) to form a wall charge uniformly in each of all discharge cells. In the next pixel data writing stage Wc, a selective erasing discharge is excited in accordance with pixel data in each discharge cell. In this event, the wall charge in a discharge cell which undergoes the erasure discharge is extinct to become a "non-light emitting cell." On the other hand, a discharge cell which does not undergo the erasure discharge has the wall charge maintained, so that it serves as a "light emitting cell." In the light emission sustaining stage Ic, the light emitting cells are maintained in a discharge light emitting state for a time corresponding to weighting of each subfield. In this way, the emitted light is sustained in the respective subfields SF1–SF6 in a light emitting period ratio of 1:2:4:8:16:32 in order.

When a selective erasure address method is employed for selectively erasing a wall charge formed in each of the discharge cells as mentioned above in the pixel data writing stage Wc, the simultaneous resetting stage Rc, indicated by hatchings in FIG. 1, is essentially provided at the head of each subfield.

However, the reset discharge performed for all discharge cells in the simultaneous resetting stage Rc involves relatively strong discharge, i.e., emission of light at a high luminance level. Thus, since the reset discharge causes light emission at the six times indicated by hatchings in FIG. 1 without any relation to pixel data, this results in a problem of degraded contrast in images.

Also, in the driving manner illustrated in FIG. 1, for example, a discharge cell which emits light at a luminance level 31 has a light emitting pattern reverse to that of a discharge cell which emits light at a luminance level 32. In other words, one cell is emitting light, while the other cell is not, thus causing a problem that a pseudo-contour is formed on the boundary of the two discharge cells.

Further, a reduction in power consumption is currently a general challenge in commercializing such PDP.

OBJECT AND SUMMARY OF THE INVENTION

The present invention has been made to solve the problems mentioned above, and its object is to provide a method of driving a plasma display panel which is capable of improving contrast, reducing power consumption, and preventing a pseudo-contour.

To achieve the above object, the present invention provides a method of driving a plasma display panel for driving a plasma display panel having a discharge cell corresponding to one pixel at each intersection of each of a plurality of row electrodes arranged to form each scanning line with each of a plurality of column electrodes crossing with the row electrodes, and the method comprises the steps of dividing a display period of one field into a plurality of subfields, and executing, in each of the subfields, a pixel data writing stage for selectively erasing or discharging a wall charge formed in each of the discharge cells in accordance with display pixel data to set the discharge cells to a light emitting cell or a non-light emitting cell, and a light emission sustaining stage for sustaining only the light emitting cells to emit light for a time corresponding to weighting to the subfield, and executing a simultaneous resetting stage for simultaneously resetting to discharge all the discharge cells to form a wall charge in each of the discharge cells only in the first subfield of a group of subfields, including at least two mutually consecutive subfields of the subfields, wherein the erasing discharge is performed only in the pixel data writing stage in any subfield of the group of subfields.

According to another aspect of the present invention, the display period of one field is divided to N (N is a natural number) subfields, and a subfield group of consecutive M ($2 \leqq M \leqq N$) subfields is formed. The method executes in order, a resetting stage for producing a discharge to initialize all of the discharge cells to a state of either of a light emitting cell or a non-light emitting cell only in the subfields in the head portion of the subfield group, a pixel data writing stage for applying to the column electrodes a first pixel data pulse which produces a discharge to set the discharge cells as the non-light emitting cell or the light emitting cell in one of the subfields in the subfield group, and applying to the column electrodes a second pixel data pulse which is the same as the first pixel data pulse in at least one of the subfields existing behind in the subfield group, and a light emission sustaining stage for producing a discharge for causing only discharge cells set as the light emitting cell in each of said subfield to emit light for a light emitting period corresponding to the weighting of the subfield.

BRIEF DESCRIPTION OF THE DRAWINGS

FIGS. 3 and 4 show in combination an example of a conversion table in a data converting circuit 3;

FIGS. 7 and 8 show in combination another example of a conversion table in the data converting circuit 3;

FIGS. 11 and 12 show in combination a conversion table for driving light emission of the PDP 10 in accordance with the light emission driving format illustrated in FIG. 10;

FIG. 20 is a table showing a correspondence relationship between luminance modes and light emitting periods in respective subfields;

FIGS. 22 and 23 show in combination an example of a conversion table in the first data converting circuit 32;

FIGS. 28 and 29 show in combination an example of a conversion table in a second data converting circuit 34;

FIGS. 35 and 36 show in combination another example of a conversion table in the first data converting circuit 32;

FIGS. 37 and 38 show in combination another example of a conversion table in the second data converting circuit 34; and FIGS. 39 through 45 are diagrams showing further examples of the light emission driving pattern according to the driving method of the present invention;

DESCRIPTION OF THE PREFERRED EMBODIMENTS

Several embodiments of the present invention will hereinafter be described with reference to the accompanying drawings.

Figure 2:
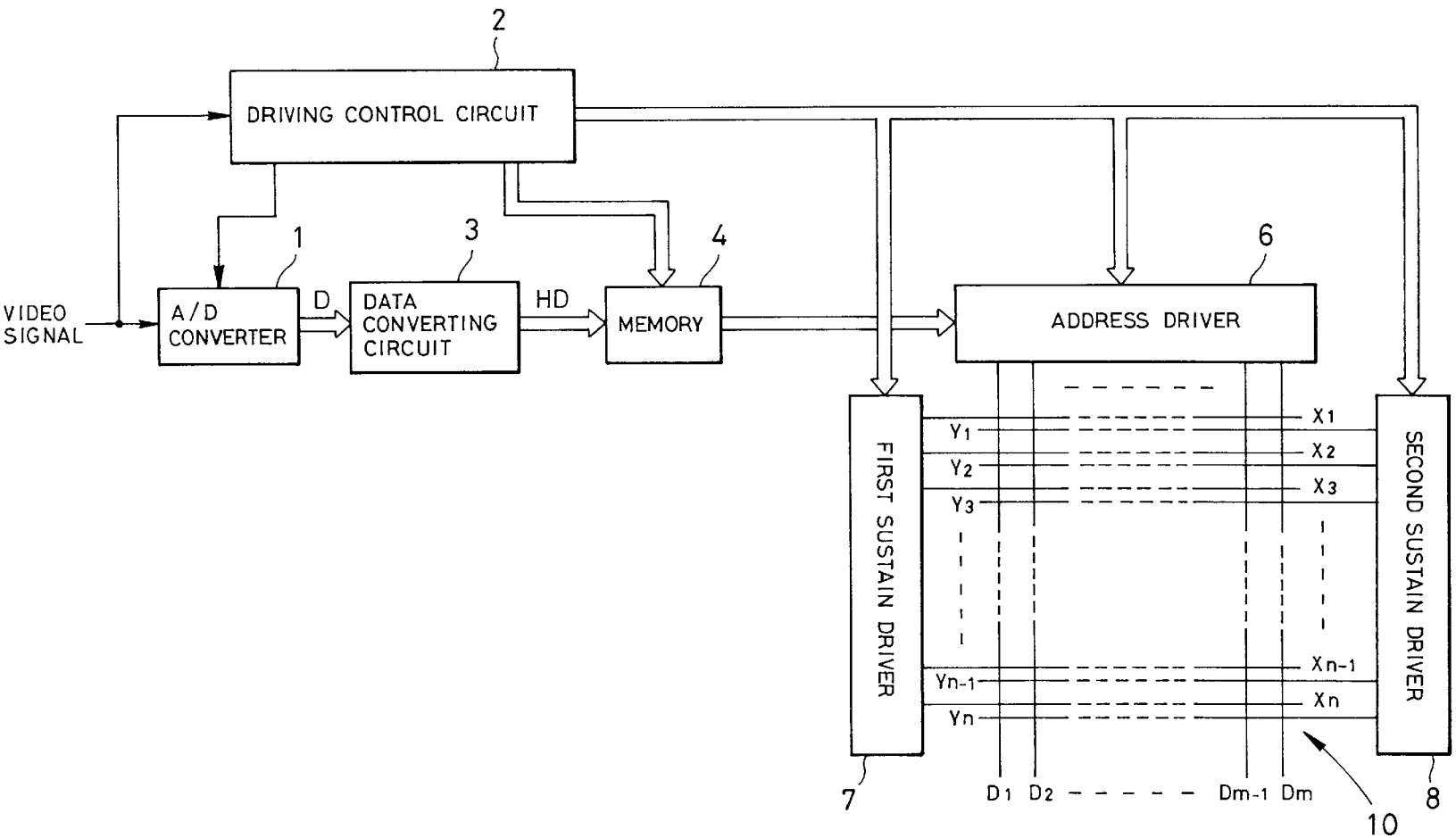
FIG. 2 is a schematic diagram generally illustrating the configuration of a plasma display device which drives a plasma display panel in accordance with a driving method according to the present invention.

FIG. 2 generally illustrates the configuration of a plasma display device which comprises a driver for driving a plasma display panel (hereinafter abbreviated as the "PDP") based on a driving method according to the present invention.

Referring specifically to FIG. 2, an A/D converter 1 samples an analog input video signal in response to a clock signal supplied thereto from a driving control circuit 2 to convert the same to 6-bit pixel data D (input pixel data) for each pixel, which is supplied to a data converting circuit 3.

The data converting circuit 3 converts the pixel data D to 9-bit converted pixel data HD (display pixel data) in accordance with a conversion table as shown in FIGS. 3 and 4, and supplies the converted pixel data HD to a memory 4. It should be noted that the conversion table shown in FIGS. 3 and 4 is merely an example of a conversion table for use in displaying a half-tone representation in 64 steps.

The converted pixel data HD are sequentially written into the memory 4 in accordance with a write signal supplied thereto from the driving control circuit 2. Once the converted pixel data HD have been written into the memory 4 for one screen portion (n rows and m columns) through the writing operation, each of the converted pixel data $HD_{11-nm}$ of the one screen portion is divided into respective bit digits (0th bit to 8th bit) which are read from the memory 4 and sequentially supplied to an address driver 6 for each row.

For example, data at the 0th bit in each of the m converted pixel data $HD_{11-1m}$ corresponding to the first row of the screen is only read from the memory 4. Next, data at the 0th bit in each of the converted pixel data $HD_{21-2m}$ corresponding to the second row is only read from the memory 4. Subsequently, data at the 0th bit in the converted pixel data HD up to the nth row are only read sequentially from the memory 4 in a similar manner. Upon completion of the reading operation for the 0th bit of all the converted pixel data HD, data at the 1st bit in each of the m converted pixel data $HD_{11-1m}$ corresponding to the second row on the screen is only read from the memory 4. Next, data at the 1st bit in each of the m converted pixel data $HD_{21-2m}$ corresponding to the second row is only read from the memory 4. Subsequently, data at the 1st bit in the converted pixel data HD up to the nth row are only read sequentially from the memory 4 in a similar manner. In the following, data from the 2th bit to the 8th bit in the converted pixel data HD are divided and read from the memory 4 in a similar procedure.

As described above, the 9-bit converted pixel data HD converted in accordance with the conversion table as shown in FIGS. 3 and 4 are divided into respective bit digits, and the divided data are sequentially read from the memory 4 from the 0th bit to the 8th bit and supplied to the address driver 6 within one field period.

The address driver 6 generates pixel data pulses $DP_1$–$DP_m$ each having a voltage corresponding to a logical level of a corresponding one in a group of pixel data bits for each row read from the memory 4, and applies these pixel data pulses $PD_1$–$DP_m$ to column electrodes $D_1$–$D_m$, respectively.

The driving control circuit 2 generates a clock signal to the A/D converter 1 and write and read signals to the memory 4 in synchronism with horizontal and vertical synchronization signals in an input video signal. The driving control circuit 2 also generates a pixel data timing signal, a reset timing signal, a scan timing signal and a sustain timing signal in synchronism with the horizontal and vertical synchronization signals.

A first sustain driver 7 generates a resetting pulse $RP_X$ for initializing a residual charge amount, and a sustaining pulse $IP_X$ for sustaining a discharge light emitting state in response to a variety of timing signals supplied from the driving control circuit 2, and applies these pulses to row electrodes $X_1$–$X_n$ of the PDP 10.

A second sustain driver 8 generates a resetting pulse $RP_Y$ for initializing a residual charge amount, a scanning pulse SP for writing pixel data, a priming pulse PP for successfully performing the writing of pixel data, and a sustaining pulse $IP_Y$ for sustaining a discharge light emitting state in response to a variety of timing signals supplied from the driving control circuit 2, and applies these pulses to the row electrodes $Y_1$–$Y_n$ of the PDP 10.

It should be noted that in the PDP 10, a row electrode for one row of the screen is formed of a pair of a row electrode X and a row electrode Y. For example, a row electrode pair for the first row in the PDP 10 is formed of row electrodes $X_1$, $Y_1$, and a row electrode pair for the nth row is formed of row electrodes $X_n$, $Y_n$. Also, in the PDP 10, a discharge cell is formed at an intersection of a row electrode pair with each of column electrodes.

Next, description will be made on the operation performed by the plasma display device as illustrated in FIG. 2 for driving the PDP 10.

Figure 5:
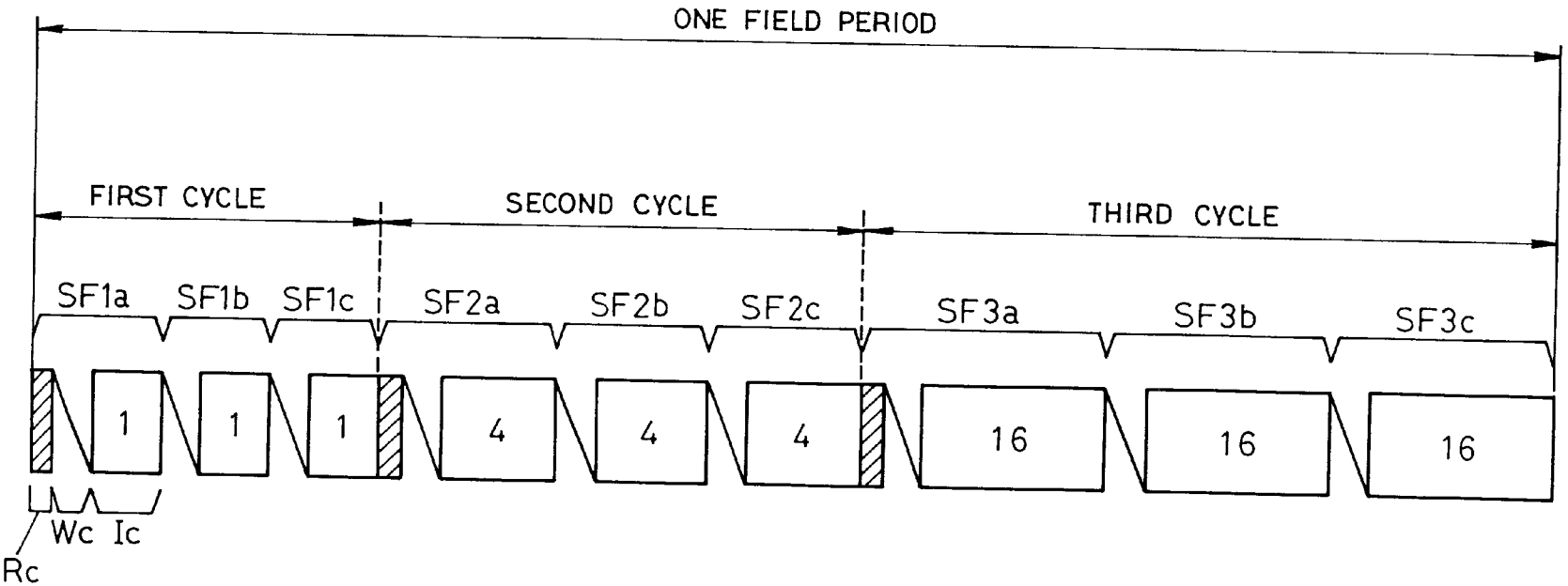
FIG. 5 illustrates an example of light emission driving format according to the present invention.

FIG. 5 illustrates a light emission driving format within one field period which is relied on by the data converting circuit 3 when it uses a data conversion table as shown in FIGS. 3 and 4.

In the light emission driving format illustrated in FIG. 5, one field period is divided into nine subperiods. In this event, discharge light emission (first reset cycle) through subfields SF1*a*–SF1*c* is performed in first to third subperiods; discharge light emission (second reset cycle) through subfields SF2*a*–SF2*c* is performed in fourth to sixth subperiods; and discharge light emission (third reset cycle) through subfields SF3*a*–SF3*c* is performed in seventh to ninth subperiods.

In each of subfields SF1*a*–SF1*c*, SF2*a*–SF2*c* and SF3*a*–SF3*c*, a pixel data writing stage Wc for writing converted pixel data HD to set discharge cells to emitting cells or non-emitting cells, and a light emission sustaining stage Ic for sustaining a discharge light emitting state in the light emitting cells are included. In other words, only discharge cells set to emitting cells in the pixel data writing stage Wc are discharged to emit light in the light emission sustaining stage Ic.

A light emitting time for discharge light emission performed in each subfield during the light emission sustaining stage Ic is as follows, assuming that a light emitting time in each of the subfields SF1*a*–SF1*c* is "1":

SF1*a*–SF1*c*: 1

SF2*a*–SF2*c*: 4

SF3*a*–SF3*c*: 16

In this event, the logical levels of the 0th–8th bits of the converted pixel data HD determine light emission/non-light emission in each of the nine subfields SF1*a*–SF3*c*, as illustrated in FIG. 5.

More specifically, the 0th–8th bits of the converted pixel data HD determine whether or not light should be emitted in the respective subfields in a correspondence relationship as shown below:

0th bit: Subfield SF1*a*

1st bit: Subfield SF1*b*

2nd bit: Subfield SF1*c*

3rd bit: Subfield SF2*a*

4th bit: Subfield SF2*b*

5th bit: Subfield SF2*c*

6th bit: Subfield SF3*a*

7th bit: Subfield SF3*b*

8th bit: Subfield SF3*c*

Selective erasure discharge is executed only in a subfield corresponding to a logical level "1" in the converted pixel data HD. Therefore, a light emitting state is found in a subfield corresponding to a logical level "0" arranged before a subfield corresponding to a logical level "1," and a non-light emitting state is found in a subfield corresponding to logical level "0" in each of the first to third reset cycles.

For example, according to converted pixel data HD: [1,0,0,1,0,0,0,0,1] corresponding to a luminance level "32" as shown in FIG. 4, light is emitted by sustain discharge only in the subfield SF3*a* and the subfield SF3*b* within nine subfields in FIG. 5.

On the other hand, a simultaneous resetting stage Rc in which reset discharge is excited in all discharge cells to form a wall charge in each of the discharge cells is executed only in the subfields SF1*a*, SF2*a*, SF3*a* which are the first subfields of the first to third reset cycles, as indicated by hatchings in FIG. 5.

In other words, the simultaneous resetting operation as described above is performed only at the head of each of the first to third reset cycles shown in FIG. 5.

FIGS. 6A to 6G are waveform charts showing application timings for a variety of driving pulses actually applied to associated electrodes of the PDP 10 in each of the subfields illustrated in FIG. 5. As can be seen, however, FIGS. 6A to 6G only show such application timings in the first reset cycle extracted from the first to third reset cycles illustrated in FIG. 5.

Figures 6A, 6B, 6C, 6D, 6E, 6F, 6G:
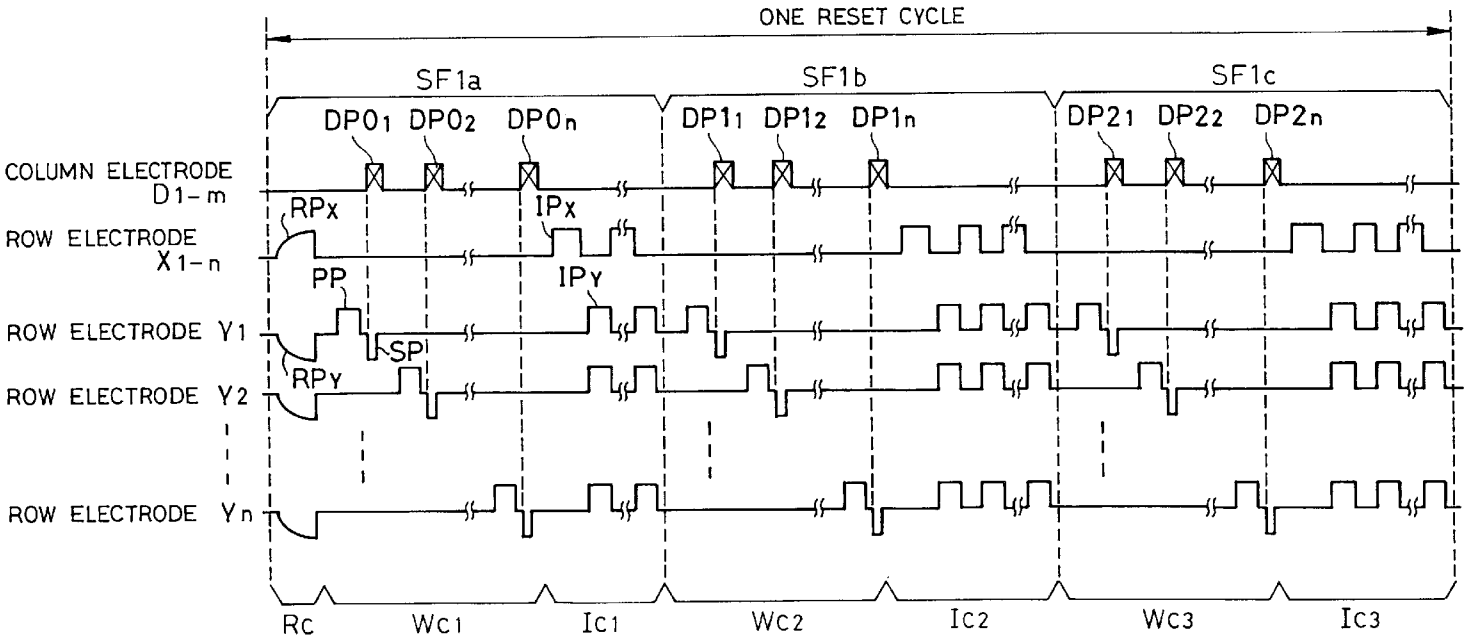
FIGS. 6A to 6G are waveform charts showing an example of application timings at which a variety of driving pulses are applied to a PDP 10 in a reset cycle.

As shown in FIGS. 6C to 6F, the first sustain driver 7 and the second sustain driver 8 first apply row resetting pulses RPx, RPy simultaneously to electrodes X, Y of the PDP 10, respectively, to reset or discharge all discharge cells in the PDP 10 to forcedly form a wall charge in each of the discharge cells (simultaneous resetting stage RC in FIG. 6G).

Next, the address driver 6 sequentially applies data pulses $DP0_1$–$DP0_m$, corresponding to respective rows, to column electrodes $D_1$–$D_m$, as shown in FIG. 6B. At this time, each of the data pulses $DP0_1$–$DP0_m$ applied to the column electrodes $D_1$–$D_m$ corresponds to the 0th bit in the converted pixel data HD as shown in FIG. 3. The second sustain driver 8 sequentially applies a scanning pulse SP to row electrodes $Y_1$–$Y_n$ at the same timing as the application timing for each of the data pulses DP, as shown in FIGS. 6D to 6F. In this event, discharge occurs only in a discharge cell at the intersection of a "row" applied with the scanning pulse SP with a "column" applied with a high-voltage pixel data pulse to selectively erase the wall charge remaining in the discharge cell. Thus, the selective erasure results in setting a light emitting discharge cell in which discharge light emission is performed in a sustain light emission stage and a non-light emitting discharge cell in which discharge light emission is not performed, as will be described later.

Immediately before the scanning pulse SP is applied to each row electrode Y, a priming pulse PP of positive polarity is sequentially applied to the row electrodes $Y_1$–$Y_n$. Priming discharge excited in response to the application of the priming pulse PP permits restoration of charged particles in a discharge space of the PDP 10, which was formed in the simultaneous resetting stage Rc but has reduced over time. Therefore, pixel data is written by the application of the scanning pulse SP, while such charged particles still remain within the discharge space (pixel data writing stage Wc1 in FIG. 6G).

Next, the first sustain driver 7 and the second sustain driver 8 apply the sustaining pulses $IP_X$, $IP_Y$ alternately to the row electrodes X, Y, as shown in FIGS. 6C to 6F. In this event, a discharge cell which still holds the wall charge formed during the pixel data writing stage Wc1, i.e., a light emitting discharge cell repeats discharge light emission to sustain its light emitting state during a period in which it is applied alternately with the sustaining pulses $IP_X$, $IP_Y$ (light emission sustaining stage Ic1 in FIG. 6G).

When the discharge light emission operation is terminated in the subfield SF1*a* made up of the simultaneous resetting stage Rc, the pixel data writing stage Wc1 and the light emission sustaining stage Ic1 as described above, the address driver 6 next applies data pulses $DP1_1$–$DP1_m$ corresponding to respective rows sequentially to the column electrodes $D_1$–$D_m$ as shown in FIG. 6B. Each of the data pulses $DP1_1$–$DP1_m$ applied to the column electrodes $D_1$–$D_m$ at this time corresponds to the 1st bit in the converted pixel data HD as shown in FIG. 3. The second sustain driver 8 sequentially applies the scanning pulse SP to the row electrodes $Y_1$–$Y_n$ at the same timing as the timing at which the respective data pulses DP are applied, as shown in FIGS. 6D–6F. In this event, discharge occurs only in a discharge cell at the intersection of a "row" applied with the scanning pulse SP with a "column" applied with the high-voltage pixel data pulse to selectively erase a wall charge remaining in the discharge cell. Thus, the selective erasure results in a light emitting discharge cell in which discharge light emission can be performed in a light emission sustaining stage Ic2, later described, and a non-light emitting discharge cell in which discharge light emission is not performed. Immediately before the scanning pulse SP is applied to each row electrode Y, the priming pulse PP of positive polarity is sequentially applied to the row electrodes $Y_1$–$Y_n$. The application of the priming pulse PP permits restoration of charged particles in a discharge space of the PDP 10. Therefore, pixel data is written by the application of the scanning pulse SP, while such charged particles still remain within the discharge space (pixel data writing stage Wc2 in FIG. 6G).

Next, the first sustain driver 7 and the second sustain driver 8 apply the sustaining pulses $IP_X$, $IP_Y$ alternately to the row electrodes X, Y, as shown in FIGS. 6C to 6F. In this event, a discharge cell which still holds the wall charge formed during the pixel data writing stage Wc2, i.e., a light emitting discharge cell repeats discharge light emission to sustain its light emitting state during a period in which it is applied alternately with the sustaining pulses $IP_X$, $IP_Y$ (light emission sustaining stage Ic2 in FIG. 6G).

When the discharge light emission operation is terminated in the subfield SF1*b* made up of the pixel data writing stage Wc2 and the light emission sustaining stage Ic2 as described above, the address driver 6 next applies data pulses $DP2_1$–$DP2_m$ corresponding to respective rows sequentially to the column electrodes $D_1$–$D_m$ as shown in FIG. 6B. Each of the data pulses $DP2_1$–$DP2_m$ applied to the column electrodes $D_1$–$D_m$ at this time corresponds to the 2nd bit in the converted pixel data HD as shown in FIG. 3. The second sustain driver 8 sequentially applies the scanning pulse SP to the row electrodes $Y_1$–$Y_n$ at the same timing as the timing at which the respective data pulses DP are applied, as shown in FIGS. 6D–6F. In this event, discharge occurs only in a discharge cell at the intersection of a "row" applied with the scanning pulse SP with a "column" applied with the high-voltage pixel data pulse to selectively erase a wall charge remaining in the discharge cell. Thus, the selective erasure results in a light emitting discharge cell in which discharge light emission can be performed in a light emission sustaining stage, later described, and a non-light emitting discharge cell in which discharge light emission is not performed. Immediately before the scanning pulse SP is applied to each row electrode Y, the priming pulse PP of positive polarity is sequentially applied to the row electrodes $Y_1$–$Y_n$. The application of the priming pulse PP permits restoration of charged particles in a discharge space of the PDP 10. Therefore, pixel data is written by the application of the scanning pulse SP, while such charged particles still remain within the discharge space (pixel data writing stage Wc3 in FIG. 6G).

The priming discharge caused by the application of the priming pulse PP in the pixel data writing stages Wc2, Wc3 is only produced in light emitting discharge cells in which the discharge has been repeated to sustain light emission in the preceding light emission sustaining stages Ic1, Ic2, respectively.

After the pixel data writing stage Wc3 is completed, the first sustain driver 7 and the second sustain driver 8 applies the sustaining pulses $IP_X$ $IP_Y$ alternately to the row electrodes X, Y. In this event, a discharge cell which still holds the wall charge formed during the pixel data writing stage Wc2, i.e., a light emitting discharge cell repeats discharge light emission to sustain its light emitting state during a period in which it is applied alternately with the sustaining pulses $IP_X$, $IP_Y$ (light emission sustaining stage Ic3 in FIG. 6G).

The operations shown in FIGS. 6A to 6G are performed similarly in the second and third reset cycles in FIG. 5 to perform discharge light emission for one field.

Thus, as illustrated in FIG. 5, the simultaneous resetting operation is executed only three times, at the head of the first to third reset cycles during one field period. This can be accomplished because pixel data are converted in accordance with the tables of FIGS. 3 and 4 so as to ensure that each of all discharge cells transitions from a light emitting discharge cell to a non-light emitting discharge cell once or less in one reset cycle as shown in FIGS. 6A–6G.

For example, the arrangement of the 0th-2nd bits in the converted pixel data HD, which govern whether or not light should be emitted in each of the subfields SF1*a*–SF1*c* (first reset cycle), are limited only to the following four patterns, as shown in FIGS. 3 and 4:

[1, 0, 0]

[0, 1, 0]

[0, 0, 1]

[0, 0, 0]

where "1" and "0" after "1" specify non-light emission, and "0" before "1" specifies light emission.

Stated another way, the present invention prohibits such a data pattern that returns a discharge cell, which has once been set to a light emitting discharge cell in a single reset cycle, again to a non-light emitting discharge cell.

Therefore, the simultaneous resetting operation for forming the wall charges in all of the discharge cells is required only once at the head of each reset cycle.

Figure 1:
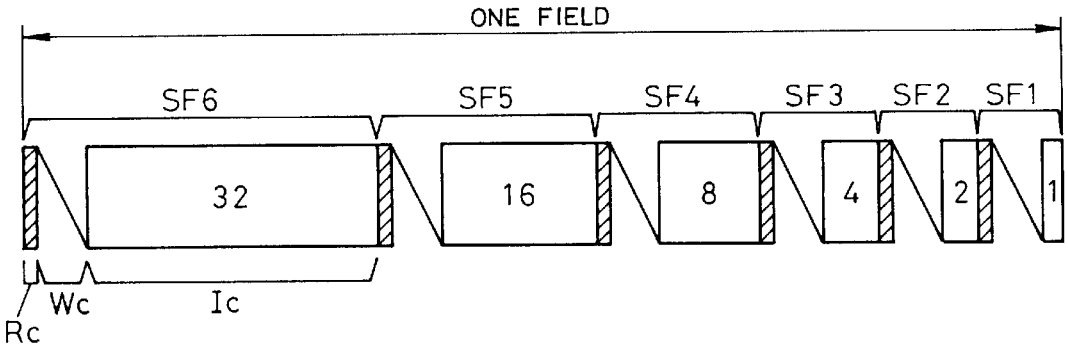
FIG. 1 illustrates a conventional light emission driving format for realizing a half-tone display of 64 steps.

Thus, according to the present invention, since the simultaneous resetting operation needs to be executed only three times in one field period, i.e., at the head of the first-third reset cycles, the contrast can be enhanced as compared with the prior art format which requires the simultaneous resetting operation six times during one field period, as illustrated in FIG. 1.

Further, the selective erasing discharge (transition from a light emitting discharge cell to a non-light emitting discharge cell) is performed at maximum only once in each of the first–third reset cycles illustrated in FIG. 5, so that the number of times the selective erasing discharge is executed in one field period is merely three times at maximum.

It is therefore possible to reduce power consumption as compared with the prior art format, as illustrated in FIG. 1, which requires the selective erasing discharge maximally six times in one field period.

Moreover, in the present invention, a subfield having a long light emitting period is divided into a plurality of subfields in such a manner as to ensure that at least one of these divided subfields is brought into a light emitting state when a display is produced at a predetermined luminance level or more. For example, for performing a high luminance display with the luminance level at "16" or more, as shown in FIG. 3, associated pixel data is converted such that the subfield SF3*a,* which has the longest light emitting period within the subfields SF3*a* –SF3*c* in FIG. 5, is brought into a light emitting state.

Therefore, even in a display with few changes in luminance gradation, mutually adjacent discharge cells will not be inverted between them in the light emission pattern, thereby making it possible to suppress the pseudo-contour.

While in the foregoing embodiment, the PDP 10 is driven using a conversion table as shown in FIGS. 3 and 4 for the data conversion circuit 3 and in accordance with the light emission driving format as illustrated in FIG. 5, the present invention is not limited to this particular configuration.

Figure 9:
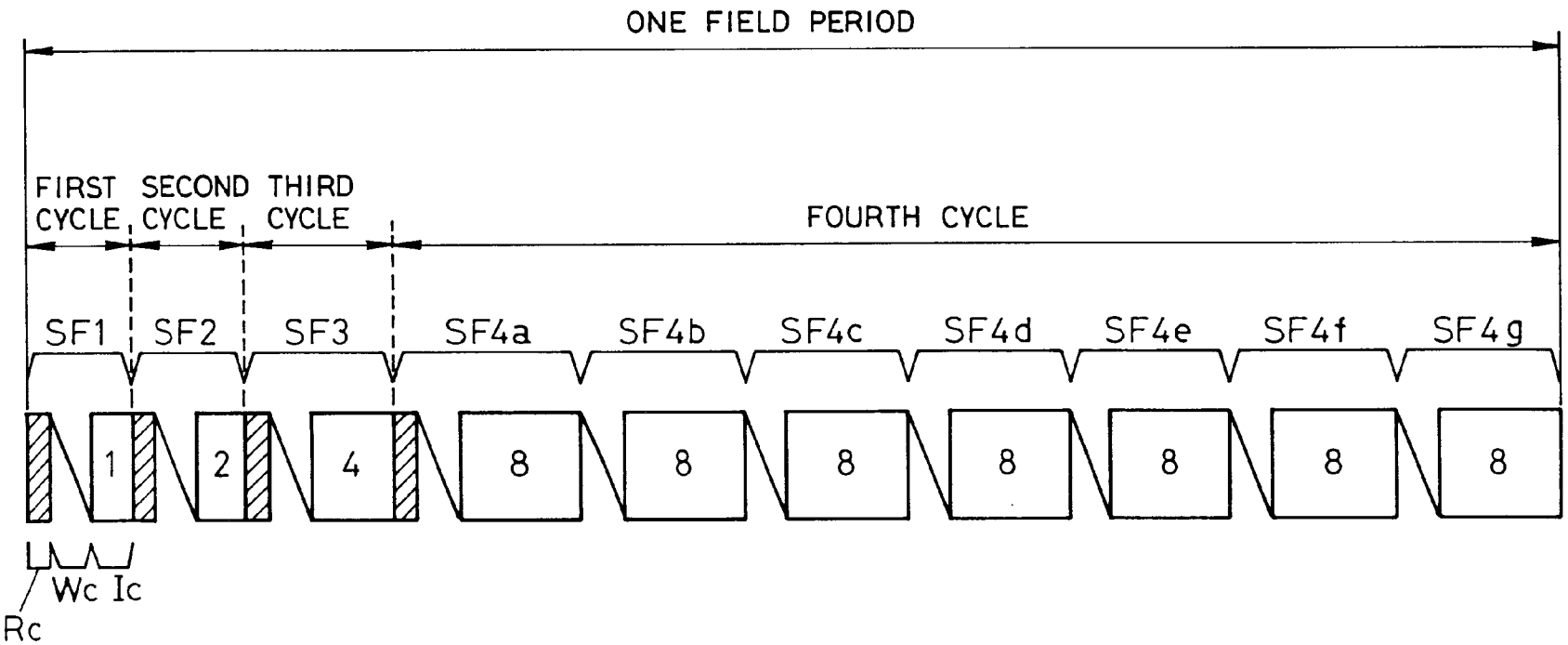
FIG. 9 illustrates another example of a light emission driving format according to the present invention.

Alternatively, even when the PDP 10 is driven using a conversion table as shown in FIGS. 7 and 8 in the data converting circuit 3 and in accordance with a light emission driving format as illustrated in FIG. 9, for example, the number of times of the simultaneous resetting operations can be reduced in a similar manner.

Specifically, in the light emission driving format illustrated in FIG. 9, one field period is partitioned into first to tenth subperiods, wherein discharge light emission through a subfield SF1 is performed in a first subperiod (first reset cycle); discharge light emission through a subfield SF2 in a second subperiod (second reset cycle); discharge light emission through a subfield SF3 in a third subperiod (third reset cycle); and discharge light emission through a subfield SF4 in fourth to tenth subperiods SF4*a* –SF4*g* (fourth reset cycle).

A light emitting time for discharge light emission performed in each of the subfields SF1–SF4 is as follows, assuming that a light emitting time in the subfield SF1 is "1":

SF1: 1

SF2: 2

SF3: 4

SF4*a*–SF4*c:* 8

In this event, the logical levels of the 0th–9th bits of the converted pixel data HD as shown in FIGS. 7 and 8 determine whether or not light should be emitted in each of the subfields SF1, SF2, SF3, SF4*a*–SF4*g,* as illustrated in FIG. 9.

More specifically, the 0th–9th bits of the converted pixel data HD determine whether or not light should be emitted in the respective subfields in a correspondence relationship as shown below:

0th bit: Subfield SF1

1st bit: Subfield SF2

2nd bit: Subfield SF3

3rd bit: Subfield SF4*a*

4th bit: Subfield SF4*b*

5th bit: Subfield SF4*c*

6th bit: Subfield SF4*d*

7th bit: Subfield SF4*e*

8th bit: Subfield SF4*f*

9th bit: Subfield SF4*g*

In the light emission driving format illustrated in FIG. 9, a simultaneous resetting stage Rc as indicated by hatching is performed only at the head of each reset cycle.

Particularly, in the fourth reset cycle, data is converted on the basis of FIGS. 7 and 8 so as to ensure that each of all discharge cells transitions from a light emitting discharge cell to a non-light emitting discharge cell once or less.

For example, the arrangement of the 3rd–9th bits in converted pixel data HD governing whether or not light should be emitted in each of the subfields SF4*a*–SF4*g* is limited only to the following eight patterns, as shown in FIGS. 7 and 8:

[1, 0, 0, 0, 0, 0, 0]

[0, 1, 0, 0, 0, 0, 0]

[0, 0, 1, 0, 0, 0, 0]

[0, 0, 0, 1, 0, 0, 0]

[0, 0, 0, 0, 1, 0, 0]

[0, 0, 0, 0, 0, 1, 0]

[0, 0, 0, 0, 0, 0, 1]

[0, 0, 0, 0, 0, 0, 0]

Stated another way, the present invention prohibits such a data pattern that returns a discharge cell, which has once been set to a light emitting discharge cell, again to a non-light emitting discharge cell in the fourth reset cycle.

Therefore, the simultaneous resetting operation for forming the wall charges in all of the discharge cells is required only once at the head of this fourth reset cycle.

Thus, according to this embodiment, since the simultaneous resetting operation needs to be executed only four times in one field period, i.e., at the head of the first–fourth reset cycles, the contrast can be enhanced as compared with the prior art format, as illustrated in FIG. 1, which requires the simultaneous resetting operation six times during one field period.

Further, the selective erasing discharge (transition from a light emitting discharge cell to a non-light emitting discharge cell) is performed at maximum only once in each of the first–fourth reset cycles as illustrated in FIG. 9, so that the total number of times the selective erasing discharge is executed in one field period is merely four at maximum.

It is therefore possible to reduce power consumption as compared with the prior art format, as illustrated in FIG. 1, which requires the selective erasing discharge maximally six times in one field period.

It should be noted that in the driving method illustrated in FIGS. 7, 8, 9, a pseudo-contour is likely to occur on the screen when the luminance level of pixel data transitions, for example, from "7" to "8."

Specifically, as shown in FIG. 7, converted pixel data HD corresponding to the luminance level "7" is:

[0, 0, 0, 1, 0, 0, 0, 0, 0, 0]

while converted pixel data HD corresponding to the luminance level "8" is:

[1, 1, 1, 0, 1, 0, 0, 0, 0, 0]

As can be seen, in spite of a change in the luminance level by one step, bits corresponding to the subfields SF1, SF2, SF3, SF4*a* in the light emission pattern are all inverted, so that this can be viewed as an erroneous contour.

Figure 10:
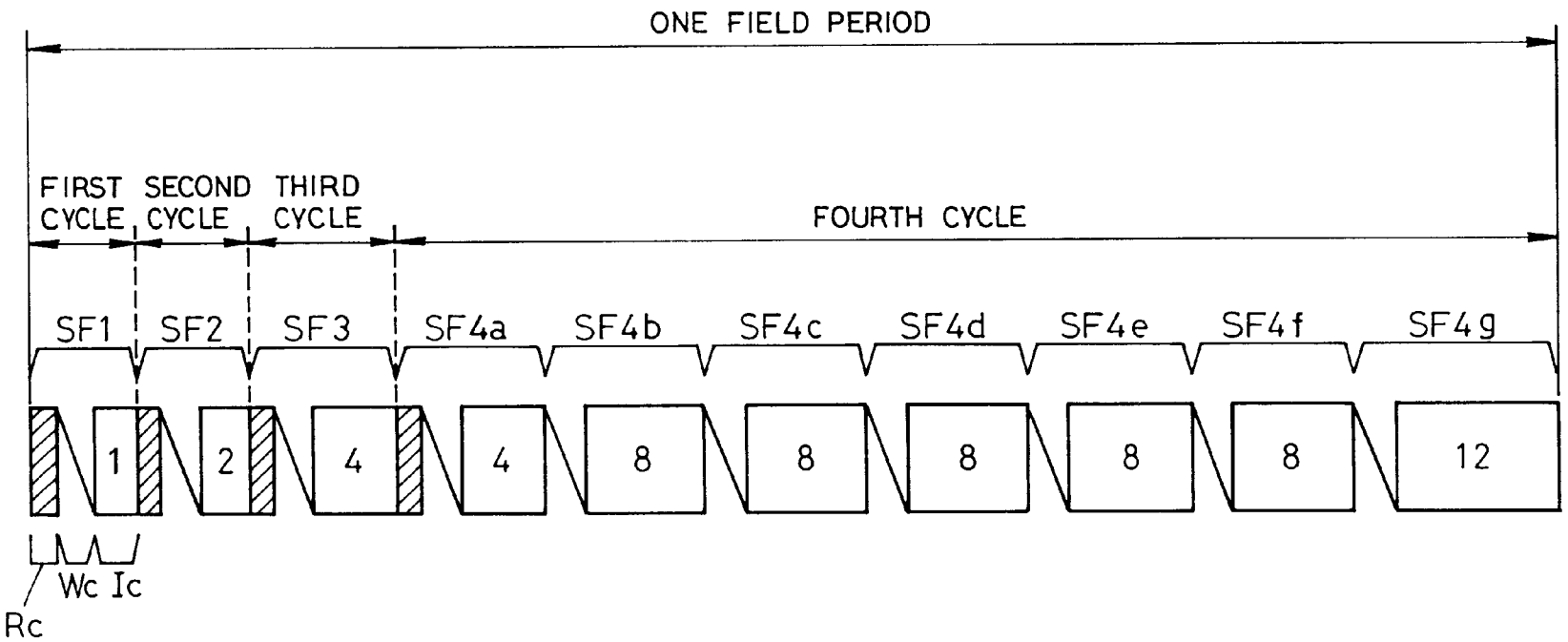
FIG. 10 illustrates a further example of a light emission driving format according to the present invention.

FIG. 10 illustrates a light emission driving format according to another embodiment which is created in view of the occurrence of such a pseudo-contour, and FIGS. 11 and 12 shows a conversion table for use in driving the PDP in accordance with this light emission driving format.

In the light emission format illustrated in FIG. 10, the light emission period ratio "8" in the subfield SF4*a* shown in FIG. 9 is reduced to "4" which is identical to that of the subfield SF3 positioned preceding thereto, and the reduced portion is compensated for by increasing the light emission period ratio of the subfield SF4*g* to "12."

According to this light emission driving format, as shown in FIG. 11, converted pixel data HD corresponding to the luminance level "7" can be set to:

[0, 0, 0, 1, 0, 0, 0, 0, 0, 0]

while converted pixel data HD corresponding to the luminance level "8" can be set to:

[1, 1, 0, 0, 1, 0, 0, 0, 0, 0]

With these converted pixel data HD, while bits in the light emission pattern corresponding to the subfields SF1, SF2, SF4*a* are inverted, the bit corresponding to the subfield SF3 is not inverted. The occurrence of pseudo-contour is therefore prevented even if the luminance level of pixel data transitions from "7" to "8."

In essence, a duration of sustained light emission, performed in the first subfield SF4*a* in a group of a plurality of subfields (fourth cycle), is first set identical to a duration of sustained light emission performed in the subfield SF3 preceding to the group of subfields.

Figure 13:
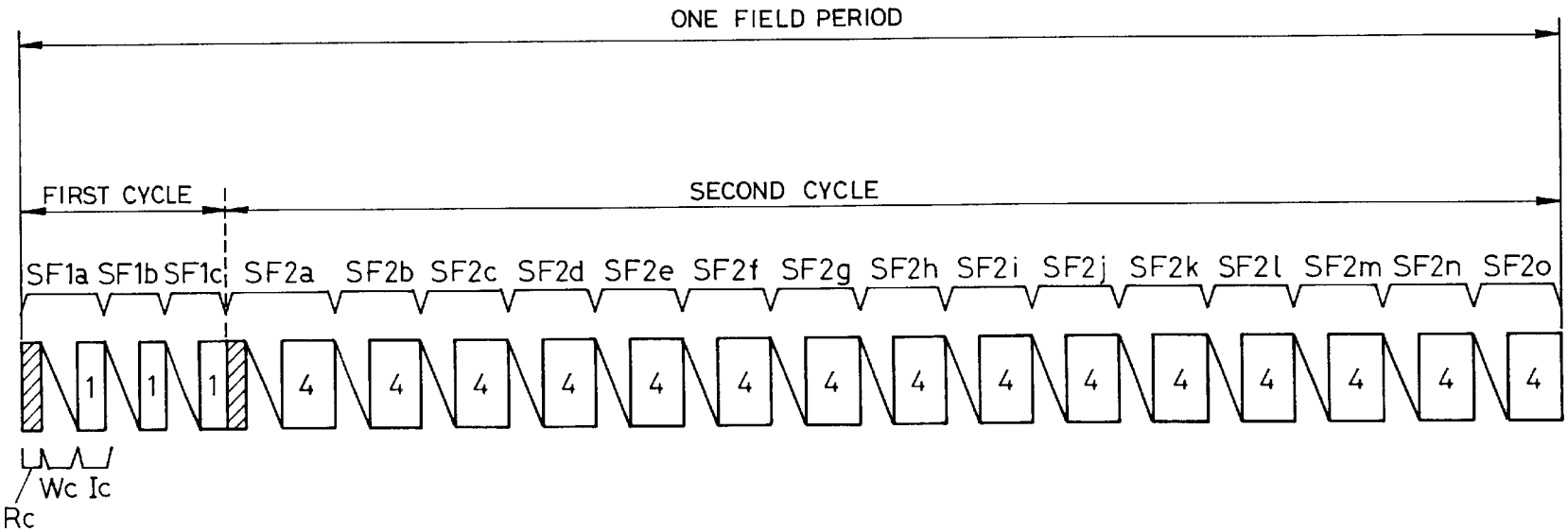
FIG. 13 illustrates a further example of a light emission driving format according to the present invention.

Here, when the luminance level of pixel data transitions by only one step, pixel data is converted as shown in FIGS. 11 and 12 so as to ensure that either the first subfield SF4*a* in the group of subfields or the subfield SF3 maintains a light emitting state before the transition. More specifically, as shown in FIG. 11 and 12, when the luminance level changes one step, the bits corresponding to the subfields SF4*a*, SF3 in the light emission pattern are changed:

from [0, 1] to [0, 0] when the luminance level transitions from "7" to "8"; and from [0, 0] to [1, 0] when the luminance level transitions from "11" to "12," so that either one maintains the light emitting state before the transition. While in the foregoing embodiment, the simultaneous rest operation is performed three times (FIG. 5) or four times (FIGS. 9, 10) in one field period, a light emission driving format as illustrated in FIG. 13 may be employed to reduce the number of times of the simultaneous resetting operation to two.

Figure 14:
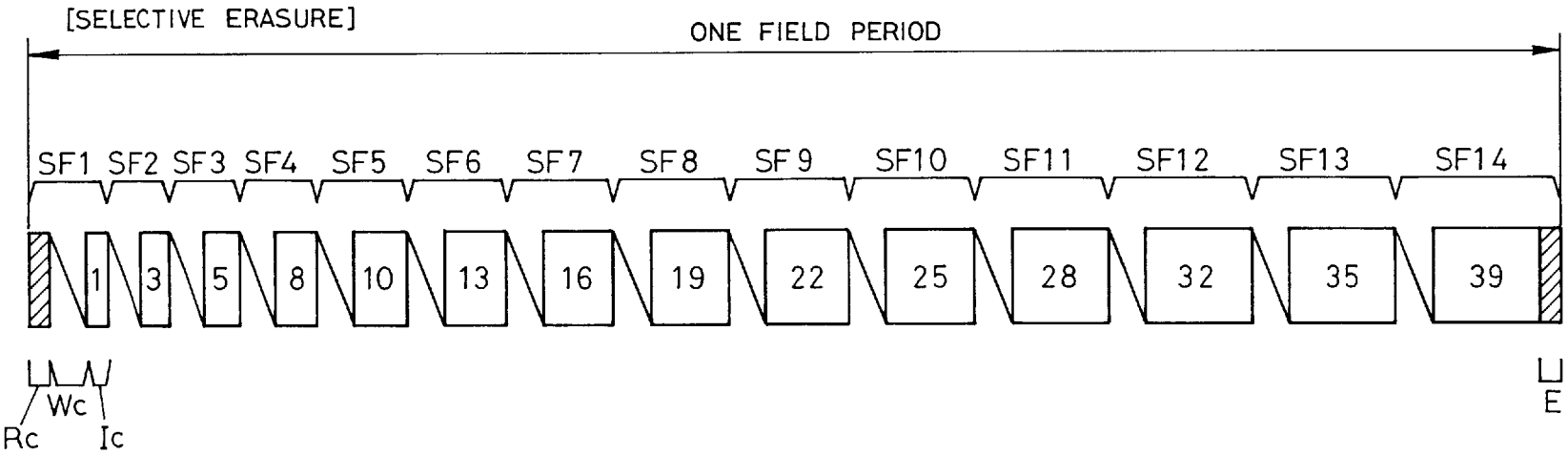
FIG. 14 illustrates a further example of a light emission driving format (selective erasure address method) according to the present invention.
Figure 15:
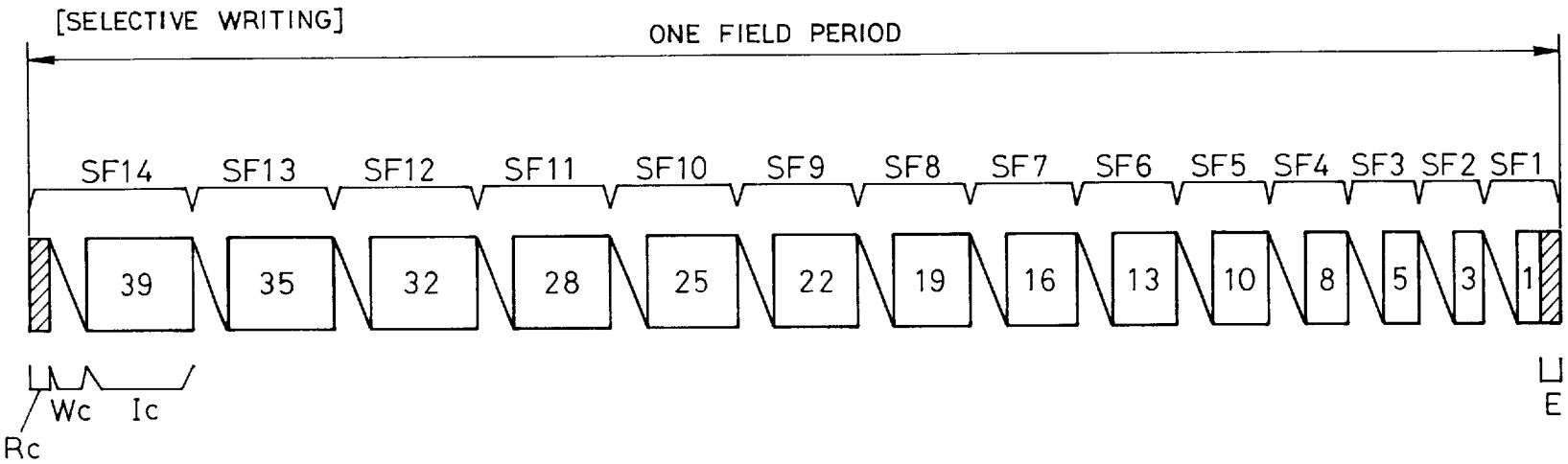
FIG. 15 illustrates a further example of a light emission driving format (selective writing method) according to the present invention.

It is further possible to perform only once the simultaneous resetting operation in one field period by employing a light emission driving format as illustrated in FIGS. 14 and 15. FIG. 14 illustrates a light emission driving format for writing pixel data in accordance with the selective erasure address method as mentioned above in the pixel data writing stage Wc, while FIG. 15 illustrates a light emission driving format for writing pixel data in accordance with the selective writing address method.

In the light emission driving formats illustrated in FIGS. 14 and 15, one field period is divided into 14 subfields SF1–SF14. Each of the subfields SF1–SF14 includes a pixel data writing stage Wc for writing pixel data to set light emitting cells and non-light emitting cells, and a light emission sustaining stage Ic for sustaining a discharge light emitting state only in the light emitting cells. In this event, a light emitting time (the number of times of light emission) in each light emission sustaining stage Ic of the subfields SF1–SF14 is set as follows, assuming that a light emitting time in the subfield SF1 is "1":

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

Specifically, the ratio of the numbers of times of light emission in the respective subfields SF1–SF14 is set nonlinear (i.e., an inverse gamma ratio: $Y=X^{2.2}$ ) to correct a nonlinear characteristic (gamma characteristic) of input pixel data D.

Further, in these subfields, the simultaneous resetting stage Rc is executed only in the first subfield. Specifically, the simultaneous resetting stage Rc is executed only in the subfield SF1 in the light emission driving format when employing the selective erasure address method as illustrated in FIG. 14, and only in the subfield SF14 in the light emission driving format when employing the selective writing method as illustrated in FIG. 15. In addition, an erasing stage E for extinguishing wall charges remaining in all discharge cells is executed in the last subfield of one field period, as illustrated in FIGS. 14 and 15.

Figure 16:
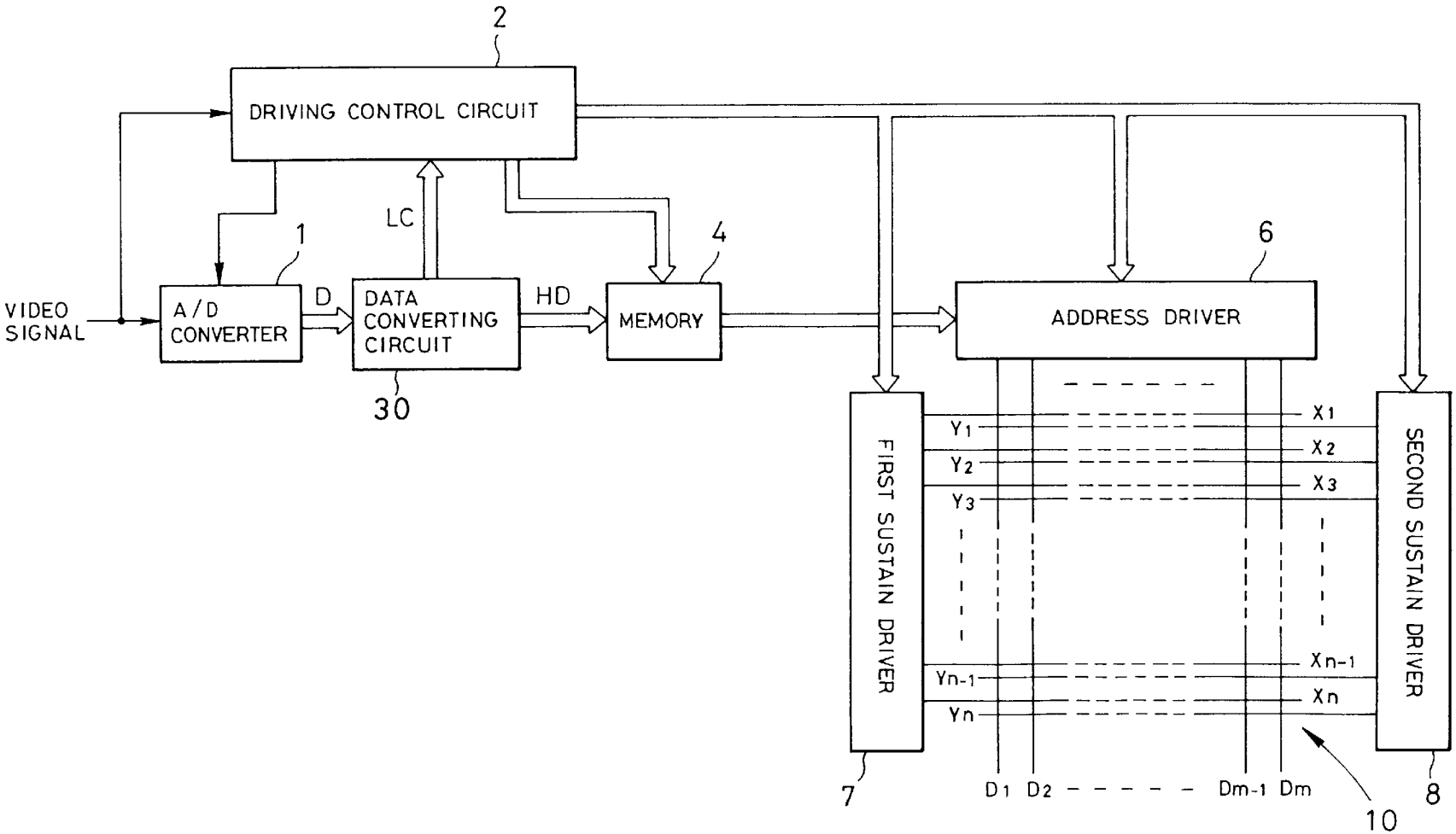
FIG. 16 is a schematic diagram generally illustrating the configuration of a plasma display device according to another embodiment of the present invention.

FIG. 16 illustrates the configuration of a plasma display device for performing the light emission driving operations based on the light emission driving formats of FIGS. 14 and 15.

As can be seen, the plasma display device illustrated in FIG. 16 has a data converting circuit 30 instead of the data converting circuit 3 in the configuration illustrated in FIG. 2, and the rest of functional modules except for the data converting circuit 30 are identical to those illustrated in FIG. 2. Therefore, the following description will be made only on the operation of the data converting circuit 30 illustrated in FIG. 16.

Figure 17:
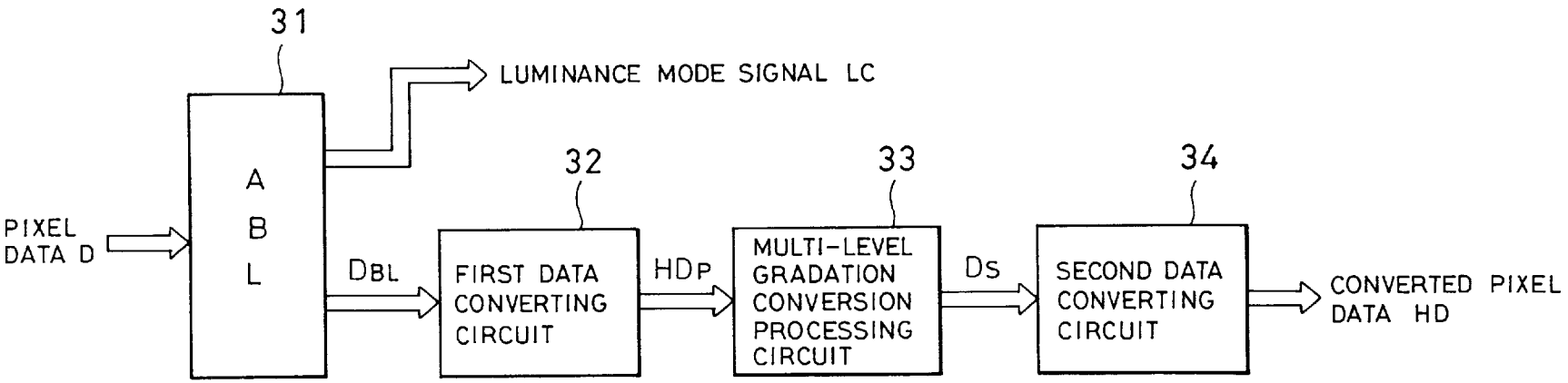
FIG. 17 is a block diagram illustrating the internal configuration of a data converting circuit 30.

FIG. 17 is a block diagram illustrating the internal configuration of the data converting circuit 30. Referring specifically to FIG. 17, an ABL (automatic brightness limiting) circuit 31 adjusts the luminance level of pixel data D for each pixel sequentially supplied thereto from an A/D converter 1 such that an average luminance of pixels displayed on the screen of the PDP 10 falls within a predetermined luminance range, and supplies the resulting luminance adjusted pixel data $D_{BL}$ to a first data converting circuit 32.

Since the adjustment of the luminance level is performed before the ratio of the numbers of times of light emission in the respective subfields is set nonlinear to conduct an inverse gamma correction as mentioned, the ABL circuit 31 is adapted to conduct an inverse gamma correction on the pixel data D (input pixel data), and automatically adjust the luminance level of the pixel data D (input pixel data) in accordance with an average luminance of the thus produced inverse gamma converted pixel data. This can prevent the display quality from degrading due to the luminance adjustment.

Figure 18:
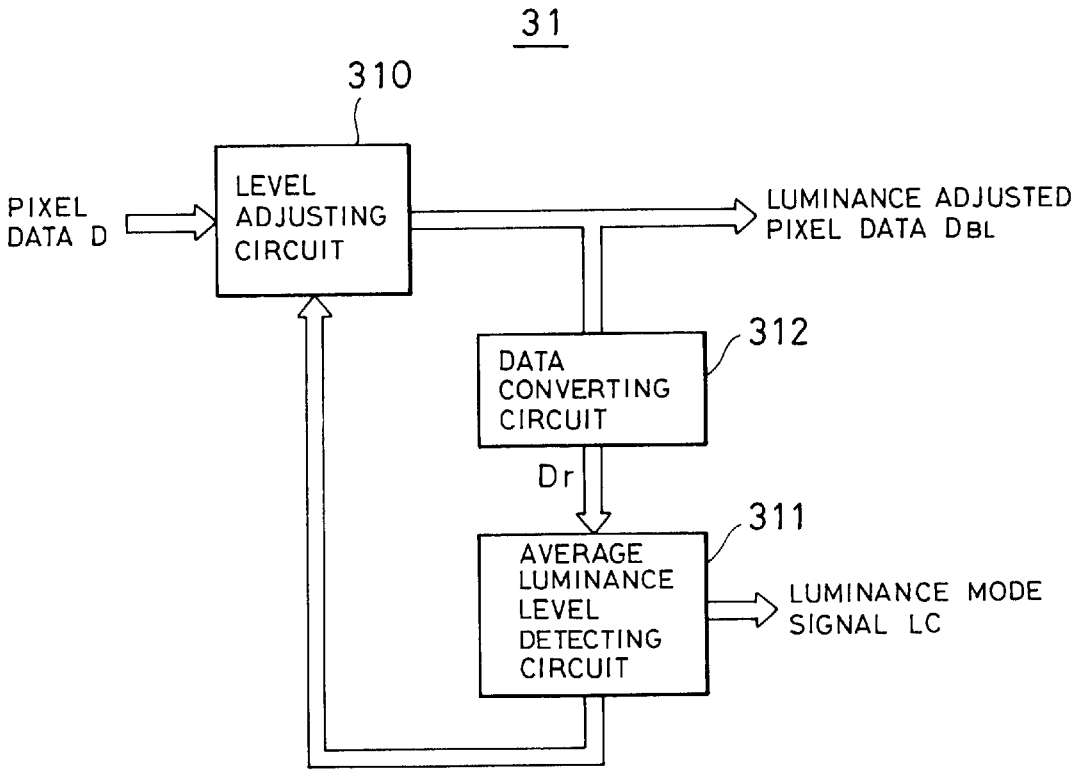
FIG. 18 is a block diagram illustrating the internal configuration of an ABL circuit 31.
Figure 19:
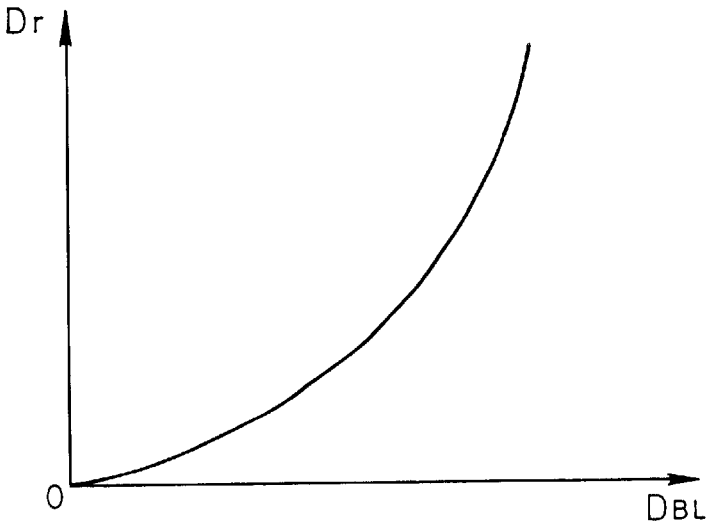
FIG. 19 is a graph illustrating a conversion characteristic in a data converting circuit 312.

FIG. 18 is a block diagram illustrating the internal configuration of the ABL circuit 31. Referring specifically to FIG. 18, a level adjusting circuit 310 adjusts the level of pixel data D in accordance with an average luminance calculated in an average luminance detecting circuit 311, later described, and outputs resulting luminance adjusted pixel data $D_{BL}$. A data converting circuit 312 converts the luminance adjusted pixel data DBL using the inverse gamma characteristic ($Y=X^{2,2}$) representing a nonlinear characteristic as illustrated in FIG. 19 to produce inverse gamma converted pixel data Dr which is supplied to the average luminance level detecting circuit 311. In other words, the data converting circuit 312 conducts the inverse gamma correction on the luminance adjusted pixel data $D_{BL}$ to recover pixel data (inverse gamma converted pixel data Dr) corresponding to an original video signal from which the gamma correction has been removed. The average luminance detecting circuit 311 calculates an average luminance from the inverse gamma converted pixel data Dr, and supplies the average luminance to the level adjusting circuit 310. The average luminance detecting circuit 311 also selects a luminance mode available for driving the PDP 10 to emit light at a luminance in accordance with the average luminance calculated as mentioned above, from luminance modes 1–4 which specify light emitting times in the respective subfields, for example, as shown in FIG. 20, and supplies a luminance mode signal LC indicative of the selected luminance mode to a driving control circuit 2.

Figure 21:
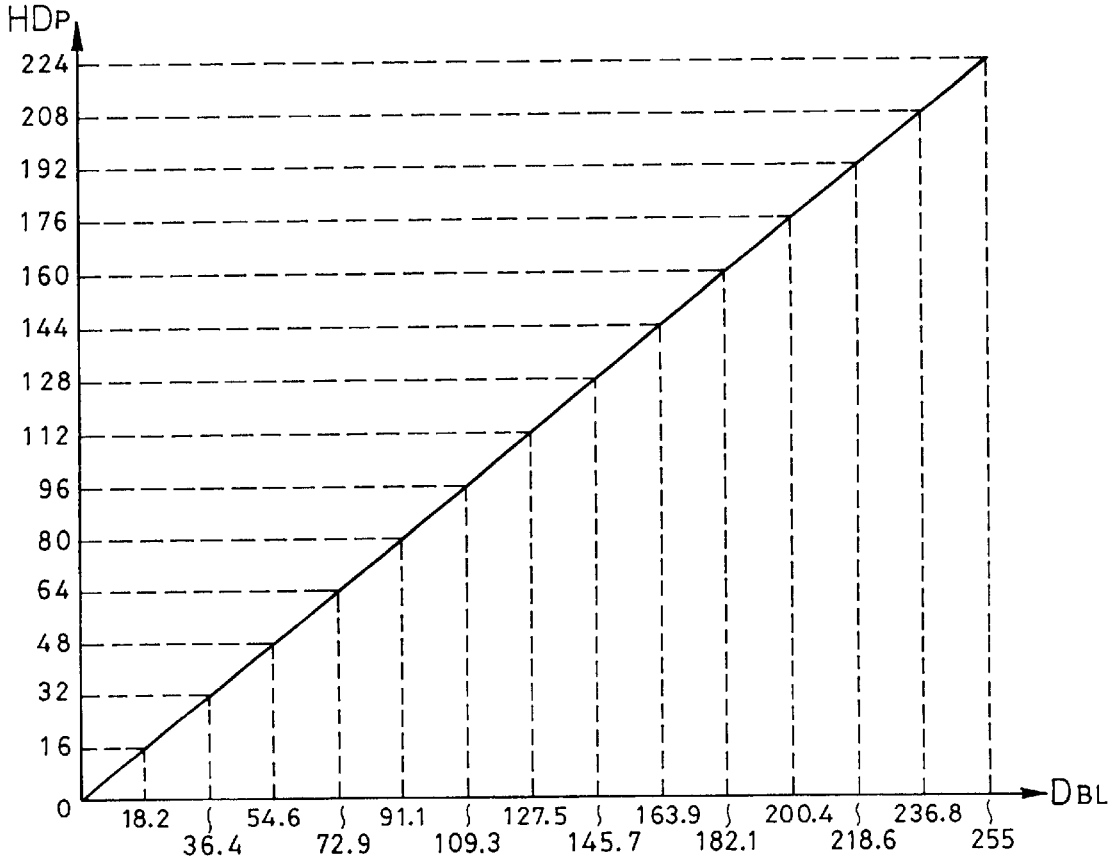
FIG. 21 is a graph illustrating a conversion characteristic in a first data converting circuit 32.

Here, the first data converting circuit 32 converts input luminance adjusted pixel data $D_{BL}$ capable of representing 256 steps of gradation (8 bits) to 8-bit (0–244) converted pixel data $HD_P$ having the number of gradation levels reduced by 14×16/255 (224/255), based on a conversion characteristic as shown in FIG. 21, and supplies the converted pixel data $HD_P$ to a multi-level gradation conversion processing circuit 33. Specifically, the 8-bit input luminance adjusted pixel data $D_{BL}$ (0–255) is converted in accordance with a conversion table as shown in FIGS. 22 and 23 based on the conversion characteristic as mentioned. The conversion characteristic is determined in accordance with the number of bits of input pixel data, the number of compressed bits by multi-level gradation conversion, and the number of steps of gradation in display. Thus, the first data converting circuit 32 is disposed in front of the multi-level gradation conversion processing circuit 33, later described, to perform a conversion in accordance with the number of steps in gradation and the number of compressed bits by multi-tone, to thereby divide the luminance adjusted pixel data $D_{BL}$ into a group of upper bits (corresponding to multi-tone pixel data) and a group of lower bits (data to be truncated, i.e., error data) on a bit boundary, and to perform multi-level gradation conversion processing based on the multi-tone pixel data. This can prevent the occurrence of luminance saturation due to the multi-level gradation conversion processing, and the occurrence of flatness in the display characteristic which may be found when display gradation does not lie on the bit boundary (i.e., occurrence of gradation distortion).

Figure 24:
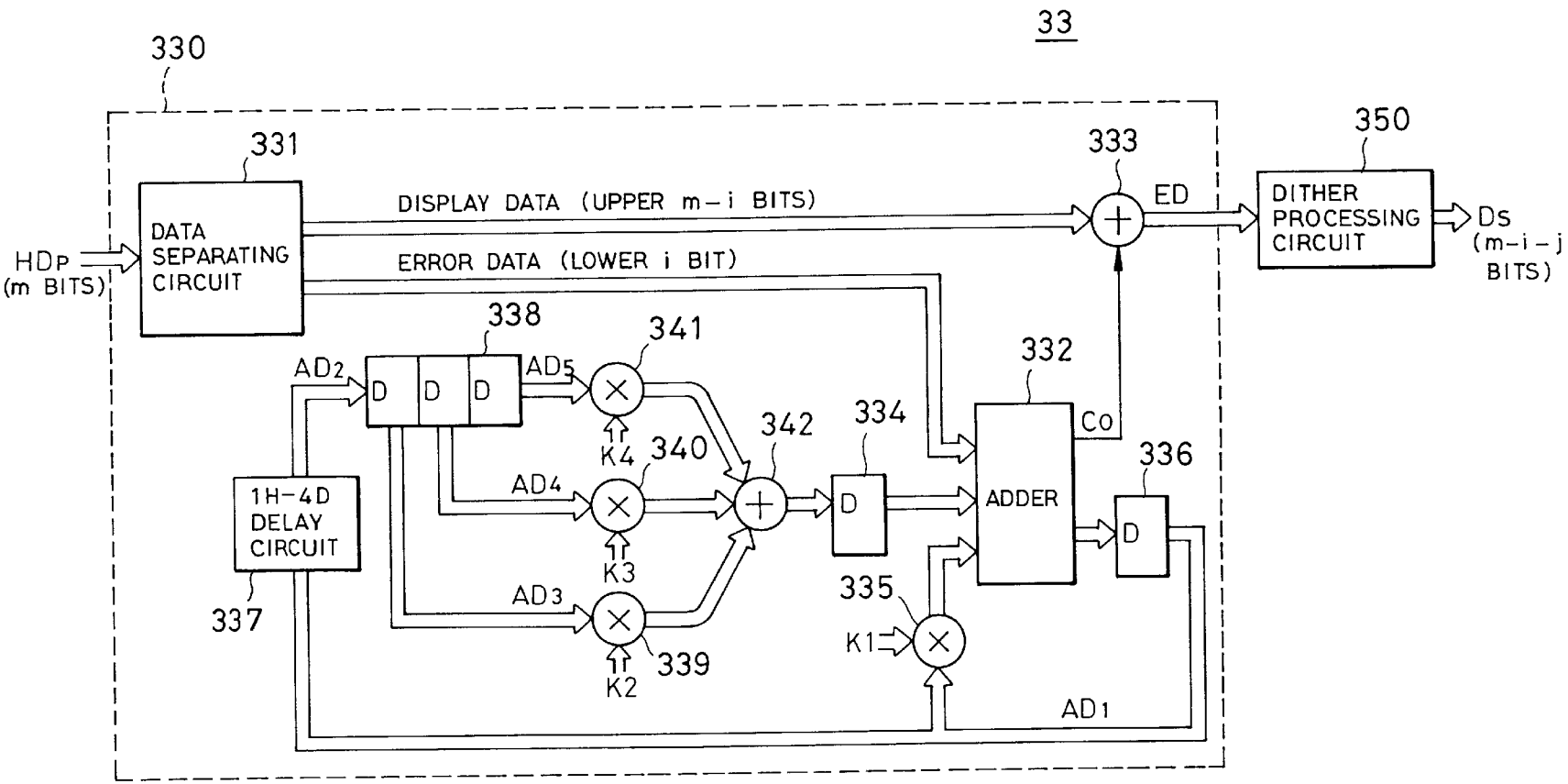
FIG. 24 is a block diagram illustrating the internal configuration of a multi-level gradation conversion processing circuit 33.

FIG. 24 is a block diagram illustrating the internal configuration of the multi-level gradation conversion processing circuit 33. As illustrated in FIG. 24, the multi-level gradation conversion processing circuit 33 is composed of an error diffusion processing circuit 330 and a dither processing circuit 350.

First, a data separating circuit 331 in the error diffusion processing circuit 330 separates m-bit converted pixel data $HD_P$ supplied from the first data converting circuit 32 illustrated in FIG. 17 into lower i bits as error data and upper (m−i) bits as display data.

An adder 332 adds the lower i bits of the converted pixel data $HD_P$ as the error data, a delay output from a delay circuit 334, and a multiplication output of a coefficient multiplier 335 to produce an addition value which is supplied to a delay circuit 336. The delay circuit 336 delays the addition value supplied from the adder 332 by a delay time D having the same time as a clock period of the pixel data to produce a delayed addition signal $AD_1$ which is supplied to the coefficient multiplying circuit 335 and to a delay circuit 337, respectively.

The coefficient multiplier 335 multiplies the delayed addition signal $AD_1$ by a predetermined coefficient value $K_1$ (for example, "7/16"), and supplies the multiplication result to the adder 332.

The delay circuit 337 again delays the delayed addition signal $AD_1$ by a time equal to (one horizontal scan period minus the delay time D multiplied by four) to produce a delayed addition signal $AD_2$ which is supplied to a delay circuit 338. The delay circuit 338 further delays the delayed addition signal $AD_2$ by the delay time D to produce a delayed addition signal $AD_3$ which is supplied to a coefficient multiplier 339. The delay circuit 338 further delays the delayed addition signal $AD_2$ by a time equal to the delay time D multiplied by two to produce a delayed addition signal $AD_4$ which is supplied to a coefficient multiplier 340. The delay circuit 338 further delays the delayed addition signal $AD_2$ by a time equal to the delay time D multiplied by three to produce a delayed addition signal $AD_5$ which is supplied to a coefficient multiplier 341.

The coefficient multiplier 339 multiplies the delayed addition signal $AD_3$ by a predetermined coefficient value $K_2$ (for example, "3/16"), and supplies the multiplication result to an adder 342. The coefficient multiplier 340 multiplies the delayed addition signal $AD_4$ by a predetermined coefficient value $K_3$ (for example, "5/16"), and supplies the multiplication result to the adder 342. The coefficient multiplier 341 multiplies the delayed addition signal $AD_5$ by a predetermined coefficient value $K_4$ (for example, "1/16"), and supplies the multiplication result to the adder 342.

The adder 342 adds the multiplication results supplied from the respective coefficient multipliers 339, 340, 341 to produce an addition signal which is supplied to the delay circuit 334. The delay circuit 334 delays the addition signal by the delay time D to produce a delayed signal which is supplied to the adder 332. The adder 332 adds the lower i bits of the converted pixel data $HD_P$, the delayed signal output from the delay circuit 334 and the multiplication output from the coefficient multiplier 335, and generates a carry-out signal $C_0$ which is at logical level "0" when a carry is not generated as a result of the addition, and at logical level "1" when a carry is generated. The carry-out signal $C_0$ is supplied to an adder 333.

The adder 333 adds the carry-out signal $C_0$ to display data consisting of the upper (m−i) bits of the converted pixel data $HD_P$ to output the error diffusion processed pixel data ED having (m−i) bits. Consequently, the number of bits of the error diffusion processed pixel data ED is smaller than that of the converted pixel data $HD_P$.

The operation of the error diffusion processing circuit 330 configured as described above will be described below.

Figure 25:
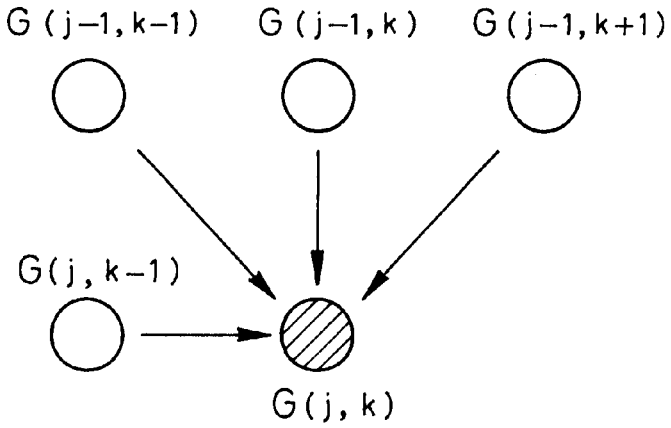
FIG. 25 is a diagram for describing the operation of an error diffusion processing circuit 330.

For producing error diffusion processed pixel data ED corresponding to a pixel G(j, k) for the PDP 10, for example, as illustrated in FIG. 25, respective error data corresponding to a pixel G(j, k−1) on the left side of the pixel G(j, k), a pixel G(j−1, k−1) off to the upper left of the pixel G(j, k), a pixel G(j−1, k) above the pixel G(j, k), and a pixel G(j−1, k+1) off to the upper right of the pixel G(j, k), i.e.:

error data corresponding to the pixel G(j, k−1): delayed addition signal $AD_1$;

error data corresponding to the pixel G(j−1, k+1); delayed addition data $AD_3$;

error data corresponding to the pixel G(j−1, k): delayed addition data $AD_4$; and error data corresponding to the pixel G(j−1, k−1): delayed addition data $AD_5$, are weighted with the predetermined coefficient values $K_1$–$K_4$, as mentioned above, and added. Next, the lower i bits of converted pixel data $HD_P$, i.e., error data corresponding to the pixel G(j, k) is added to the addition result, and a 1-bit carry-out signal $C_0$ resulting from the addition is added to the upper (m−i) bits of the converted pixel data $HD_P$, i.e., display data corresponding to the pixel G(j, k) to produce the error diffusion processed pixel data ED.

With the configuration as described, the error diffusion processing circuit 330 regards the upper (m−i) bits of the converted pixel data $HD_P$ as display data, and the remaining lower i bits as error data, and reflects the weighted addition of the error data at the respective peripheral pixels {G(j, k−1), G(j−1, k+1), G(j−1, k), G(j−1, k−1)} to the display data. With this operation, the luminance for the lower i bits of the original pixel {G(j, k)} is virtually represented by the peripheral pixels, so that gradation representation of luminance equivalent to that provided by the m-bit pixel data can be accomplished with display data having a number of bits less than m bits, i.e., (m−i) bits.

If the coefficient values for the error diffusion were constantly added to respective pixels, noise due to an error diffusion pattern could be visually recognized to cause a degraded image quality.

To eliminate this inconvenience, the coefficients $K_1$–$K_4$ for the error diffusion to be assigned to four pixels may be changed from field to field in a manner similar to dither coefficients, later described.

The dither processing circuit 350 performs dither processing on the (m−i)-bit error diffusion processed pixel data ED supplied from the error diffusion processing circuit 330 to generate multi-level gradation converted pixel data $D_S$ which has the number of bits reduced to (m−i−j) bits while maintaining the number of levels of luminance gradation equivalent to the error diffusion processed pixel data ED. The dither processing refers to representation of an intermediate display level with a plurality of adjacent pixels. For example, for achieving a gradation display comparable to 8 bits using upper 6 bits of 8-bit pixel data, four pixels vertically and horizontally adjacent to each other are grouped into a set, and four dither coefficients a–d having coefficient values different from each other are assigned to respective pixel data corresponding to the respective pixels in the set, and added. In accordance with the dither processing as described, a combination of four different intermediate display levels can be produced with four pixels. Thus, even with 6-bit pixel data, an available number of levels of luminance gradation are four times as much. In other words, a half tone display comparable to that provided by 8 bits can be achieved.

However, if a dither pattern formed of the dither coefficients a–d were constantly added to each pixel, noise due to the dither pattern could be visually recognized, thereby causing a degraded image quality.

To eliminate this inconvenience, the dither processing circuit 350 changes the dither coefficients a–d assigned to four pixels from field to field.

Figure 26:
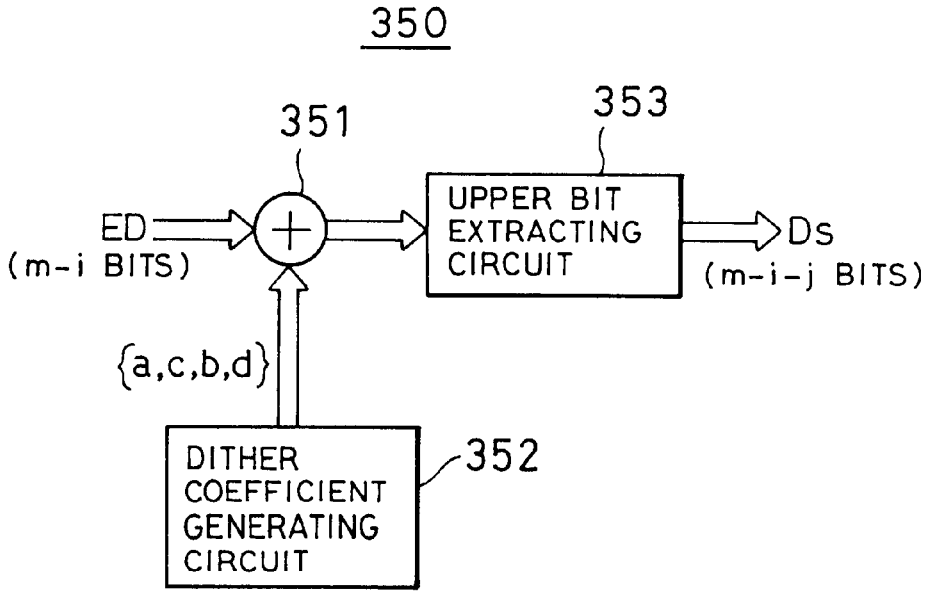
FIG. 26 is a block diagram illustrating the internal configuration of a dither processing circuit 350.
Figure 27:
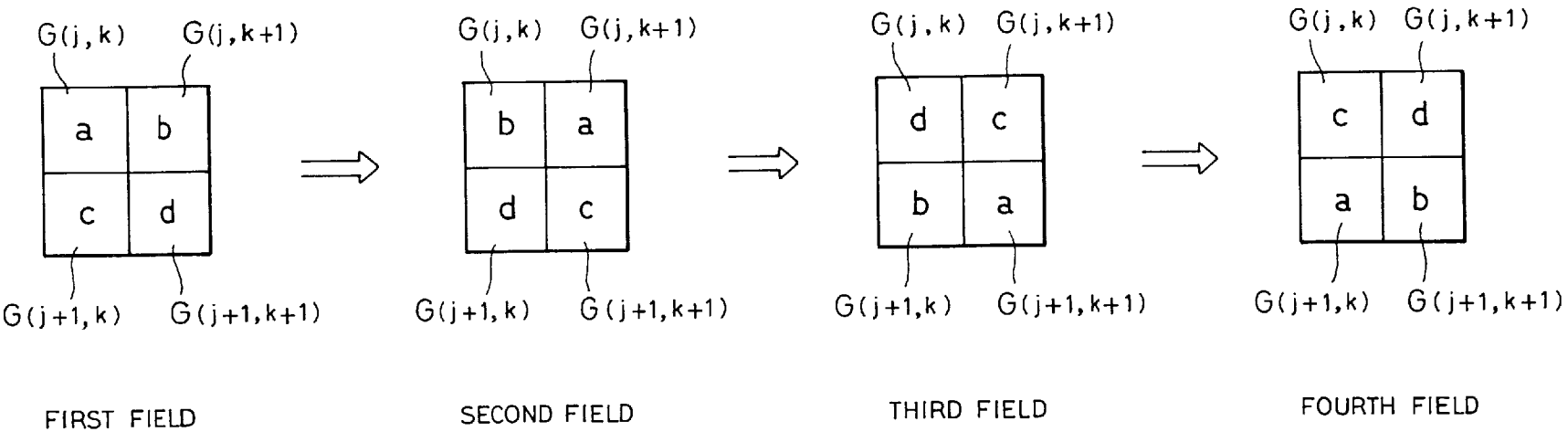
FIG. 27 is a diagram for describing the operation of the dither processing circuit 350.

FIG. 26 is a block diagram illustrating the internal configuration of the dither processing circuit 350. Referring specifically to FIG. 26, a dither coefficient generating circuit 352 generates four dither coefficients a, b, c, d for four mutually adjacent pixels, and supplies these dither coefficients sequentially to an adder 351. For example, as shown in FIG. 27, four dither coefficients a, b, c, d are generated corresponding to four pixels: a pixel G(j, k) and a pixel G(j, k+1) corresponding to a jth row, and a pixel (j+1, k) and a pixel G(j+1, k+1) corresponding to a (j+1)th row, respectively. In this event, the dither coefficient generating circuit 352 changes the dither coefficients a–d assigned to these four pixels from field to field as shown in FIG. 27.

Specifically, the dither coefficients a–d are repeatedly generated in a cyclic manner with the following assignment:

in the first field:

pixel G(j, k): dither coefficient a pixel G(j, k+1): dither coefficient b pixel G(j+1, k): dither coefficient c pixel G(j+1, k+1): dither coefficient d in the second field:

pixel G(j, k): dither coefficient b pixel G(j, k+1): dither coefficient a pixel G(j+1, k): dither coefficient d pixel G(j+1, k+1): dither coefficient c in the third field:

pixel G(j, k): dither coefficient d pixel G(j, k+1): dither coefficient c pixel G(j+1, k): dither coefficient b pixel G(j+1, k+1): dither coefficient a in the fourth field:

pixel G(j, k): dither coefficient c pixel G(j, k+1): dither coefficient d pixel G(j+1, k): dither coefficient a pixel G(j+1, k+1): dither coefficient b The dither coefficient generating circuit 352 supplies these dither coefficients to the adder 351. Then, the dither coefficient generating circuit 352 repeatedly executes the operations in the first to fourth fields as described above. In other words, upon completion of the dither coefficient generating operation in the fourth field, the dither coefficient generating circuit 352 again returns to the operation in the first field to repeat the foregoing operation.

The adder 351 adds the dither coefficients a–dassigned to each of the fields as described above to each of the error diffusion processed pixel data ED, supplied thereto from the error diffusion processing circuit 330, corresponding to the pixels G(j, k), G(j, k+1), G(j+1, k), G(j+1, k+1) to produce dither added pixel data which is supplied to an upper bit extracting circuit 353.

For example, in the first field shown in FIG. 27, the adder 351 sequentially supplies:

the error diffusion processed pixel data ED corresponding to the pixel G(j, k)+the dither coefficient a;

the error diffusion processed pixel data ED corresponding to the pixel G(j, k+1)+the dither coefficient b;

the error diffusion processed pixel data ED corresponding to the pixel G(j+1, k)+the dither coefficient c; and the error diffusion processed pixel data ED corresponding to the pixel G(j+1, k+1)+the dither coefficient d;

to the upper bit extracting circuit 353 as the dither added pixel data.

The upper bit extracting circuit 353 extracts upper (m−i−j) bits of the dither added pixel data, and supplies the extracted bits to the second data converting circuit 34 illustrated in FIG. 17 as multi-level gradation converted pixel data $D_S$.

The second data converting circuit 34 converts the multi-level gradation converted pixel data $D_S$ to converted pixel data HD (display pixel data) consisting of 1st to 14th bits corresponding to the subfields SF1–SF14, respectively, illustrated in FIG. 14 or 15 in accordance with a conversion table shown in FIG. 28 or FIG. 29.

Referring to FIGS. 28 and 29, the multi-level gradation converted pixel data $D_S$ is produced by reducing the number of possible gradation levels of 8-bit input pixel data D (256 gradation levels) in a ratio of 224/225 in accordance with a first data conversion (the conversion table in FIGS. 22 and 23), and converting the reduced data to 4-bit data (0–14: 15 gradation levels) by multi-level gradation conversion processing (for example, a total of four bits are compressed, two bits in the error diffusion processing and two bits in the dither processing).

FIG. 28 shows a conversion table for use in light emission driving in accordance with the selective erasure address method as illustrated in FIG. 14, and FIG. 29 shows a conversion table for use in light emission driving in accordance with the selective writing method as illustrated in FIG. 15. In this event, a bit at logical level "1" in converted pixel data HD consisting of 1st–14th bits indicates that selective erasure discharge (selective write discharge) is performed in a pixel data writing stage Wc in a subfield SF corresponding to the bit. The converted pixel data HD are sequentially written into the memory 4 illustrated in FIG. 16 in response to a write signal supplied thereto from the driving control circuit 2. When the converted pixel data HD for one screen (n rows, m columns) have been written into the memory 4, the one screen portion of converted pixel data $HD_{11-nm}$ is divided into the respective bit digits (1st–14th bits). The divided bits are read from the memory 4 and supplied sequentially to the address driver 6 for each row.

When the light emission driving is performed, for example, in accordance with the selective erasure address method as illustrated in FIG. 14, the 14-bit converted pixel data HD, which have been converted in accordance with the conversion table as shown in FIG. 28, are divided into the respective bit digits, and sequentially read from the memory 4 from the 1st bit to the 14th bit and supplied to the address driver 6 in one field period.

The address driver 6 generates pixel data pulses $DP_1$–$DP_m$ each having a voltage corresponding to a logical level of a corresponding one in a group of pixel data bits for each row, read from the memory 4, and an erasing pulse AP for erasing a remaining charge, and applies these pulses to column electrodes $D_1$–$D_m$ of the PDP 10 at the timings as illustrated in FIGS. 30A through 30G or FIGS. 31A through 31G.

The driving control circuit 2 generates a clock signal to the A/D converter 1 and write and read signals to the memory 4 in synchronism with horizontal and vertical synchronization signals in an input video signal. The driving control circuit 2 also generates a pixel data timing signal, a reset timing signal, a scan timing signal and a sustain timing signal in synchronism with the horizontal and vertical synchronization signals. In this event, the driving control circuit 2 sets the number of times (or a period in which) the sustain timing signal is supplied in each light emission sustaining stage Ic illustrated in FIGS. 14 or 15, i.e., the number of the sustain timing pulses supplied in each light emission sustaining stage Ic illustrated in FIGS. 14 or 15 in accordance with a mode specified by a luminance mode signal LC as shown in FIG. 20. For example, in the light emission sustaining stage Ic in a subfield SF1 illustrated in FIGS. 14 or 15, the number of sustain timing pulses is set to "1" when a mode 1 is specified by the luminance mode signal LC; to "2" when a mode 2 is specified; to "3" when a mode 3 is specified; and to "4" when a mode 4 is specified.

Figures 30A, 30B, 30C, 30D, 30E, 30F, 30G:
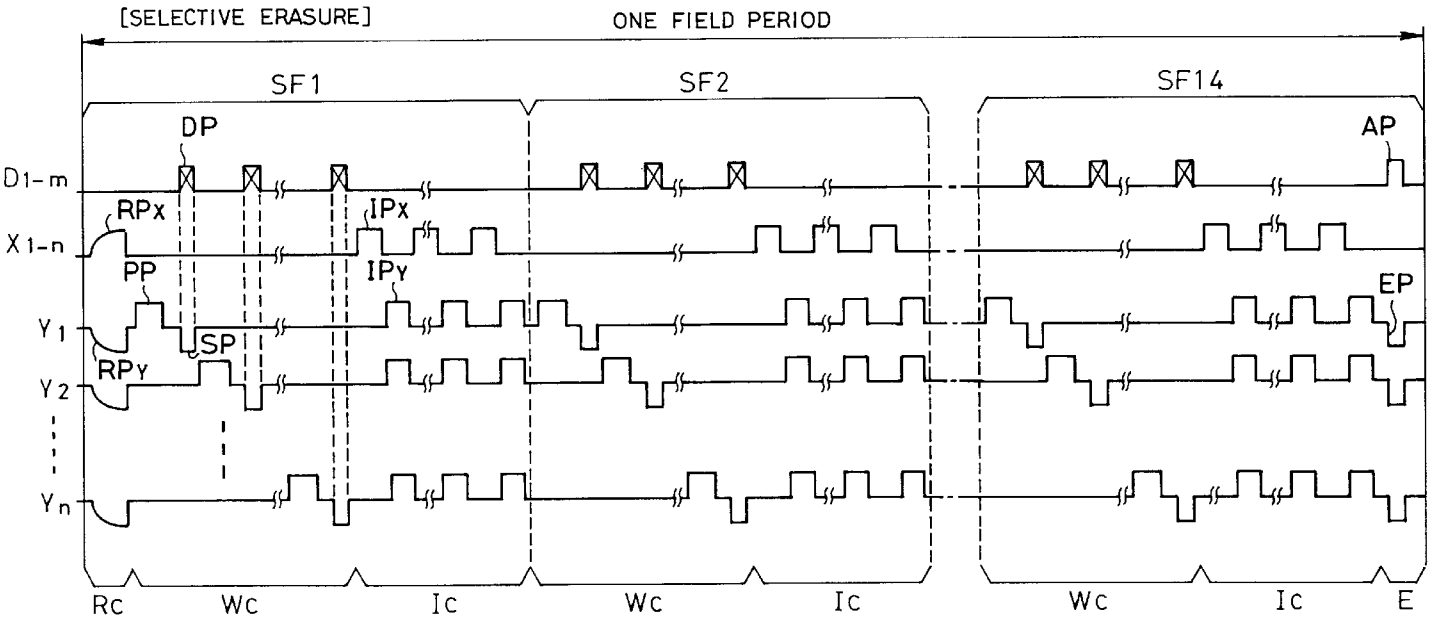
FIGS. 30A to 30G are waveform charts showing application timings for a variety of driving pulses according to a driving method of the present invention (selective erasure address method)
Figures 31A, 31B, 31C, 31D, 31E, 31F, 31G:
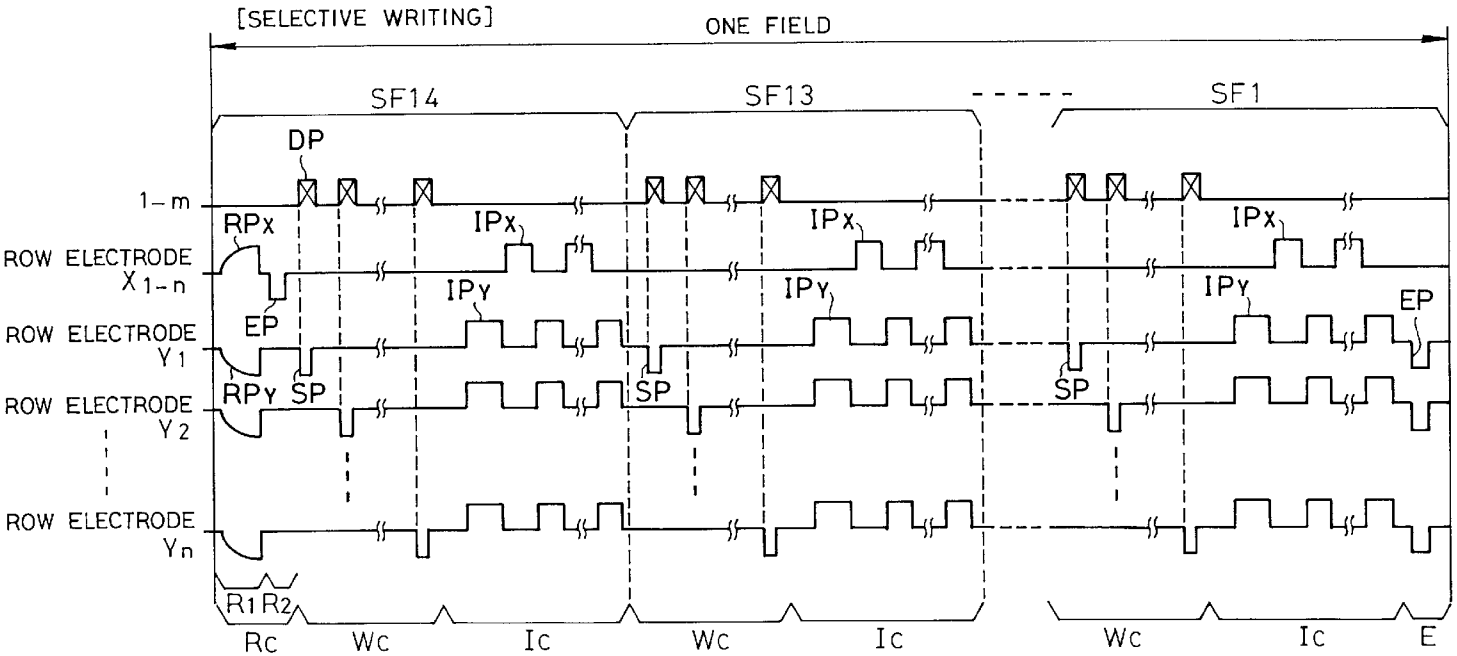
FIGS. 31A to 31G are waveform charts showing application timings for a variety of driving pulses according to a driving method of the present invention (selective writing method)

A first sustain driver 7 generates a resetting pulse $RP_X$ for initializing a residual charge amount, and a sustaining pulse $IP_X$ for sustaining a discharge light emitting state in response to a variety of timing signals supplied from the driving control circuit 2, and applies these pulses to row electrodes $X_1$–$X_n$ of the PDP 10 at timings as illustrated in FIGS. 30C or 31C. A second sustain driver 8 generates a resetting pulse $RP_Y$ for initializing a residual charge amount, a scanning pulse SP for writing pixel data, a priming pulse PP for successfully performing the writing of pixel data, a sustaining pulse $IP_Y$ for sustaining a discharge light emitting state, and an erasing pulse EP for erasing remaining wall charge in response to a variety of timing signals supplied from the driving control circuit 2, and applies these pulses to row electrodes $Y_1$–$Y_n$ of the PDP 10 at timings as illustrated in FIGS. 30D to 30F or in FIGS. 31D to 31F.

FIGS. 30A–30G illustrate application timings for a variety of driving pulses in one field period during the light emission driving in accordance with the selective erasure address method, while FIGS. 31A–31G illustrate application timings for a variety of driving pulses in one field period during the light emission driving in accordance with the selective writing address method. In this event, when the light emission is driven in accordance with the selective writing address method illustrated in FIGS. 31A–31G, the first sustain driver 7 and the second sustain driver 8 first apply the resetting pulses $RP_X$, $RP_Y$, respectively to row electrodes X, Y of the PDP 10 to reset or discharge all discharge cells in the PDP 10 to forcedly form a wall discharge in each of the discharge cells ($R_1$ in FIG. 31G). Immediately after the application of these pulses, the first sustain driver 7 simultaneously applies the erasing pulse EP to the row electrodes $X_1$–$X_n$ of the PDP 10 to erase the wall charges formed in all the discharge cells ($R_2$ in FIG. 31G). A sequence of operations $R_1$, $R_2$ implements the simultaneous resetting stage Rc. In a pixel data writing stage Wc in FIGS. 31A–31G, discharge occurs only in a discharge cell at the intersection of a "row" applied with the scanning pulse SP with a "column" applied with a high-voltage pixel data pulse to selectively erase the wall charge remaining in the discharge cell. Such selective erasure results in setting a light emitting discharge cell in which discharge light emission is performed in a light emission sustaining stage Ic and a non-light emitting discharge cell in which discharge light emission is not performed.

Here, when light emission is driven in accordance with the selective erasure address method, erasing discharge is selectively performed only in a subfield SF corresponding to a bit at logical level "1" in converted pixel data HD (indicated by a black circle), as shown in FIG. 28. In this event, a lighting state is sustained in subfields SF which exist between the first subfield SF1 and the subfield in which the selective erasing discharge is performed (indicated by white circles). After the selective erasing discharge, an extinct state is sustained.

When light emission is driven in accordance with the selective writing address method, selective write discharge is performed only in a subfield SF corresponding to a bit at logical level "1" in converted pixel data HD (indicated by a black circle), as shown in FIG. 29. In this event, an extinct state is sustained in subfields SF which exist between the first subfield SF14 and the subfield in which the selective write discharge is performed, and a lighting state is sustained in subfields SF which exist subsequent to the subfield SF in which the selective write discharge is performed (indicated by white circles).

Therefore, according to the configuration as described, light emission is driven for the PDP 10 with 15 levels of luminance of emitted light, as shown in FIGS. 28 and 29. Thus, the ratio of emitted light luminance is as follows:

{0, 1, 4, 9, 17, 27, 40, 56, 75, 97, 122, 150, 182, 217, 256}

However, with the operation of the half-tone processing circuit 33, actually visualized gradation is represented at more than 15 levels.

It should be noted that actual luminance of emitted light may change depending on a mode specified by the luminance mode signal LC as shown in FIG. 20. Specifically, a light emission period in each of the light emission sustaining stages Ic illustrated in FIGS. 14 and 15 is defined for the mode 1 in FIG. 20. Otherwise, luminance twice as much as that of the mode 1 is represented when the mode 2 is specified by the luminance mode signal LC; three times when the mode 3 is specified; and four times when the mode 4 is specified.

As described above, the driving method illustrated in FIGS. 14 and FIGS. 31A–31G is such that the simultaneous resetting stage Rc is executed only at the subfield located at the head of one field period while desired luminance is maintained, and the respective discharge pixels are set to either a light emitting cell or a non-light emitting cell in accordance with pixel data only in a pixel data writing stage of any one of subfields. In this event, the luminance may be increased by bringing the subfields in one field into a lighting state in order from the first subfield when the selective erasure address method is employed, or by bringing the subfields in one field into a lighting state in order from the last subfield when the selective writing address method is employed.

In the driving method illustrated in FIGS. 14 and FIGS. 31A–31G, it is therefore possible to improve the contrast as compared with a driving method as illustrated in FIG. 13 which requires the simultaneous resetting stage Rc twice in one field period. Also, since this driving method has a reduced number of times of centroid movements upon bit rising in one field, i.e., the number of transitions from a lighting state to an extinct state (or from an extinct state to a lighting state) in one field period, a pseudo-contour can be sufficiently reduced. Further, since this driving method requires the selective erasing operation (selective writing operation) for writing pixel data only once in one field period, power consumption associated with addressing is largely reduced.

Figure 32:
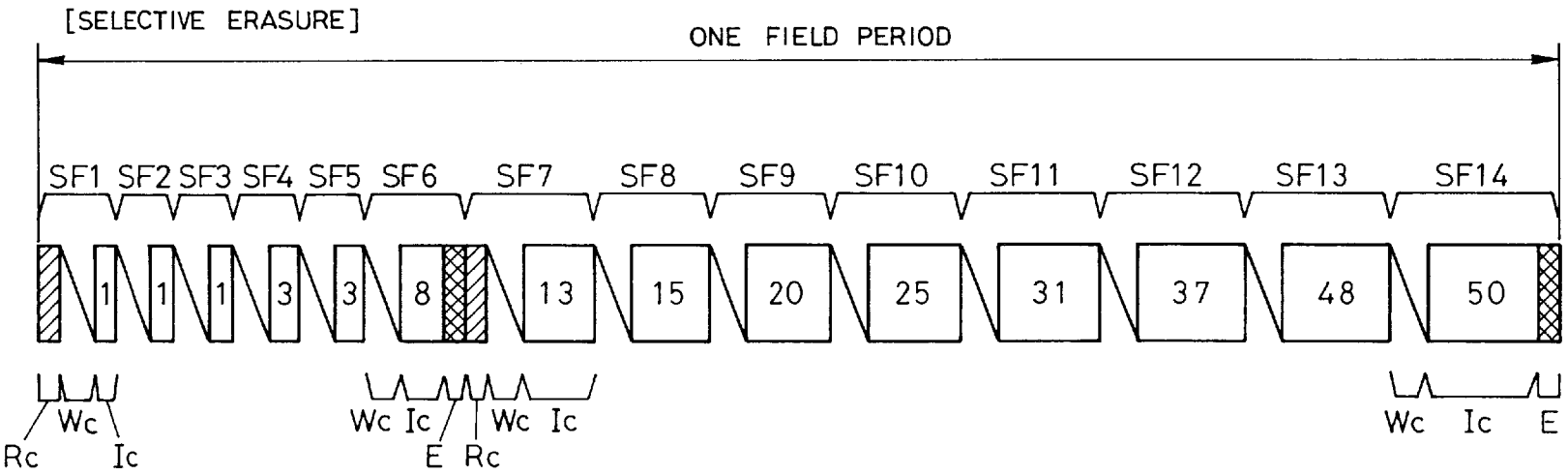
FIG. 32 illustrates another example of a light emission driving format (selective erasure address method) according to the present invention.
Figure 33:
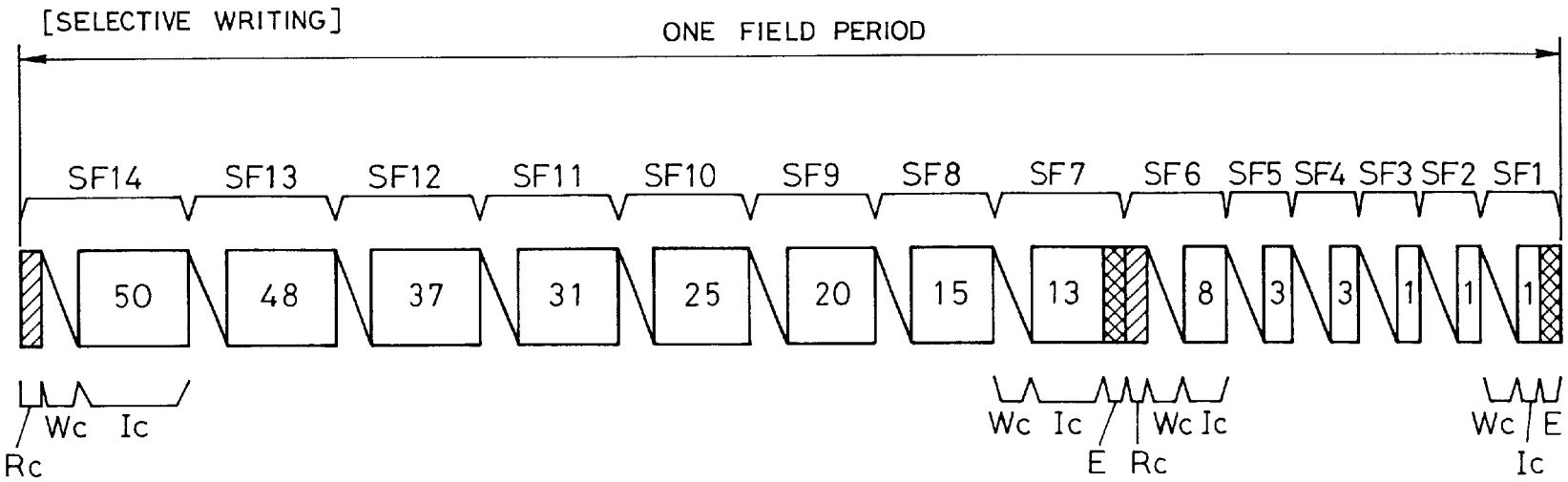
FIG. 33 illustrates another example of a light emission driving format (selective writing method) according to the present invention.

FIGS. 32 and 33 illustrate other light emission driving formats for driving light emission with the configuration illustrated in FIGS. 16–18.

In the light emission driving formats illustrated in FIGS. 32 and 33, subfields in one field is divided into two groups of subfields each including a plurality of subfields arranged consecutively to each other, wherein a simultaneous resetting stage Rc is executed only in a subfield arranged at the head of each subfield group, and each of discharge cell is set to either a light emitting cell or a non-light emitting cell in accordance with pixel data only in a pixel data writing stage in any one of the subfields. Thus, in each of the subfield groups, the simultaneous resetting operation and the selective erasing operation (selective writing operation) are each performed once. In this event, the luminance may be increased by bringing the subfields in one field into a lighting state in order from the first subfield when the selective erasure address method is employed, or by bringing the subfields in one field into a lighting state in order from the last subfield when the selective writing address method is employed.

Specifically, FIG. 32 illustrates a light emission driving format for writing pixel data in accordance with the selective erasure address method as mentioned above in the pixel data writing stage Wc, while FIG. 33 illustrates a light emission driving format for writing pixel data in accordance with the selective writing address method.

In the light emission driving formats illustrated in FIGS. 32 and 33, one field period is divided into 14 subfields SF1–SF14. Each of the subfields SF1–SF14 includes a pixel data writing stage Wc for writing pixel data to set discharge cells to light emitting cells or non-light emitting cells, and a light emission sustaining stage Ic for sustaining a discharge light emitting state only in the light emitting cells. In this event, a light emitting time (the number of times of light emission) in each light emission sustaining stage Ic of the subfields SF1–SF14 is as follows, assuming that a light emitting time in the subfield SF1 is "1":

SF1: 1
SF2: 1
SF3: 1
SF4: 3
SF5: 3
SF6: 8
SF7: 13
SF8: 15
SF9: 20
SF10: 25
SF11: 31
SF12: 37
SF13: 48
SF14: 50

Specifically, the ratio of the numbers of times of light emission in the respective subfields SF1–SF14 is set nonlinear (i.e., an inverse gamma ratio: $Y=X^{2.2}$) to correct a nonlinear characteristic (gamma characteristic) of input pixel data D.

Further, in these subfields, the simultaneous resetting stage Rc is executed in the first subfield and an intermediate subfield in these subfields. Specifically, the simultaneous resetting stage Rc is executed in the subfields SF1, SF7 in the light emission driving format when employing the selective erasure address method as illustrated in FIG. 32, and in the subfield SF14, SF6 in the light emission driving format when employing the selective writing method as illustrated in FIG. 33. In addition, an erasing stage E for extinguishing wall charges remaining in all discharge cells is executed in the last subfield of one field period and in subfields immediately before the subfields in which the simultaneous resetting stage Rc is executed, as illustrated in FIGS. 32 and 33.

Figure 34:
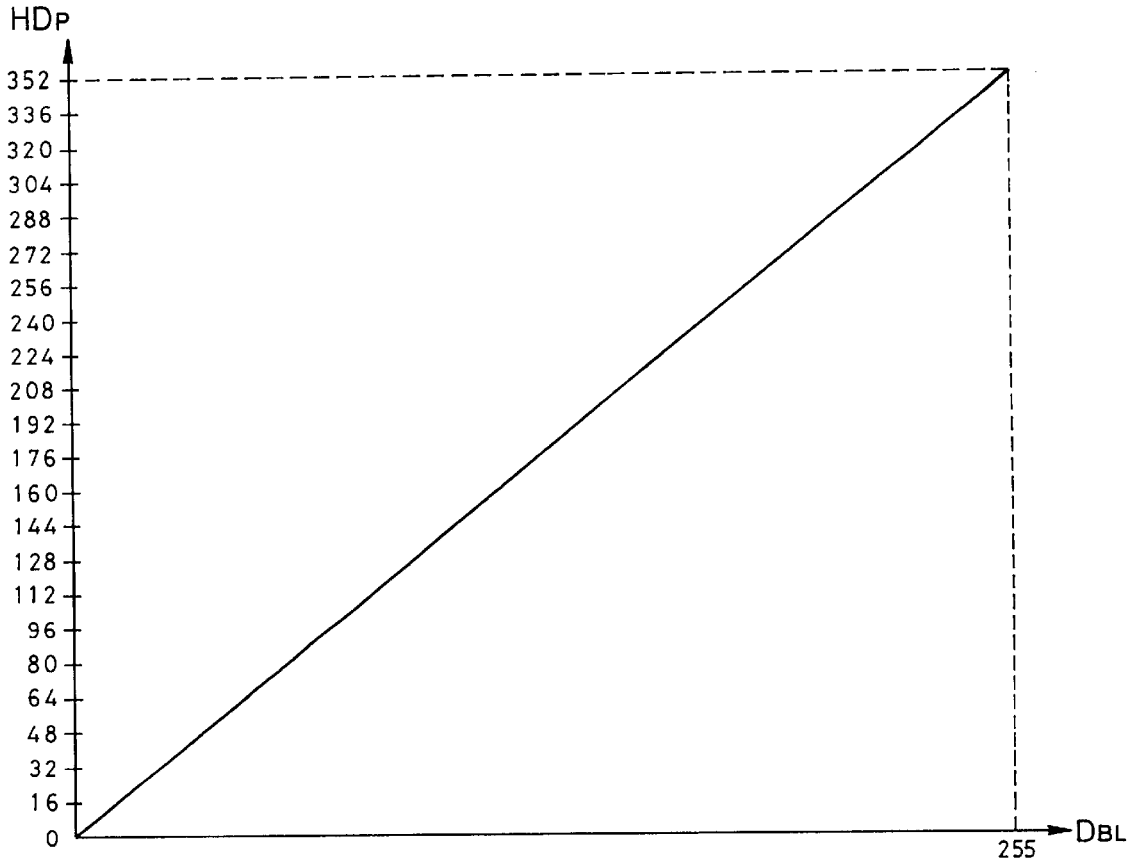
FIG. 34 is a graph illustrating another example of a conversion characteristic in the first data converting circuit 32.

FIG. 34 illustrates a conversion characteristic of the first data converting circuit 32 in FIG. 17 which is applied when the light emission driving is performed on the basis of the light emission driving formats illustrated in FIGS. 32 and 33. FIGS. 35 and 36 show an example of a conversion table based on the conversion characteristic of FIG. 34.

Here, in the first data converting circuit 32 converts input luminance adjusted pixel data $D_{BL}$ capable of representing 256 steps of gradation (8 bits) to 9-bit (0–352) converted pixel data $HD_P$ having the number of gradation levels increased by 22×16/255 (352/255), based on a conversion table of FIGS. 35 and 36, and supplies the converted pixel data $HD_P$ to the multi-level gradation conversion processing circuit 33. The multi-level gradation conversion processing circuit 33 performs, for example, 4-bit compress processing similar to the foregoing to output 5-bit multi-level gradation converted pixel data $D_S$ (0–22).

FIGS. 37 and 38 each show a conversion table for use in the second data converting circuit 34 illustrated in FIG. 17, and a driving state in one field. Specifically, FIG. 37 shows a conversion table used when light emission is driven in accordance with the selective erasure address method as illustrated in FIG. 32, while FIG. 38 shows a conversion table used when light emission is driven in accordance with the selective writing method as illustrated in FIG. 33.

In FIGS. 37 and 38, multi-level gradation converted pixel data $D_S$ is produced by increasing the number of possible gradation levels of the 8-bit input pixel data D (256 gradation levels) in a ratio of 352/225 in accordance with a first data conversion (the conversion table in FIGS. 22 and 23), and converting the increased data to 5-bit data (0–22: 23 gradation levels) by multi-level gradation conversion processing (for example, a total of four bits are compressed, two bits in the error diffusion processing and two bits in the dither processing).

According to the configuration illustrated in FIGS. 32 to 38, even if the simultaneous resetting stage Rc and the selective erasing operation (selective writing operation) are performed twice in one field period, an improved contrast, a reduced pseudo-contour and reduced power consumption associated with addressing are achieved, as compared with the driving method illustrated in FIG. 13.

Also, according to the configuration illustrated in FIGS. 32 to 38, since 23 levels of display gradation can be provided, the number of levels of display gradation is increased as compared with the configuration illustrated in FIGS. 14 and FIGS. 31A to 31G (having 15 levels of display gradation).

In the light emission driving pattern shown in FIGS. 28, 29, 37 and 38, the selective erasing (write) discharge is generated in the pixel data writing stage Wc by simultaneously applying the scanning pulse SP and the pixel data pulse of a high voltage.

However, if the amount of charge particles remaining in the discharge cell is small, there can be a case that the selective erasing (write) discharge is not generated normally even if the scanning pulse SP and the pixel data pulse of a high voltage are applied simultaneously, so that the wall charge in the discharge cell is not erased or formed. In such a case, a light emission corresponding to the highest luminance level will be effected even if the pixel data D after the A/D conversion represents a low luminance level. This will greatly degrade the quality of the image.

For instance, in the case where the selective erasure address scheme is adopted as the pixel data writing method, if the converted pixel data HD is [0,1,0,0,0

In the example shown in FIG. 40, as shown by the black dots in the figure, the second selective erasing (write) discharge is performed after the lapse of one subfield subsequent to the execution of the first selective erasing (write) discharge.

It should be also noted that the number of times of the selective erasure (writin) discharge to be performed in one field period is not limited to twice.

FIGS. 41 and 43 show a pattern of the light emitting driving and an example of the conversion table of the second data converting circuit 34 adopted in view of the point described above.

The sign "*" shown in FIGS. 41 and 43 represents that it may take either one of logical values "1" and "0", and the triangle indicates that the selective erasing (write) discharge is performed only when the sign "*" has the logical level "1".

Briefly speaking, since the writing of the pixel data can be failed only with the first selective erasing (write) discharge, the selective erasing (write) discharge is performed once more in one of the subfields existing thereafter, so as to ensure the writing of the pixel data.

As specifically described above, in the embodiment shown in FIGS. 39–45, the display period of one field is divided to N (N is a natural number) subfields, and a subfield group of consecutive M ($2 \leqq M \leqq N$) subfields is formed. A discharge to initialize all of the discharge cell to one of the state of the light emitting cell and the state of the non-light emitting cell is produced only in the subfield in the head part of the subfield group. The writing of the pixel data is performed by applying, in one of the subfields in the the subfield group, first data pulse which generates a discharge to set each discharge cell to one of the non-light emitting cell and the light emitting cell. In each subfield, only the light emitting cells are driven to emmit light for a light emission period corresponding to the weight of the subfield. In this operation, the writing of the pixel data is ensured by the application of a second pixel data pulse which is the same as the first pixel data pulse in one of the subfields existing after the application of the first pixel data pulse.

As described above in detail, since the present invention can reduce the number of times the simultaneous resetting operation is performed for initializing all discharge cells in one field, the resulting image can be enhanced in contrast. Further, since the present invention can reduce the number of times the selective erasing (write) discharge is performed in each pixel data writing stage within one field period, a reduction in power consumption is achieved. Furthermore, since the present invention can prevent adjacent discharge cells in a light emission pattern from inverting with respect to each other even when a display includes a small amount of changes in luminance levels, the pseudo-contour can be suppressed.

What is claimed is:

1. A method of driving a plasma display panel having a discharge cell corresponding to one pixel at each intersection of each of a plurality of row electrodes arranged to form each scanning line with each of a plurality of column electrodes intersecting with said row electrodes, said method comprising the steps of:

dividing a display period of one field into a plurality of subfields;

executing a resetting stage, which simultaneously initializes all said discharge cells, wherein said resetting stage is executed only in the first subfield of said one field;

after said resetting stage, setting said discharge cells to either light emitting cells or non-light emitting cells in accordance with display pixel data only in a pixel data writing stage in one or less of said subfields in said one field;

wherein said subfields comprise N consecutive subfields in said one field, wherein N consecutive subfields define N+1 levels of gradation, wherein an $(N+1)^{th}$ gradation level is displayed in said light emitting cells by continuously sustaining light emission in said light emission sustaining stage, without interruption, in each of n consecutive subfields of said N consecutive subfields, wherein $0 \leqq m \leqq N$, and wherein said pixel data writing stage for the discharge cell is provided only once or less in said one field without regard to the level of gradation.

2. A method of driving a plasma display panel according to claim 1, further comprising the step of:

executing an erasing stage for erasing wall charges in all of said discharge cell in the last subfield of said one field.

3. A method of driving a plasma panel display according to claim 1, wherein:

said step of executing said resetting stage includes simultaneously discharging all said discharge cells to form wall charges therein to set all said discharge cells to said light emitting cells; and said step of executing said pixel data writing stage in any of said subfields in said one field includes selectively erasing said wall charges formed in said resetting stage in accordance with said display pixel data.

4. A method of driving a plasma display panel according to claim 3, further comprising the step of:

performing a priming discharge for once discharging and exciting said discharge cells to form charged particles in a discharge space of said discharge cells immediately before said wall charges are selectively erased in said pixel data writing stage in any of said subfield in said one field.

5. A method of driving plasma display panel according to claim 1, wherein:

said step of executing said resetting stage includes performing an erasing discharge for simultaneously discharging all said discharge cells to erase said wall charges immediately after said wall charges have been formed in all said discharge cells to set all said discharge cells to said non-light emitting cells; and said step of executing said pixel data writing stage in any of said subfields in said one field includes forming said wall charges in accordance with said display pixel data.

6. A method of driving plasma display panel according to claim 1, wherein the ratio of said light emitting periods in said light emission sustaining stages in N of said subfields arranged in said one field is set nonlinear to correct input pixel data for a nonlinear display characteristic.

7. A method of driving plasma display panel according to claim 6, wherein said nonlinear display characteristic is an inverse gamma correction characteristic.

8. A method of driving plasma display panel according to claim 6, further comprising the step of performing multi-level gradation conversion processing on said input pixel data before said nonlinear display characteristic is corrected.

9. A method of driving plasma display panel according to claim 8, wherein said multi-level gradation conversion processing includes error diffusion processing and/or dither processing.

10. A method of driving plasma display panel according to claim 8, further comprising the step of, prior to performing said multi-level gradation conversion processing, converting said input pixel data to separate said input pixel data into a group of upper bits required for said multi-level gradation conversion processing and a group of lower bits on a bit boundary.

11. A method of driving plasma display panel according to claim 1, wherein the number of subfields allocated to low luminance light emission is larger than the number of subfields allocated to high luminance light emission in said subfields arranged in said one field.

12. A method of driving plasma display panel according to claim 6, further comprising the steps of:

providing a luminance adjusting stage for adjusting the luminance before said nonlinear characteristic is corrected; and converting said input pixel data in said luminance adjusting stage to perform the same correction as the correction for said nonlinear characteristic to derive corrected pixel data; and adjusting said input pixel data in accordance with an average luminance level of said corrected pixel data and/or said light emitting period in said light emission sustaining stage in each of said subfields.

13. A method of driving a plasma display panel for driving a plasma display panel having discharge cells each corresponding to one pixel at each intersection of each of a plurality of row electrodes arranged for each scanning line with each of a plurality of column electrodes intersecting with said row electrodes, said method comprising the steps of:

dividing a display period of one field into N (N is a natural number) subfields; and executing in order, a resetting stage for producing a discharge to initialize all of said discharge cells to a state of either of a light emitting cell or a non-light emitting cell only in a subset of said subfields, wherein said subset of said subfields is located in a head portion of said N subfields, a pixel data writing stage for applying to said column electrodes a first pixel data pulse which produces a discharge to set said discharge cells as said non-light emitting cell or said light emitting cell in one of said subfields in said N subfields, and applying to said column electrodes a second pixel data pulse which is the same as said first pixel data pulse in at least one of said subfields existing afterwards in said N subfields, and a light emission sustaining stage for producing a discharge for causing only discharge cells set as said light emitting cell in each of said N subfields to emit light for a light emitting period corresponding to a weighting of said subfields, wherein said subfields comprise N consecutive subfields in said one field, wherein said N consecutive subfields define N+1 levels of gradation, wherein an $(n+1)^{th}$ gradation level is displayed in said light emitting cells by continuously sustaining light emission in said light emission sustaining stage, without interruption, in each of n consecutive subfields of said N consecutive subfields, wherein $0 \leqq n \leqq N$, and wherein said pixel data writing stage for the discharge cell is provided only twice or less in said one field without regard to the level of gradation.

14. A method of driving a plasma display panel according to claim 13, wherein said second data pulse is applied to said column electrodes in said subfields to which said first data pulse has been applied immediately before.

15. A method of driving a plasma display panel according to claim 13, further comprising an erasing stage for producing a discharge which sets all of said discharge cells to a state of the non-discharge cell only in a last one of said subfields in said one field.

16. A method of driving a plasma display panel according to claim 13, wherein in said resetting stage a discharge which initializes all of said discharge cells to said state of said light emitting cell is produced, and in said pixel data writing stage said first pixel data pulse to generate a discharge which sets said discharge cells as said non-light emitting cell and said second pixel data pulse which is the same as said first pixel data pulse are applied to said column electrodes.

17. A method of driving a plasma display panel according to claim 13, wherein in said resetting stage a discharge which initializes all of said discharge cells to said state of said non-light emitting cell is produced, and in said pixel data writing stage said first pixel data pulse to generate a discharge which sets said discharge cells as said light emitting cell and said second pixel data pulse which is the same as said first pixel data pulse are applied to said column electrodes.

18. A method of driving a plasma display according to claim 1, wherein said discharge cells are set to either said light emitting cells or said non-light emitting cells only in said pixel data writing stage in only one of said sub fields in said one field.

19. A method of driving a plasma display panel as claimed in claim 1, wherein when luminance of a discharge cell is to be changed from a first level to a second level which is one step higher than said first level among said N+1 levels of gradation, luminance is increased by additionally allowing one subfield to emit light besides subfields which have been allowed to emit light to attain said first level.

20. A method of driving a plasma display panel as claimed in claim 13, wherein when luminance of a discharge cell is to be changed from a first level to a second level which is one step higher than said first level among said N+1 levels of gradation, luminance is increased by additionally allowing one subfield to emit light besides subfields which have been allowed to emit light to attain said first level.

* * * * *